US007331882B1

(12) United States Patent
White

(10) Patent No.: US 7,331,882 B1
(45) Date of Patent: Feb. 19, 2008

(54) NO TOOLS BASKETBALL SYSTEM AND ASSEMBLY

(75) Inventor: Ronald White, North Prairie, WI (US)

(73) Assignee: Russell Corporation, Atlanta, GA (US)

( * ) Notice: Subject to any disclaimer, the term of this patent is extended or adjusted under 35 U.S.C. 154(b) by 283 days.

(21) Appl. No.: 11/030,891

(22) Filed: Jan. 10, 2005

Related U.S. Application Data

(60) Provisional application No. 60/534,690, filed on Jan. 8, 2004.

(51) Int. Cl.
*A63B 63/08* (2006.01)

(52) U.S. Cl. ..... 473/481; 473/479

(58) Field of Classification Search ..... 473/481, 473/479, 483, 485, 476, 472, 484, 486, 447
See application file for complete search history.

(56) References Cited

U.S. PATENT DOCUMENTS

| | | | | |
|---|---|---|---|---|
| 1,522,957 | A * | 1/1925 | Kennedy | 473/488 |
| 3,602,505 | A * | 8/1971 | Friend | 473/470 |
| 4,613,135 | A * | 9/1986 | Rush | 473/488 |
| 4,793,611 | A * | 12/1988 | Thornell | 473/483 |
| 5,259,612 | A * | 11/1993 | Matherne et al. | 473/484 |
| 5,377,976 | A | 1/1995 | Matherne et al. | |
| 5,470,054 | A * | 11/1995 | Bohrman | 473/481 |
| 5,480,139 | A * | 1/1996 | Owen et al. | 473/486 |
| 5,906,552 | A * | 5/1999 | Padilla | 473/421 |
| 6,503,160 | B2 | 1/2003 | Hehr | |
| 6,881,162 | B2 * | 4/2005 | Nye et al. | 473/481 |
| 2003/0032490 | A1 | 2/2003 | Martin et al. | |
| 2003/0092514 | A1 | 5/2003 | Nimwegen | |
| 2003/0134701 | A1 | 7/2003 | Nye | |
| 2003/0148834 | A1 | 8/2003 | Hehr | |

FOREIGN PATENT DOCUMENTS

| | | |
|---|---|---|
| WO | WO 03/066175 | 8/2003 |
| WO | WO 03/066176 | 8/2003 |
| WO | WO 03/066177 | 8/2003 |

OTHER PUBLICATIONS

InstaHop, Manufactured & Distributed By: Huffy Sports, A Huffy Company, http://www.huffysports.com, Copyright 2000.

* cited by examiner

*Primary Examiner*—Eugene Kim
*Assistant Examiner*—M. Chambers

(57) ABSTRACT

A portable basketball system that may be assembled without the need for hand tools. The present invention may include a regulation portable basketball system that is entirely assembled by hand with the use of hand grippable devices. The pole and supporting struts may be releasably secured to portable base by bolts and hand grippable nuts. The system according to the present invention may also secure the basketball goal, basketball backboard, and basketball pole using one or more bolts and hand grippable nuts. It is contemplated that hand grippable bolts and an attached nuts may be used to reduce the number of loose nuts during assembly.

17 Claims, 62 Drawing Sheets

NO TOOLS BASKETBALL SYSTEM AND ASSEMBLY

CROSS-REFERENCE TO RELATED APPLICATIONS

This application is a non-provisional application of U.S. Provisional Application No. 60/534,690 entitled "No Tools Basketball System and Assembly," filed on Jan. 8, 2004, the contents of which are hereby incorporated by reference in their entirety.

FIELD OF THE INVENTION

The present invention relates generally to a system and method for a no tools basketball system and assembly. In particular, the present invention relates to a basketball backboard system and apparatus that may be assembled without the need for tools.

BACKGROUND OF THE INVENTION

There are many basketball systems designed for use at home currently available. Such a conventional basketball system may include multiple parts that require assembly by the user. A conventional portable basketball system may include a goal or rim, a backboard, a vertical support, a base portion, side supports, a trailing arm and wheels. Each of the parts are typically interconnected accordingly with screws or bolts. Disadvantageously, such systems have been found to require multiple tools in order to properly assemble the basketball systems such as wrenches, pliers, screwdrivers, sockets, etc. It has been found in some prior basketball system that the required tools include uncommon tools, such as deep-weld sockets, not typically owned by basketball system consumers. Moreover, the assembly of such systems may also require many tools having a variety of sizes and shapes, thus either requiring that the manufacturer supply the tools and increase the size, weight and price of the end product or requiring the consumer to purchase expensive tools for assembly of the system.

It has also been found that prior basketball systems typically include a large amount of parts that must be assembled by the consumer.

Therefore, there exists a need for a user assembled basketball system with a minimal amount of parts to assemble, and which may be assembled without tools.

SUMMARY OF THE INVENTION

The present invention includes a portable basketball system that may be assembled without the need for hand tools.

In a first embodiment, the present invention includes a basketball system including a portable base portion having a front end, the front end having a pole slot positioned substantially along a center axis of the base portion; a pole having a top end with a first opening and a bottom end, the bottom end interfacing the front end of the base and received into the pole slot; a wheel assembly secured to the base portion, the wheel assembly comprising a pair of wheels, an axle securing the wheels to the base portion, such that when the wheel assembly is assembled, the pole is secured to the base in a substantially vertical position; and a backboard assembly, the backboard assembly comprising a pole bracket having a front plate with a second opening and a curved section sized and shaped to mate with the top end of the pole, a backboard having a first recess on a front side with a third opening passing through to a second recess on a backside of the backboard, a goal having a rim and a securing plate sized and shaped to be received in the recess, the securing plate having a fourth opening, a hand grippable securing knob, and a threaded bolt sized and shaped to be received in each of the first, second, third and fourth openings, where the knob is sized and shaped to secure the securing plate, the backboard, the bracket and the top end of the pole such that the curved section is secured to the top end of the pole, where the front end of the bracket abuts the second recess and the securing plate abuts the first recess.

The basketball system may also include a pair of struts, each strut having a top section and a bottom section, where each strut is connected to the pole at its top section and connected to the base at its bottom section.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE PREFERRED EMBODIMENTS

The present disclosure will now be described more fully with reference to the Figures in which an embodiment of the present disclosure is shown. The subject matter of this disclosure may, however, be embodied in many different forms and should not be construed as being limited to the embodiments set forth herein.

Figure 1:
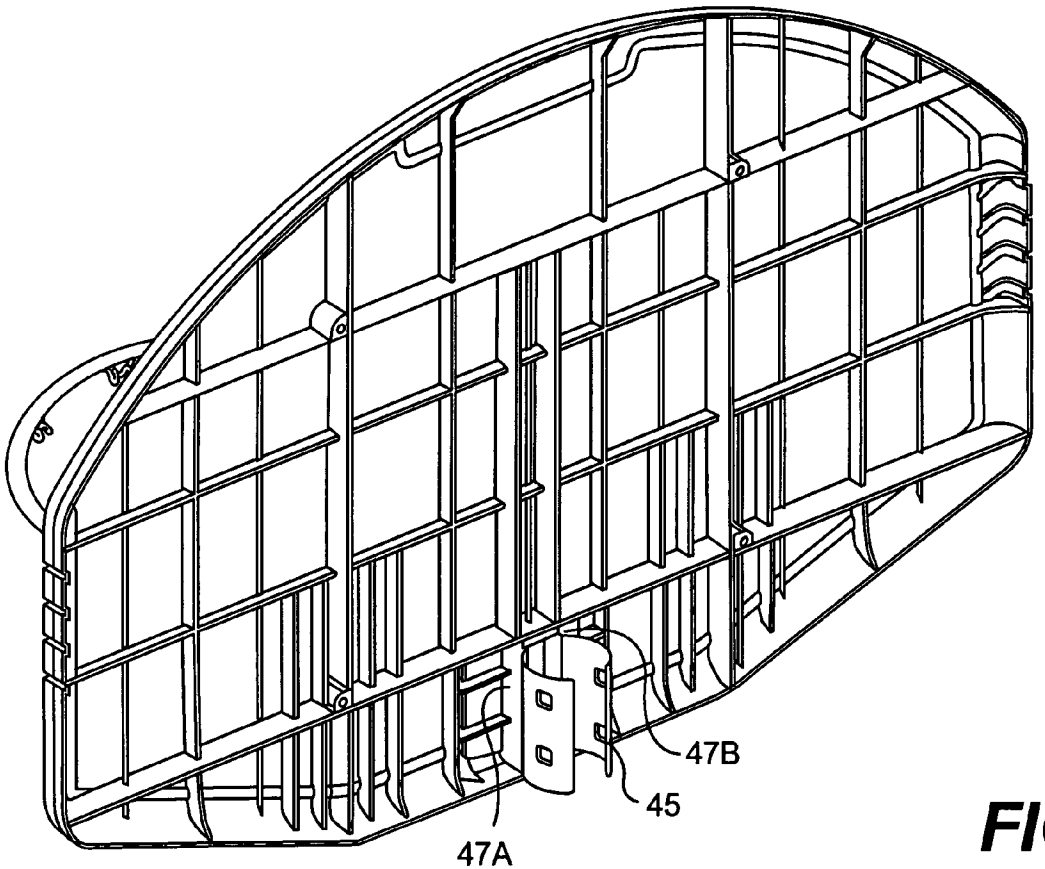
FIG. 1 shows a perspective view of a backboard according to one embodiment of the present invention.

Referring to FIG. 1, there is shown a rear side view of backboard 35, with goal 40 shown in the background on the front side of side backboard 35. Backboard 35 includes pole-mounting bracket 45. Backboard 35 also includes center ribs 47A and 47B running substantially up the middle section in vertical direction for support thereof. As shown in the FIG. 1, the ribs 27A and 47B form a recess in the backside of the backboard 35 for receiving a portion of the bracket 45.

Figure 2:
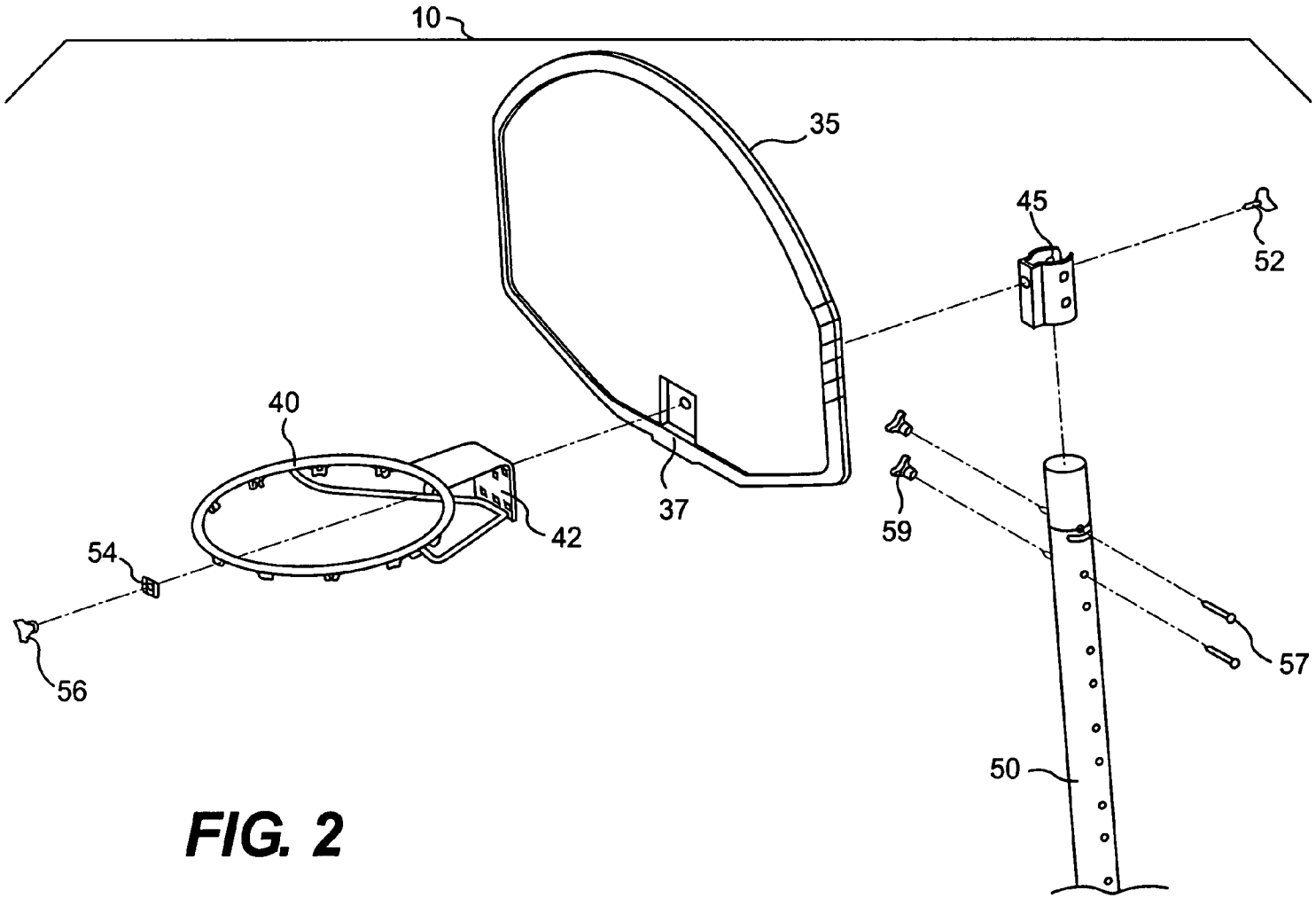
FIG. 2 shows a perspective view of the basketball system according to one embodiment of the present invention.

Referring to FIG. 2, an exploded view is shown of the various parts of the top portion of basketball system 10. Goal 40 may be secured to backboard 35 using the combination of bolt 52, washer 54 and hand grippable nut 56. Washer 54 abuts vertical plate 42 of goal 40, where plate 42 fits into slot 37 of backboard 35. Bolt 52 runs through the interior of bracket 45, backboard 35 at slot 37 and through plate 42 and is secured by washer 54 and nut 56. Backboard 35 is secured to support pole 50 via bracket 45 with a combination of bolts 57 and grippable nuts 59. Each of nuts 56 and 59 are sized and shaped to be easily grippable and securable by a user without the need for a hand tool. In some alternative embodiments nuts 56 and 59 are lockable.

Figure 3:
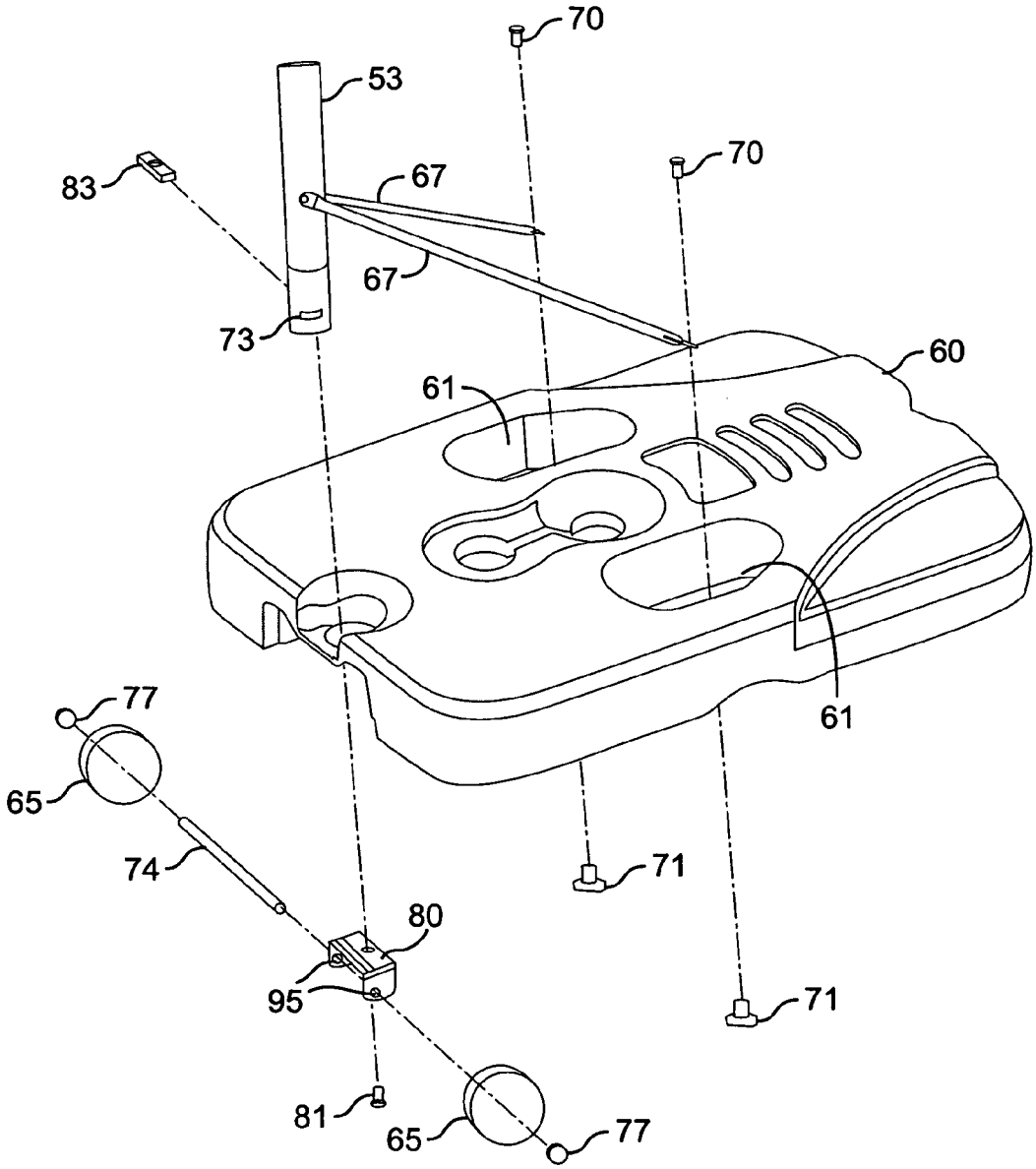
FIG. 3 shows a perspective view of the basketball system according to one embodiment of the present invention.

Referring now to FIG. 3, an exploded view is shown of the bottom portion of basketball system 10. Base 60 supports the entire system 10. The base 60 includes a recess 90 in the top of the base 60 for receiving and supporting the pole 50. The rectangular bracket 83 slides into bracket slot 73 on pole 50. Bolt 81 interfaces with rectangular bracket 83 through wheel bracket 80 to secure the pole 50 to the base 60. Wheel bracket 80 abuts and is secured to the underside of base 60 at bottom slot 93. Wheel bracket 83 interfaces with axle 74 through holes 95. Wheels 65 are secured to axle 74 with washers 77 when the ends of axle 74 are rotationally secured to the underside of base 60. Axle 74 may be rotationally secured in notches (not shown) and is prevented from abutting wheels 65 against the underside of base 60 by washers 77. Once the connecting system that includes elements 50, 81, 83, 90, and 74 is assembled pole 50 is affixed in an upright position. Struts 67 extending from base 60 to pole 50 in order to further support pole 50. Struts 67 are secured to base 60 via bolts 70 and hand grippable nuts 71. In some embodiments, wheel bracket 83 is secured to pole 50 via welding, sealing or other similar manufacture process in order to limit the number of parts to be assembled.

Figure 4:
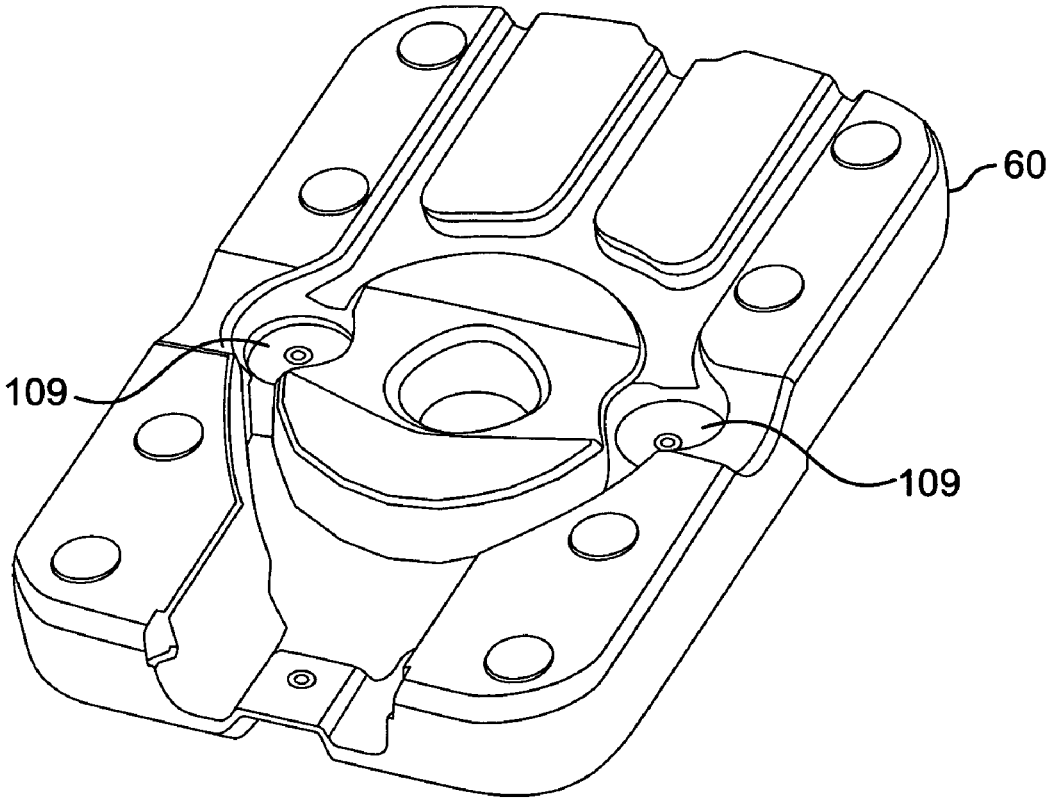
FIG. 4 shows an underside view of the base according one embodiment of the present invention.

FIG. 4 shows an underside view of one example of a base 60 according to the present invention. Recesses 109 may be located on a midline that runs through the center of base 60 and are capable of receiving hand grippable nuts 71 to secure struts 67 to base 60.

Figure 5A:
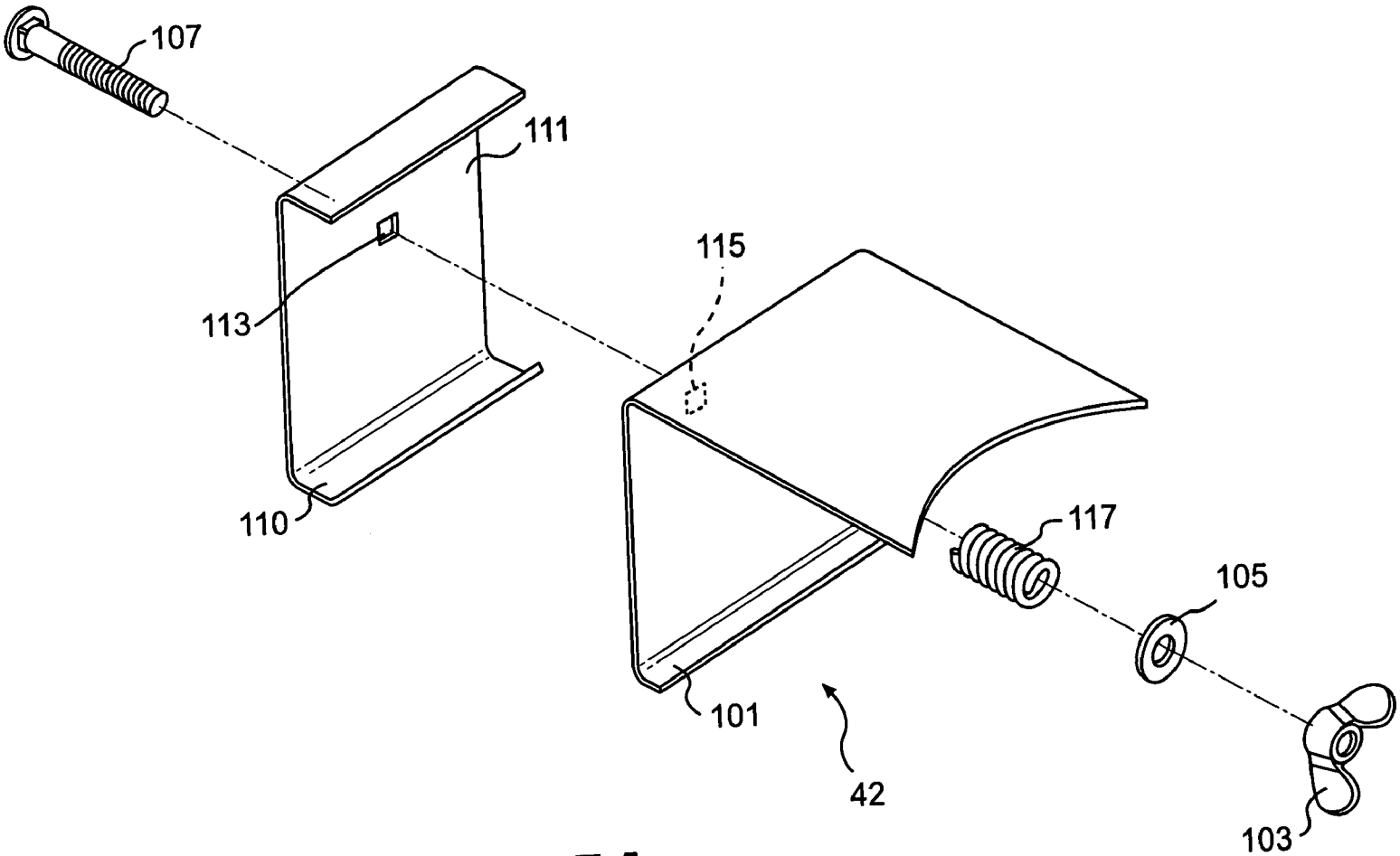
FIGS. 5A-5B show a goal support assembly according to one embodiment of the present invention.
Figure 5B:
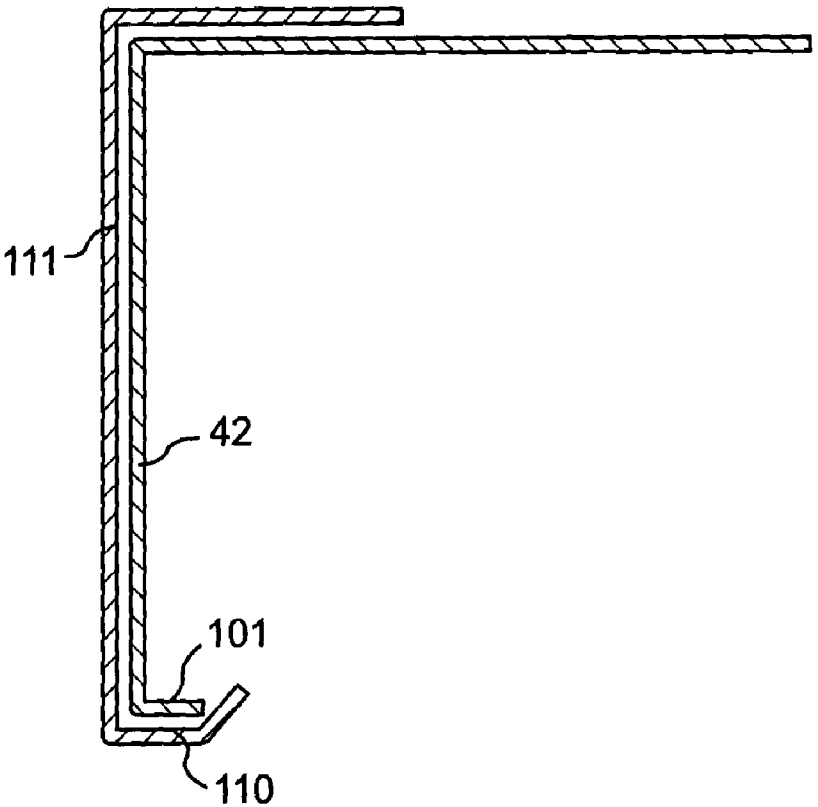

In FIGS. 5A and 5B, an alternative embodiment of the attachment of goal 40 to backboard 35 assembly is shown. The attachment includes the plate 42, which includes edge 101 and is structured and arranged to nest and pivotally engage lip 110 of rim seat 111 (as shown in FIG. 5B). Goal 40 may be affixed to rim seat 111 (and ultimately to backboard 35, not shown) with carriage bolt 107, spring 117, washer 105 and wingnut 103. Carriage bolt is sized to frictionally engage opening 113 in the rim seat 111 and pass through opening 115 of plate 42 to be secured by spring 117, washer 105 and wingnut 103. Upon downward action of goal 40, plate 42 is arranged so that it may pivot about the lip 110, compressing the spring 117. Upon release of the downward action, spring 117 may cause a return of the goal to its normal position. It should be obvious to one of ordinary skill that the rim seat 111 may be attached to the backboard 35 according to standard mechanical practices or be formed integrally with the backboard 35 without deviating from the scope and spirit of the present invention.

Figure 6A:
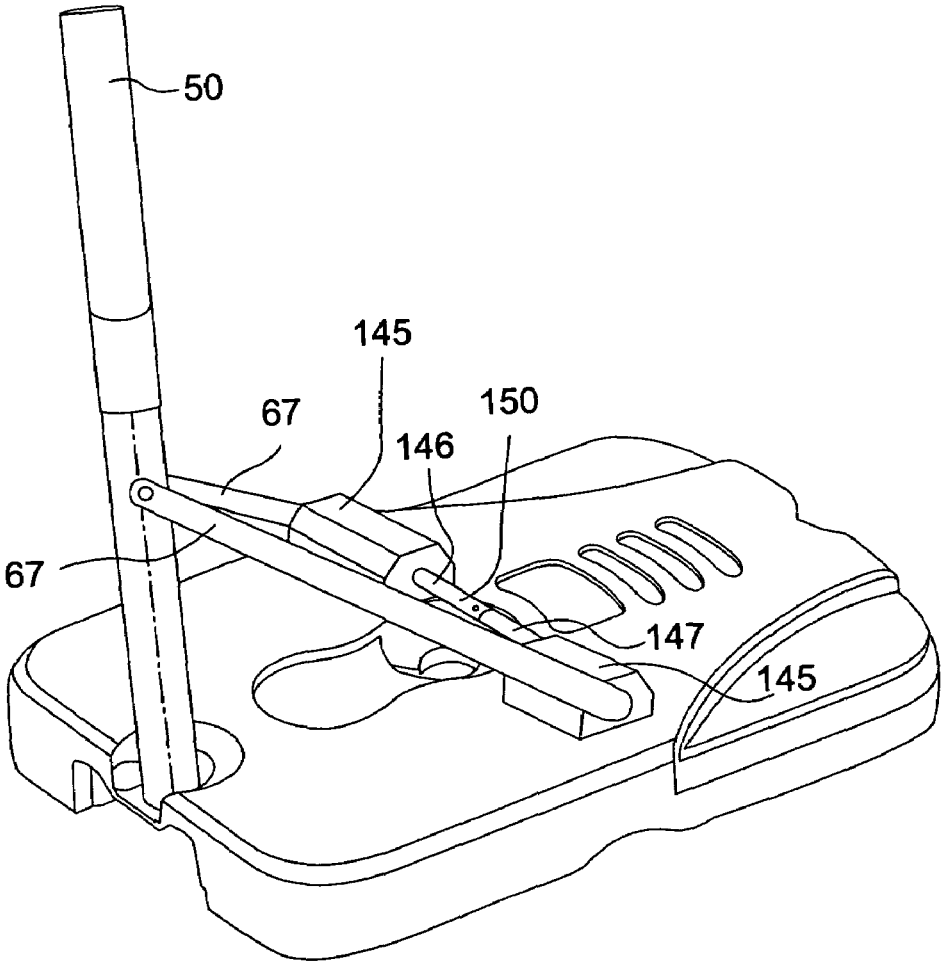
FIGS. 6A-6D show a view of a pole and strut assembly according to one embodiment of the present invention.
Figure 6B:
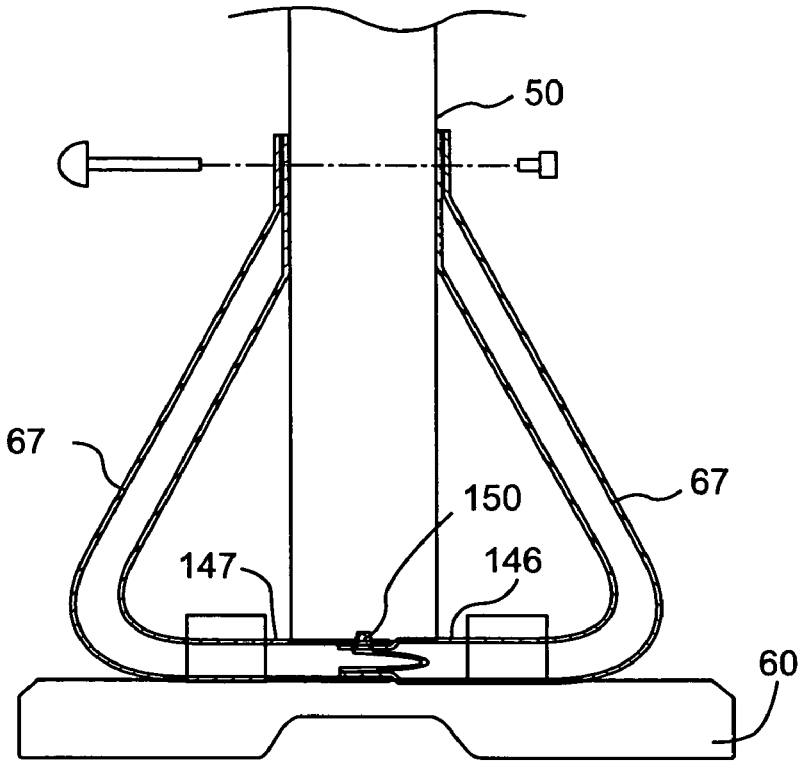

Referring to FIGS. 6A-6D shows an alternative embodiment of the pole 50, base 60 and strut 67 assembly. Strut 67 may be formed from a single tube or multiple tubes and arranged into a triangular shape. The lower portions lower portions 146 and 147 of the struts 67 are sized to frictionally fit into channels 145 of base 60 (see FIGS. 6B and 6D). As shown in FIGS. 6A and 6B, the lower portions form a connection between the channels 145, approximately centered over the base 60. However, it is contemplated that only one channel 145 may be used with the lower portions 146 and 147 connecting within the channel 145 forming a permanent and unreleasable connection between the struts.

The top of the struts 67 may be secured to the pole 50 with a standard bolt and nut configuration consistent with the present invention.

Figure 6C:
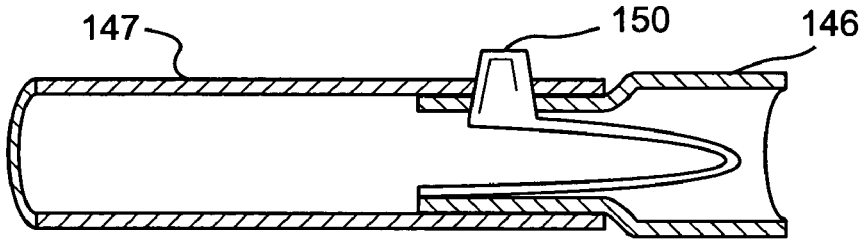
Figure 6D:
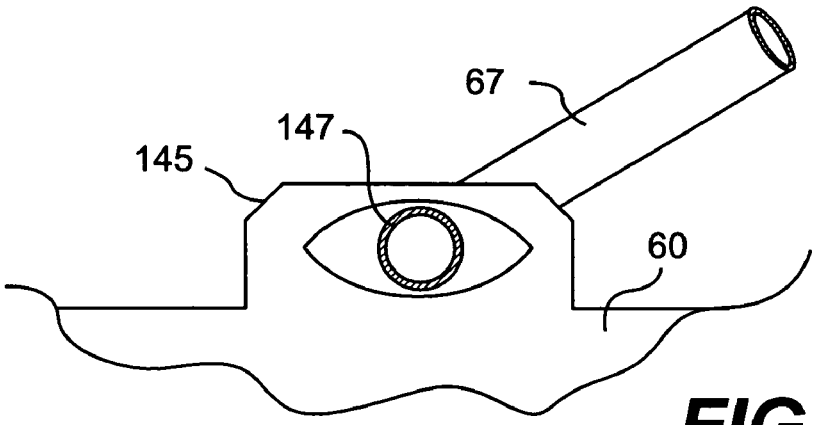

FIG. 6C shows a detailed view of the fastener 150 between the lower portions of struts 67. In FIG. 6D, the struts may engage channels 145 in a friction or snap fit such that the lower portions of the struts 67 are firmly held by the base 60. Fastener 150 may be a button fastener, a lock fastener, a spring-loaded fastener of other similar fastening means.

Figure 7A:
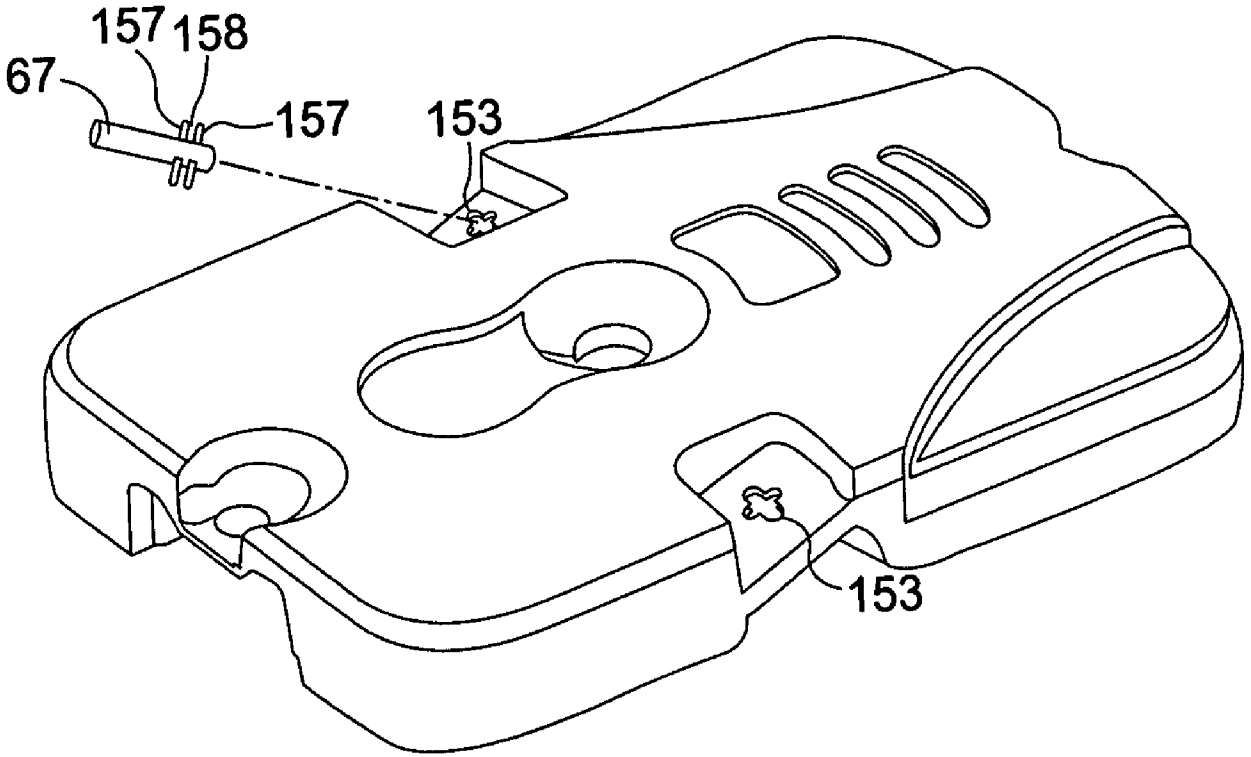
FIGS. 7A-7C show a view of a strut and base connection according to one embodiment of the present invention.

FIG. 7A shows an alternative embodiment of the connection between the struts 67 and base 60. Struts 67 may have slot 158 formed between two pins 157 which are inserted into openings in the struts 67. Alternatively pin 157 may be affixed to strut 67 via welding or other similar manufacturing technique. The strut 67 and the pins 157 may be inserted into a keyhole opening 153 in the base 60. In order to secure strut 67 to base 60, locking slot 153 receives strut 67 and pin 157 such that upon rotating the strut 67, the slot 158 engages the base 60. The upper pin 157 remains on the top side of the base 60 while the lower pin 157 engages the under side of the base 60 and the protrusions 154.

Figure 7C:
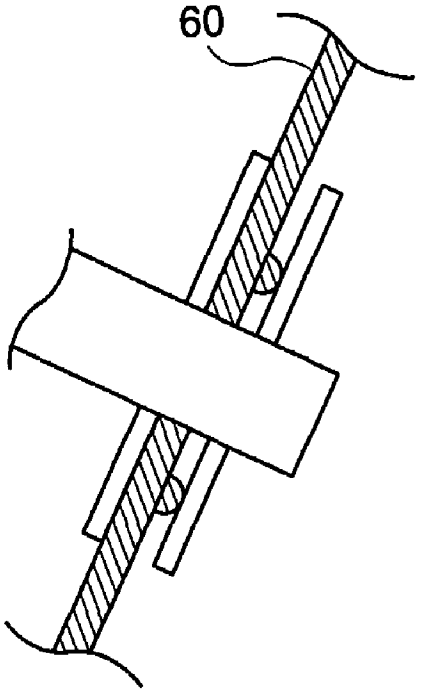
Figure 7B:
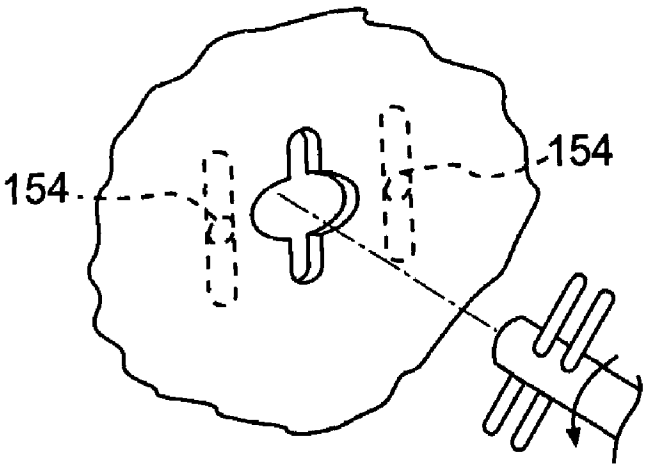

As shown in FIG. 7B, the keyhole opening 153 may receive the strut 67 and the pin 157. Upon rotating the strut 67, the lower pin 157 may engage the protrusions 154 and form a friction fit between the upper and lower pins 157. In FIG. 7C, the upper and lower pins 157 are frictionally engaged with the upper surface of the base 60 and the protrusions 154 to secure the strut 67 to the base 60.

Figure 8A:
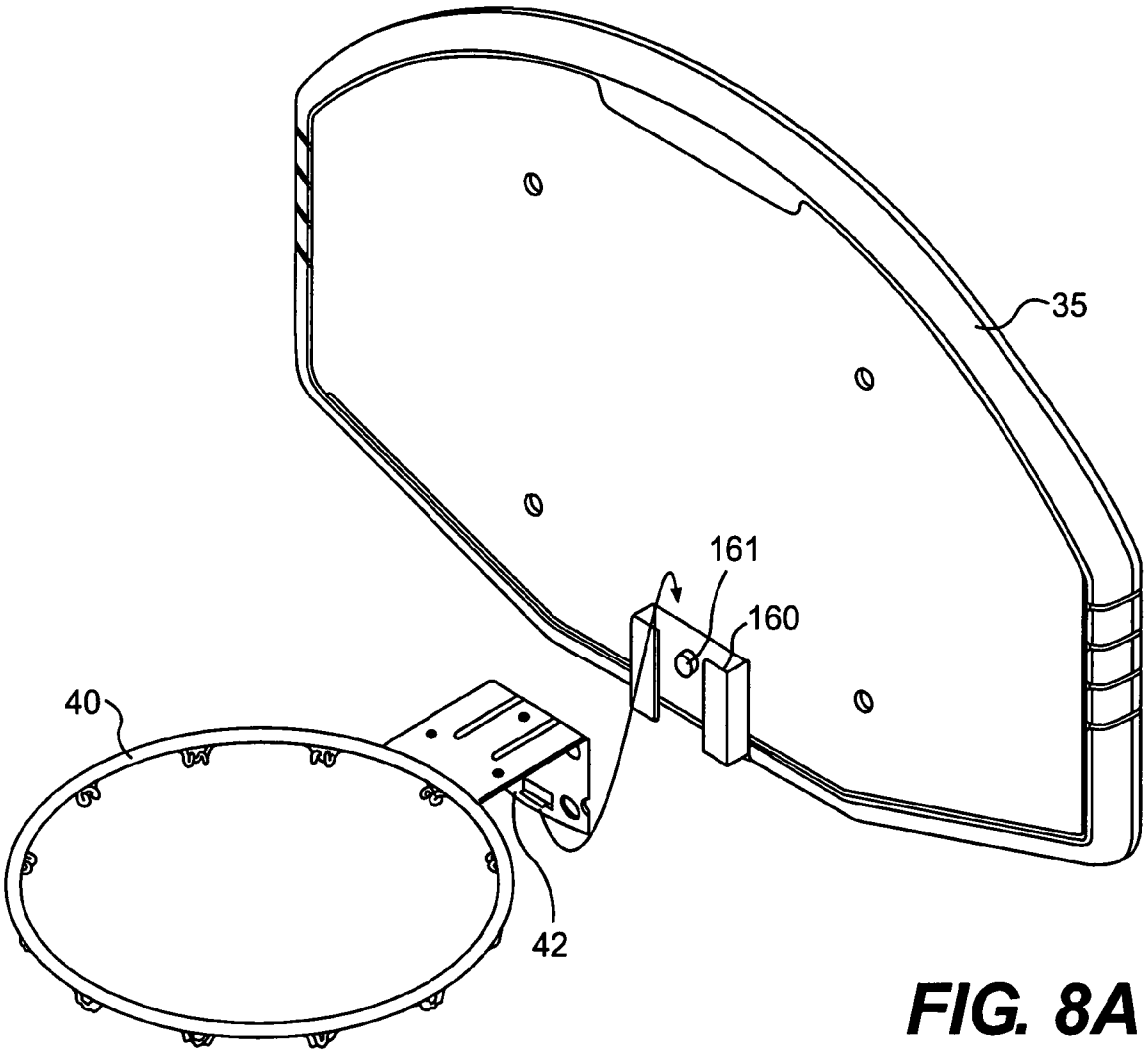
FIGS. 8A-8B show a view of the backboard and goal assembly according to one embodiment of the present invention.

FIG. 8A shows an alternative embodiment of the connection between the backboard 35 and goal 40. Plate 42 of goal 40 may be configured to slide in slot 160 of backboard 35 and be secured via lock button 161. The lock button 161 may be received in an opening in the plate 42 to prevent the goal 40 from pulling out of the slot 160. The slot 160 may rotationally fix the goal 40 from rotating about the button 161.

Figure 8B:
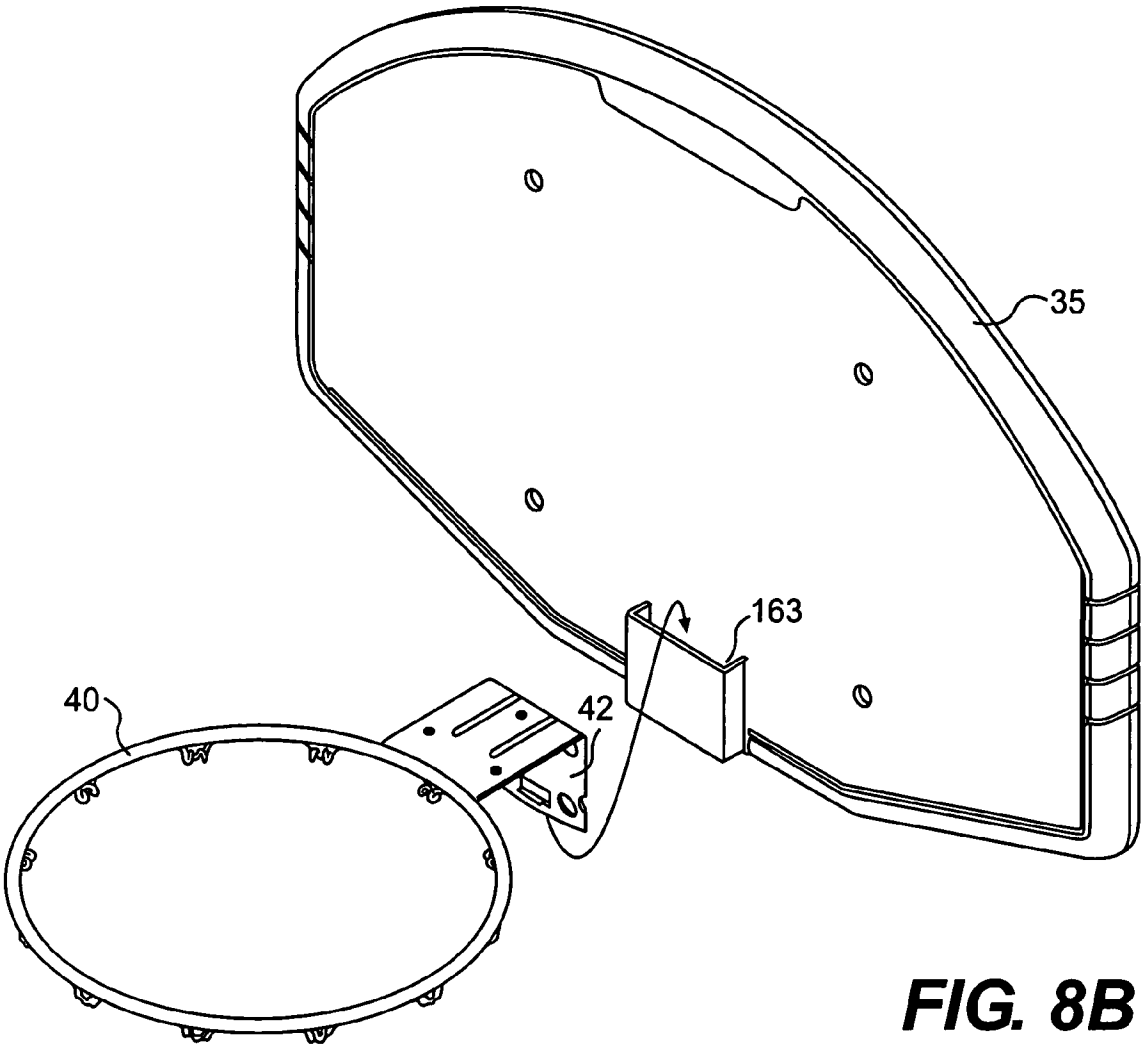

Alternatively, as shown in FIG. 8B, the button 161 may be removed and the plate 42 of goal 40 may be frictionally seated within the slot 163.

Figure 9:
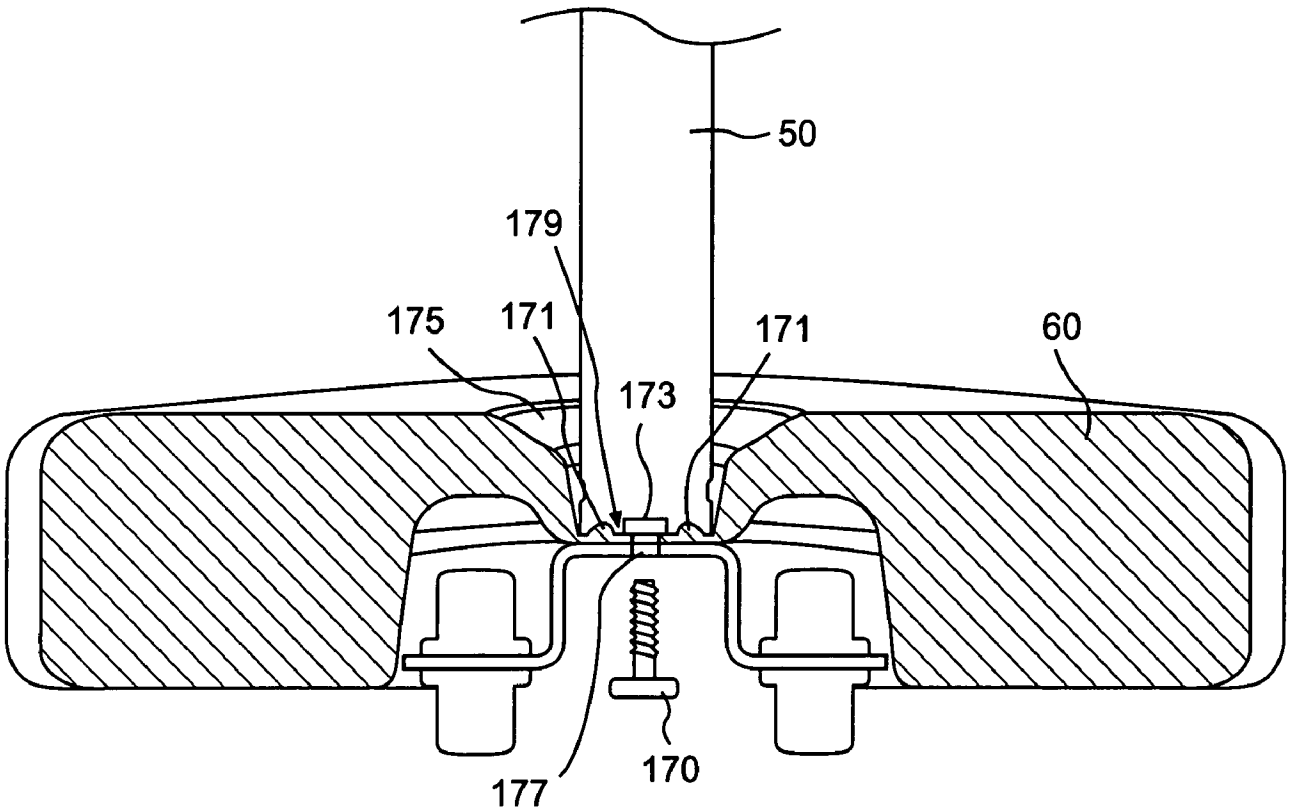
FIG. 9 shows a view of a pole and base assembly according to one embodiment of the present invention.

FIG. 9 shows an alternative embodiment of the connection between the pole 50 and base 60. Pole 50 may be structured and arranged to sit into seat area 175, where protuberances 171 engage the cross plate 179 of the pole 50 to prevent the pole 50 from rotating. Pole 50 may be secured to base 60 in seat area 175 via hand grippable bolt 170 which is sized to pass through a flattened rod section hole 177 on the underside of seat area 175 and may threadably interface with nut 173. The nut 173 may be affixed to the cross plate 179 of pole 50.

Figure 10:
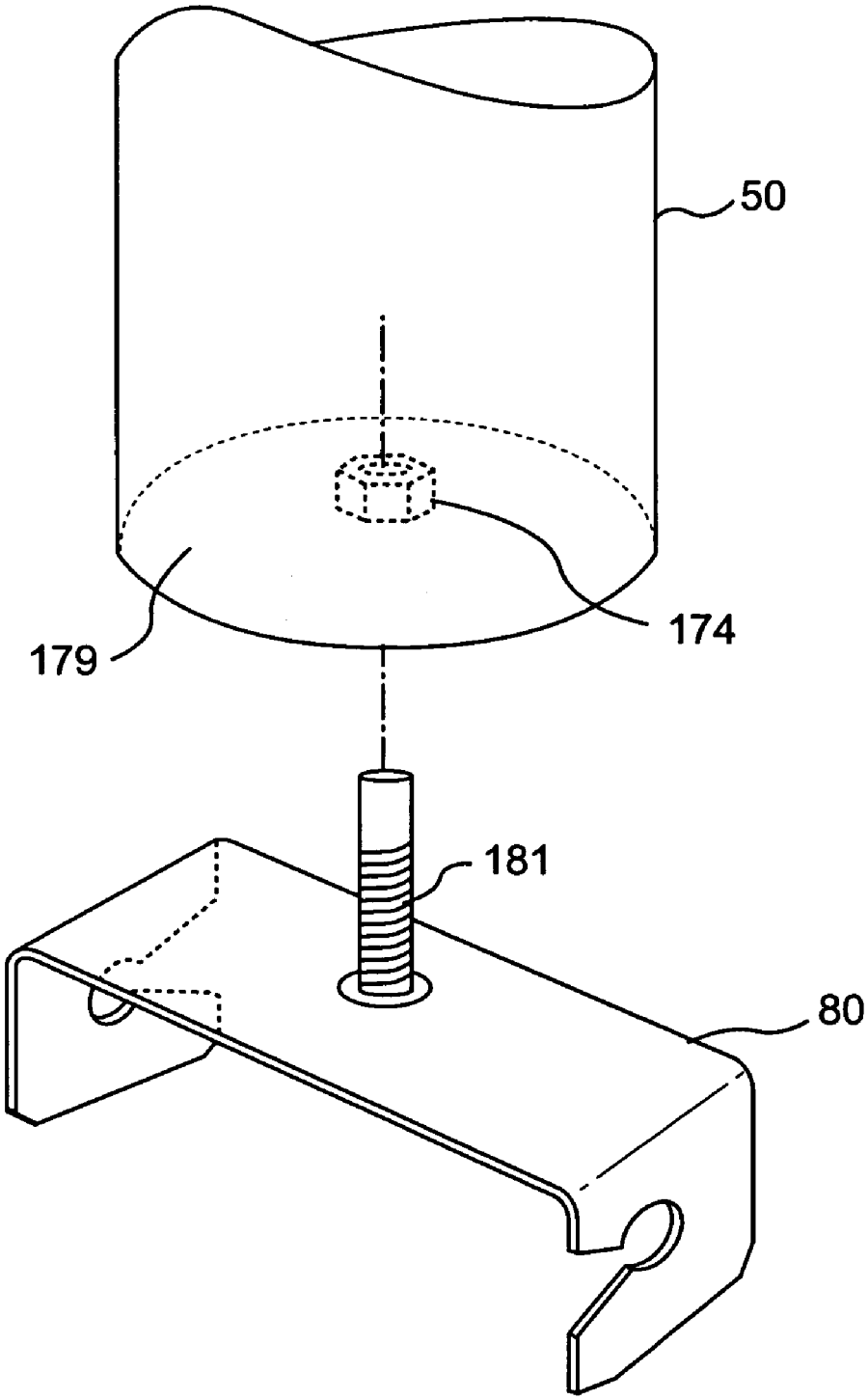
FIG. 10 shows a view of a pole and wheel bracket assembly according to another embodiment of the present invention.

FIG. 10 shows an alternative embodiment of the pole 50 and wheel bracket 80. Wheel bracket 80 may be secured to pole 50 via a hand grippable bolt 181, which is sized to mate with nut 174. Nut 174 may preferably be secured to cross plate 179 of pole 50. Alternatively, it is contemplated that the bolt 181 may also be secured to wheel bracket 80 and the bracket or the pole may be rotated to secure the bolt 181 to the nut 174.

Figure 11A:
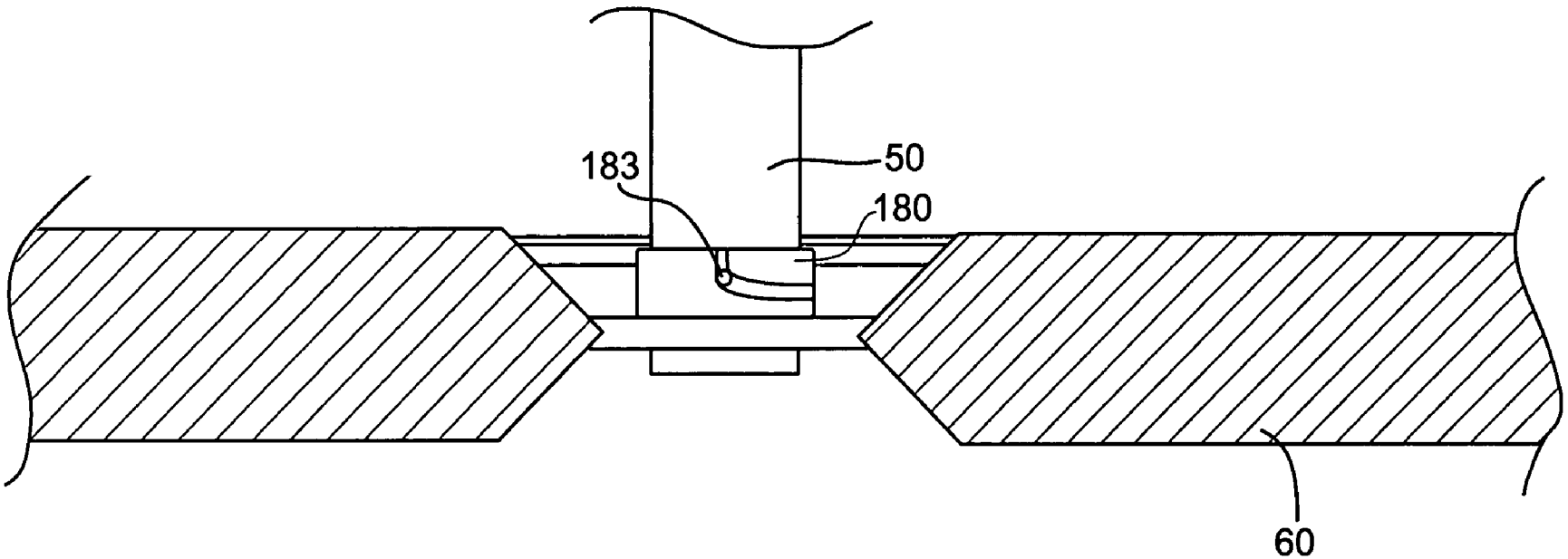
FIGS. 11A-11C show a view of a pole and base assembly according to another embodiment of the present invention.
Figure 11B:
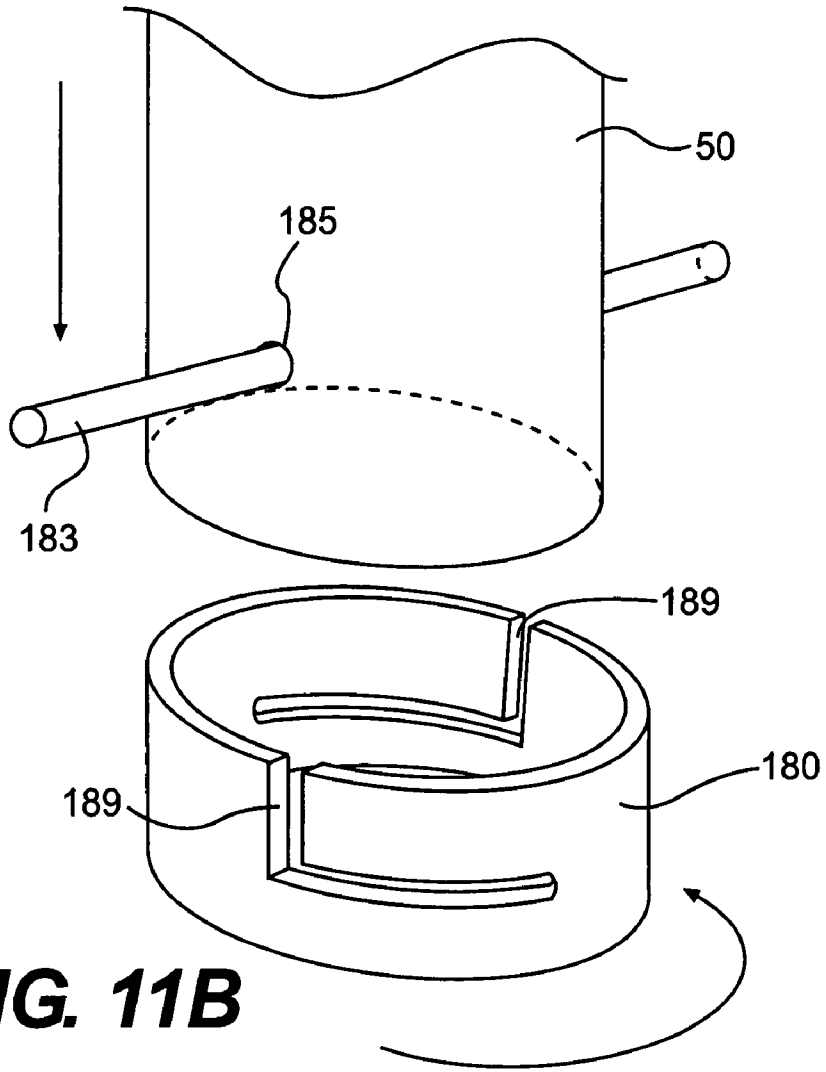

FIG. 11A shows an alternative embodiment of the connection between the pole 50 and base 60. Pole 50 may be adjoined to base cap 180 via hold pin 183. As shown in FIG. 11B, the hold pin 183 may be positioned into slots 185 of pole 50 such that, when lowered, the pin 183 may enter the cam slots 189. As shown, base cap 180 includes diametrically opposed cam slots 189 that are initially aligned perpendicular to hold pin 183. As base cap 180 is rotated relative to pole 50, hold pin 183 may be inserted into and locked within cam slots 189. Although not shown, it is also contemplated that the holding pin 183 may function as an axle for the wheels upon locking the pin 183 to the base 60 with the use of the cap 180.

Figure 11C:
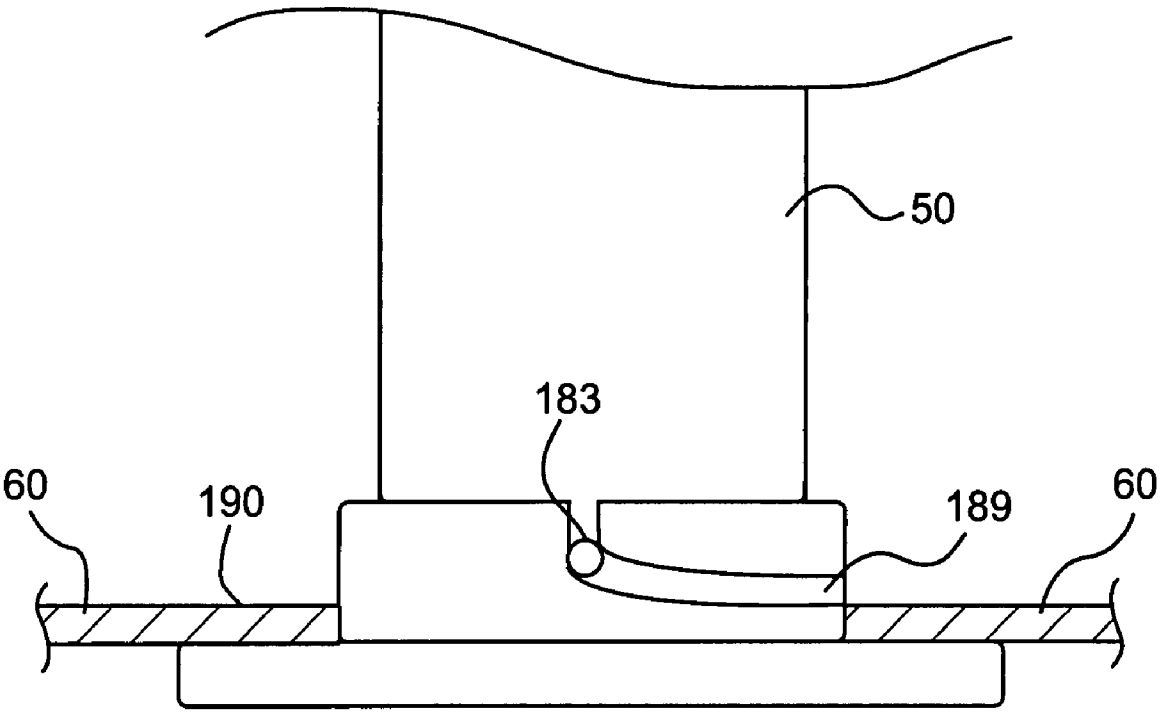

As shown in FIG. 11C, the cap 180 may include an outside lip 190. The outside lip 190 may be structured and arranged to abut the underside of an opening 195 in base 60.

Figure 12:
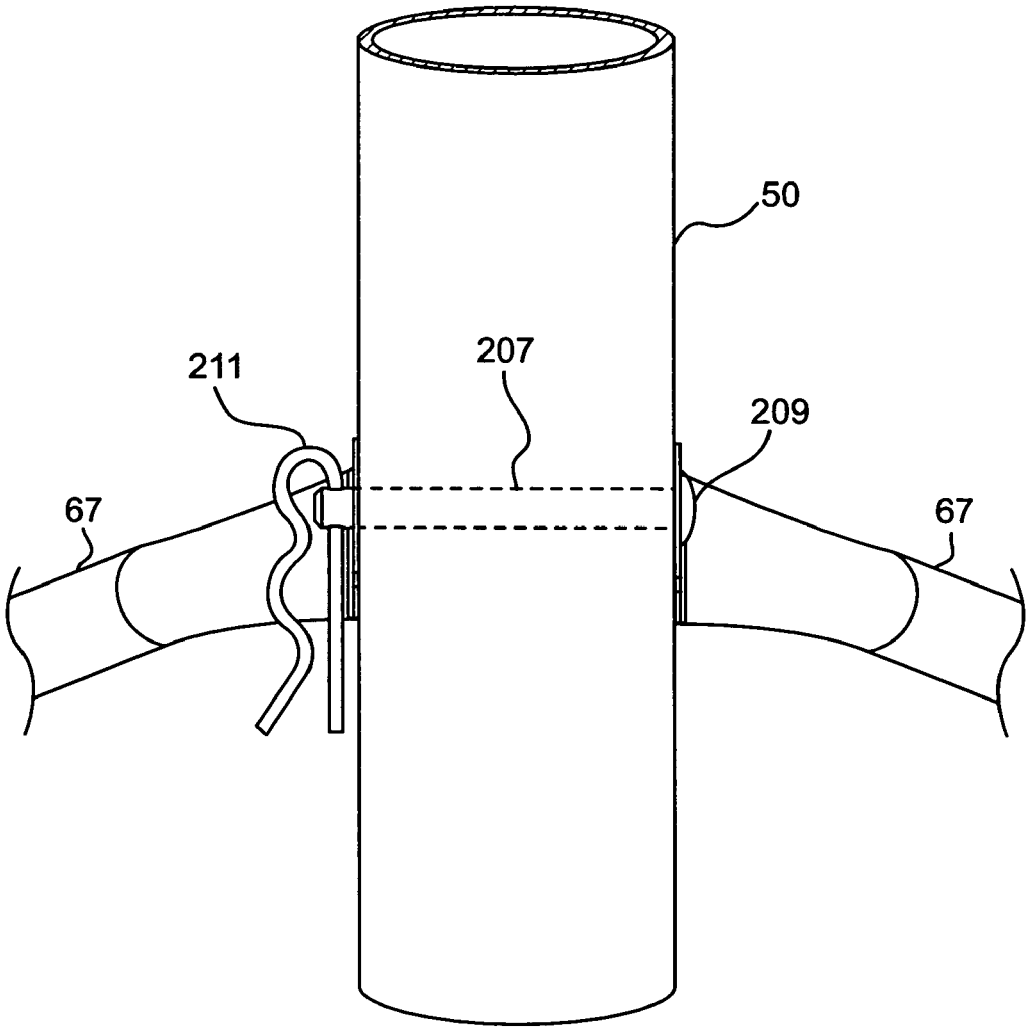
FIG. 12 shows a view of a pole and strut assembly according to another embodiment of the present invention.
Figure 13A:
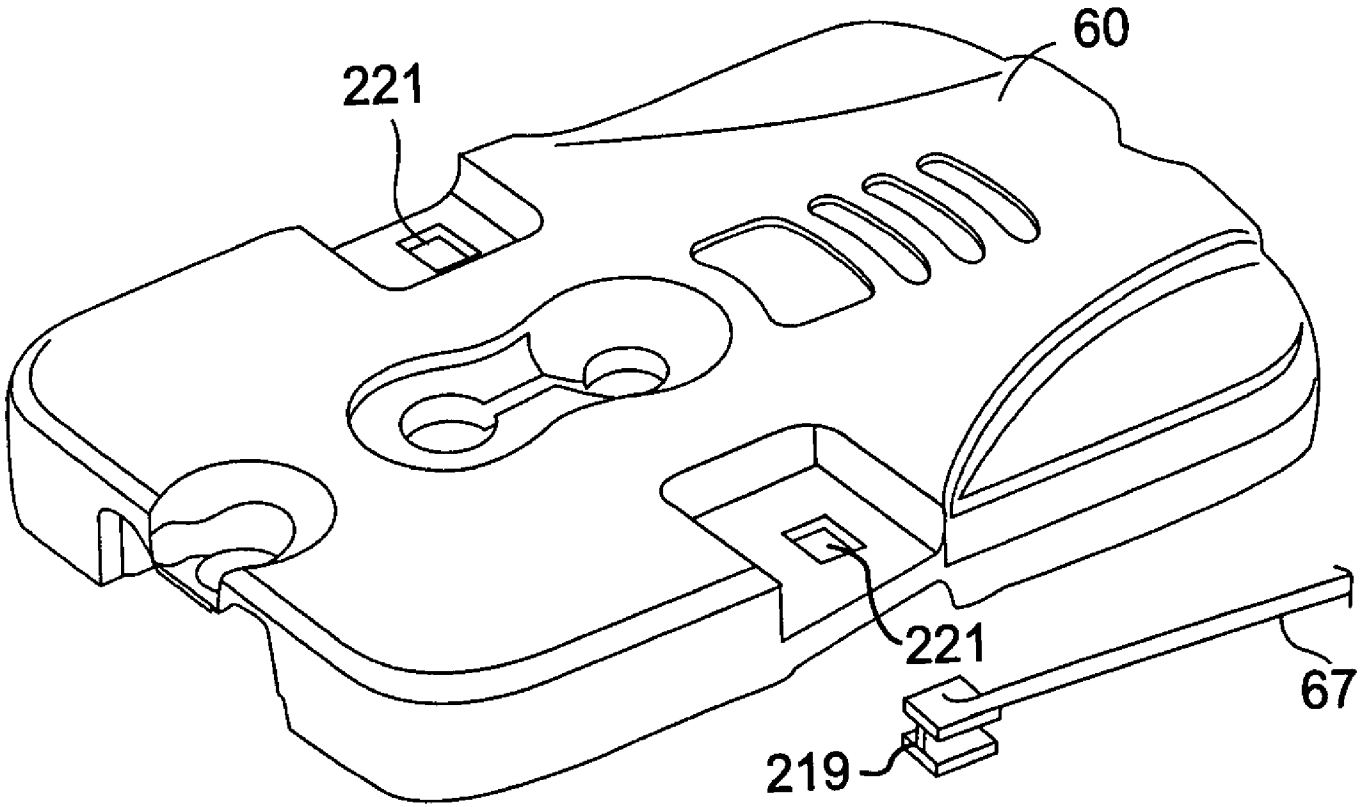
FIGS. 13A-13C show a view of a strut and base assembly according to one embodiment of the present invention.
Figure 13B:
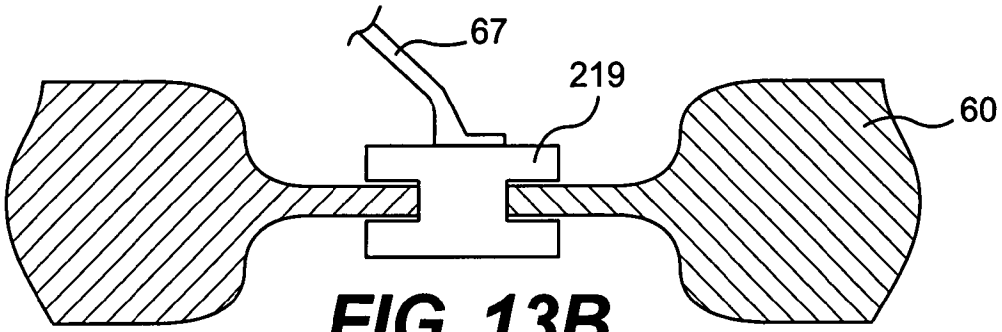
Figure 13C:
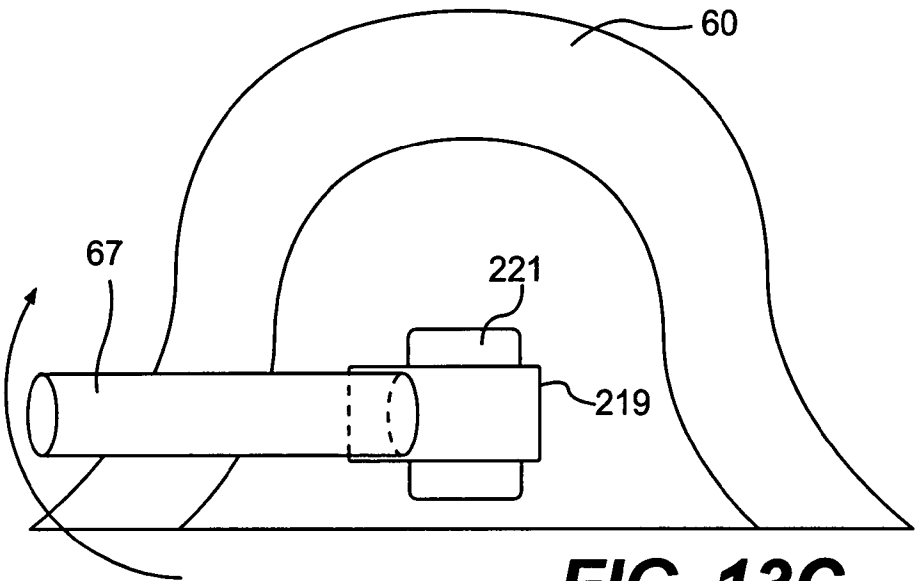

FIG. 12 shows another alternative connection between the pole 50 and strut 67. Struts 67 may be secured to pole 50 via rod 207 which extends through the center of pole 50. Struts 67 may be secured via rod 207 with carriage end 209 and via snap means 211. Snap means 211 may include a push cap or push pin arrangement made of any suitable material having suitable flexibility FIGS. 13A-13C show an alternative connection between the strut 67 and base 60. Strut 67 may have a detailed stamp in the form of an H-shaped cross-section 219 as shown in FIG. 13B. As base 60 may have a rectangular cross-section at the connection point opening 221. Strut 67 may be inserted into the connection point and then rotated into position to be assembled to the pole 50 (not shown). By rotating strut 67, the H-shaped detail 219 clears connection point opening 221, and frictionally locks onto the base 60.

In FIG. 13B, a cross section of the base 60, the opening 221 and the H-shaped detail 219 are shown in frictional engagement. The base 60 is received in the H-shaped detail 219 such that the strut 67 is secured to the base 60. In FIG. 13C, a top view of the base 60 and the H-shaped detail 219 is shown during installation. The H-shaped detail 219 may be inserted into the opening 221 until half of the H-shaped detail 219 is in the opening and half is out of the opening. The strut 67 may then be rotated as shown by the arrow in FIG. 13C until the top of the strut 67 may engage the pole 50 (not shown). The strut 67 may be connected to the pole 50 in any manner consistent with the present invention.

Figure 14A:
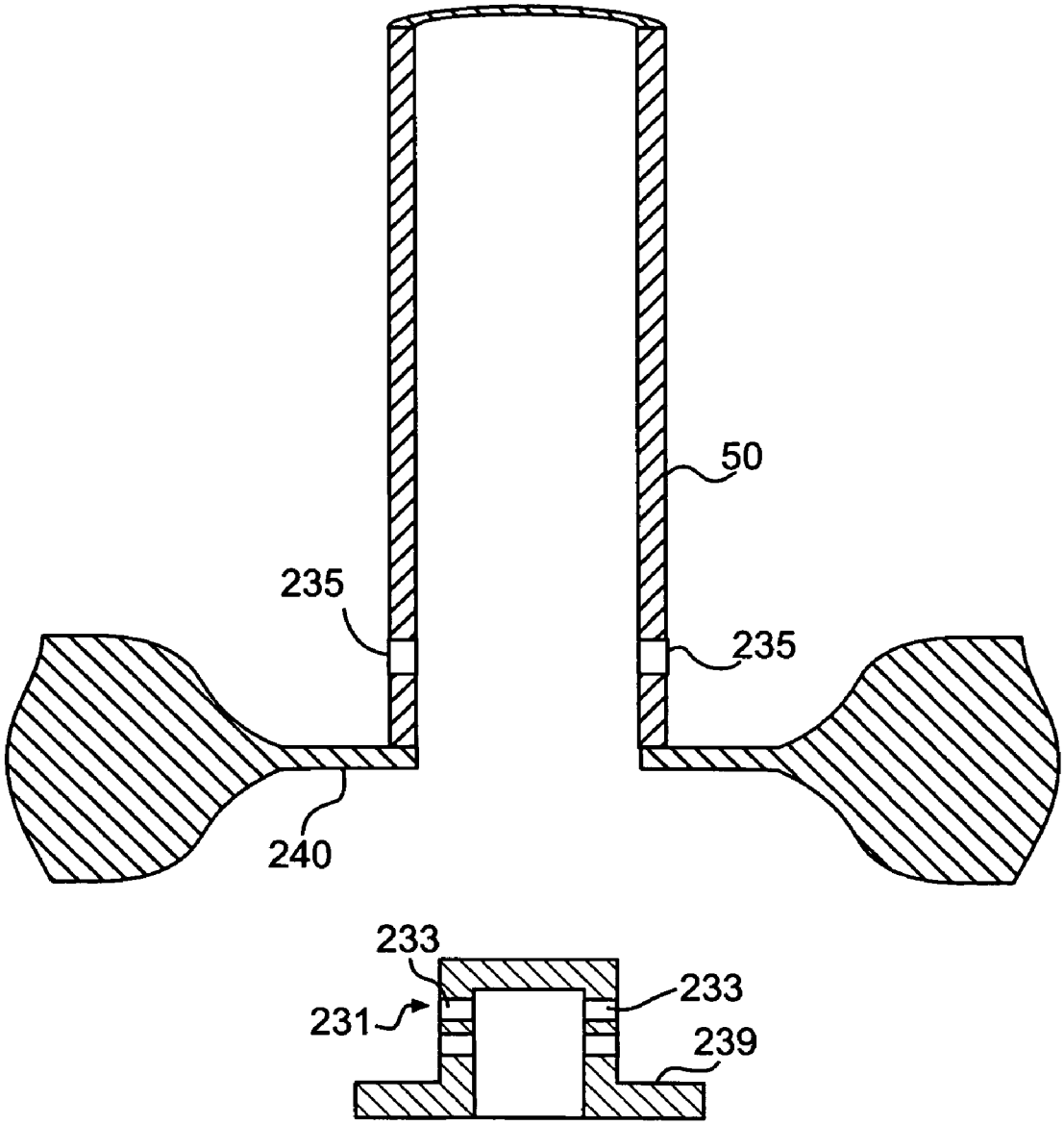
FIGS. 14A-14C show a view of a pole and base assembly according to one embodiment of the present invention.
Figure 14B:
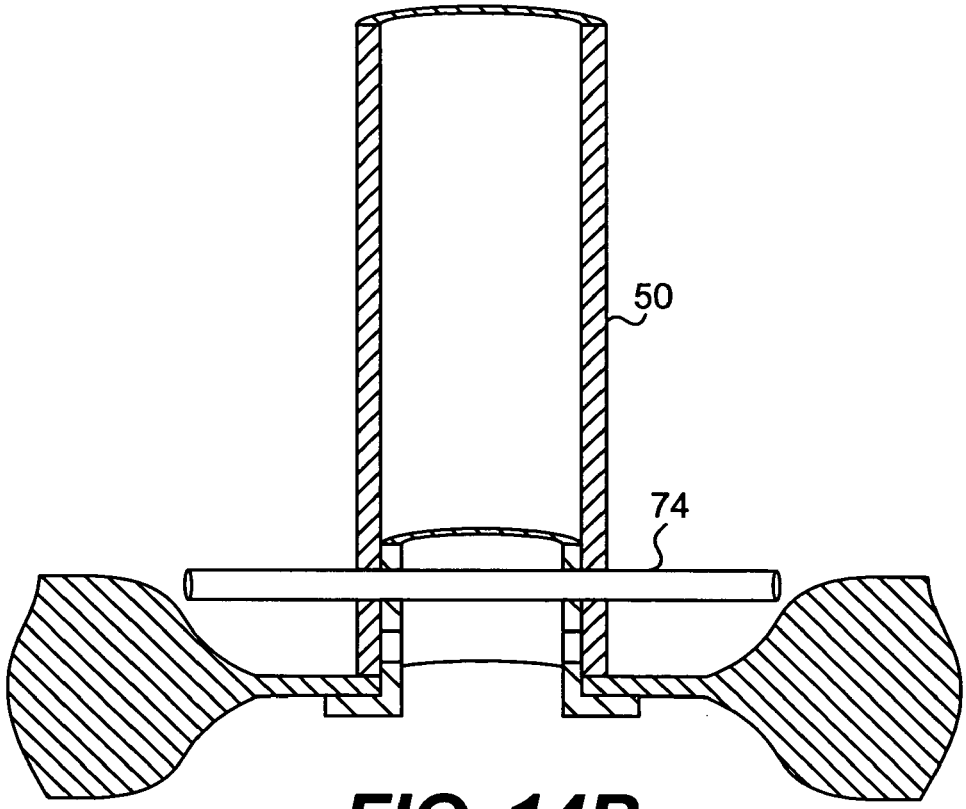
Figure 14C:
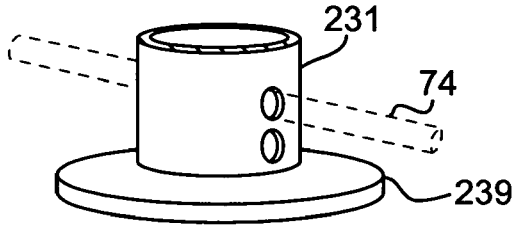

FIGS. 14A-14C show an alternative connection between the pole 50 and base 60. Anchor 231 may be sized and shaped to be received into the lower portion of pole 50. When anchor 231 is received into the lower portion of pole 50, inner anchor edge 239 abuts lower base section 240. When securely received therein, slots 235 of pole 50 are positioned to align with slots 233 of anchor 231. When properly aligned, slots 235 and slots 233 receive holding pin 74. It should be understood that the holding pin 74 may also be employed as the wheel axel 74 as discussed above. As shown in FIG. 14B, the pole 50 may be secured to the base 60 upon insertion of the pin 74 into slots 235 and 233. Anchor 231 may be made of any suitable material but preferably plastic to keep the weight of the basketball system low. As shown, the pin 74 may extend on both ends such that the pin 74 approaches the base 60 and may not be simply slid out of the slots 235 and 233 without contacting the base 60.

Figure 15A:
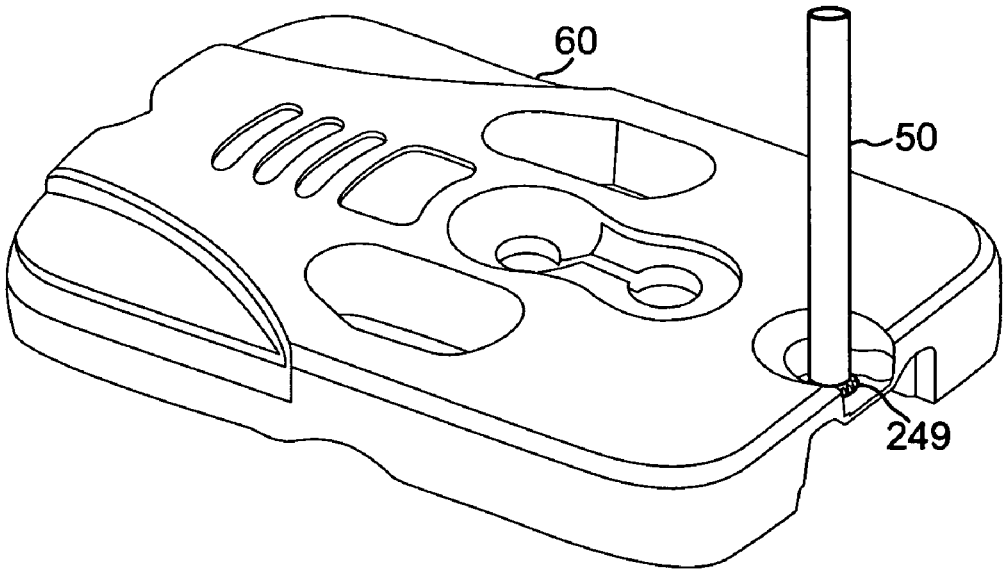
FIGS. 15A-15B show a view of a pole and base assembly according to another embodiment of the present invention.
Figure 15B:
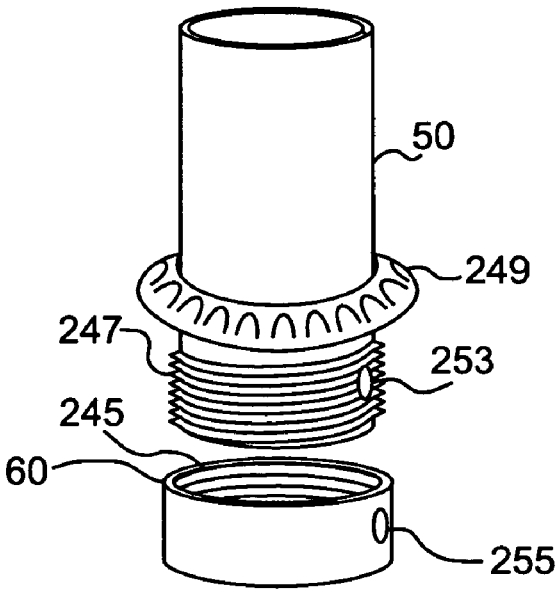

FIGS. 15A and 15B show another alternative connection between the pole 50 and base 60. Base 60 may include interior threaded portion 245 and the pole 50 may include externally threaded portion 247 structured and arranged to threadably engage threads 245 of base 60. Additionally, a base cap 249 may be positioned on pole 50 to also engage threads 247 and frictionally engage the top of the base 60 after the threads 247 are substantially engaged with threads 245 of the base 60. The threads 245 may be integrally formed in the base 60 or may be incorporated into an anchor as discussed in alternative connections above.

Furthermore, a rod 251 may also be received through slots 253 of pole 50 and aligned slots 255 of base 60. Rod 251 may be used to rotationally secure the pole 50 and/or serve as a wheel axle for the wheels.

Figure 16A:
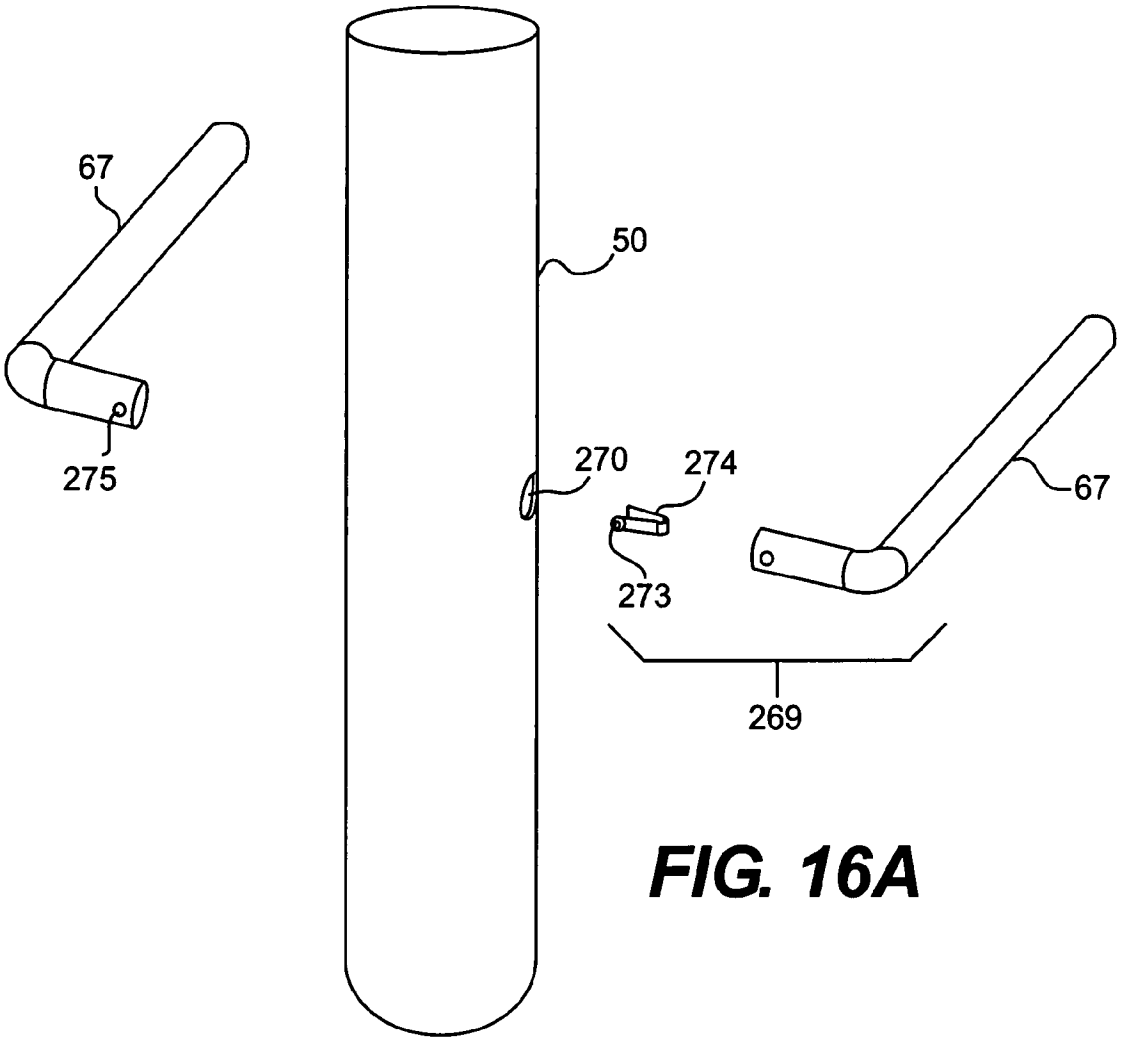
FIGS. 16A-16B show a view of a pole and strut assembly according to another embodiment of the present invention.
Figure 16B:
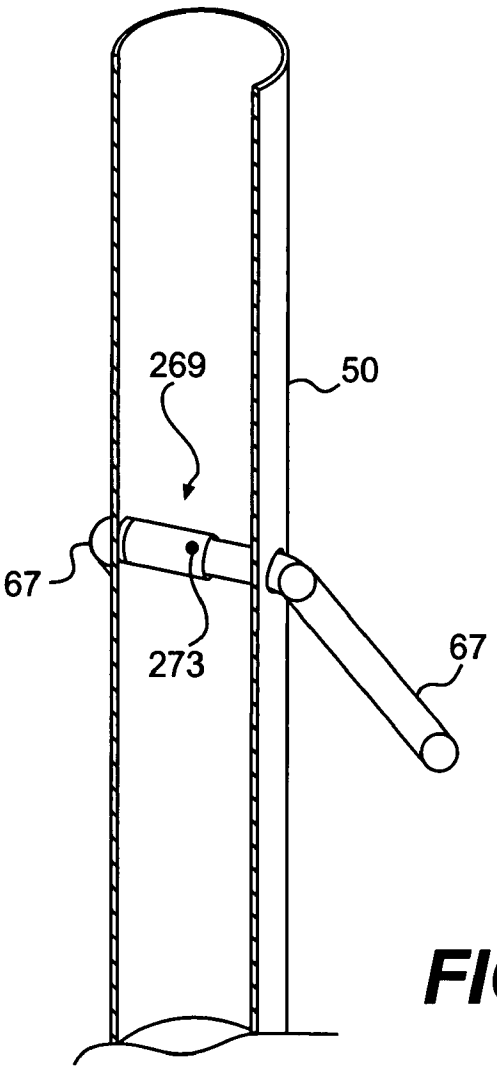

FIGS. 16A-16B show an alternative connection between the strut 67 and pole 5. Pole 50 may have openings 270 to receive the upper portions of struts 67. Struts 67 may have a spring pin system 269 which includes spring 274 and pin 273 on one end of one strut 67. Another end of another strut 67 may include eyelet 275 sized and shaped to received pin 273. When struts 67 are received through openings 270 in pole 50 each end of struts 67 are structured and arranged to mate in the interior of pole 50, where pin 273 will engage eyelet 273 thereby securing struts 67 to pole 50.

Figure 17A:
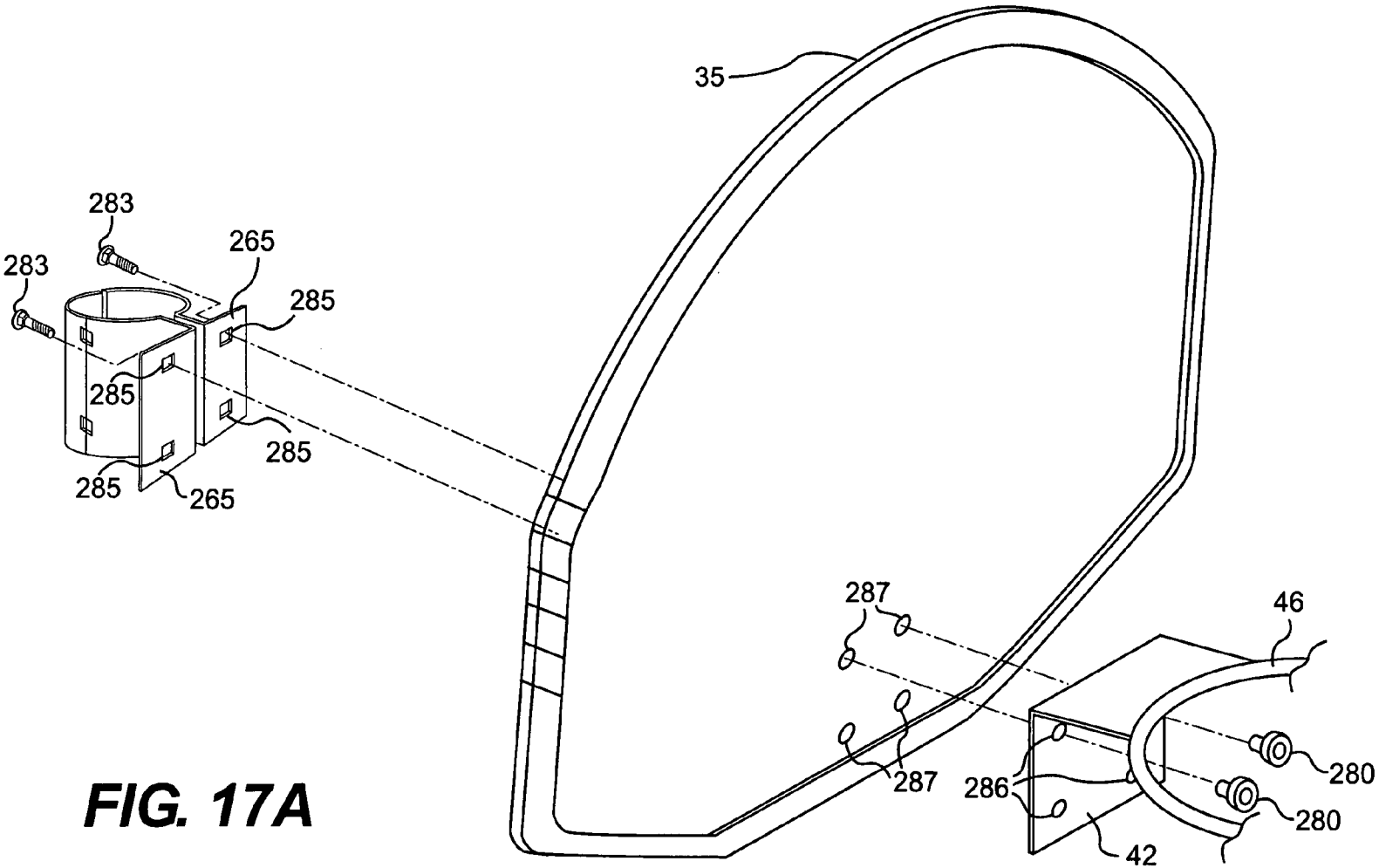
FIGS. 17A-17B show a view of a goal and backboard assembly according to another embodiment of the present invention.
Figure 17B:
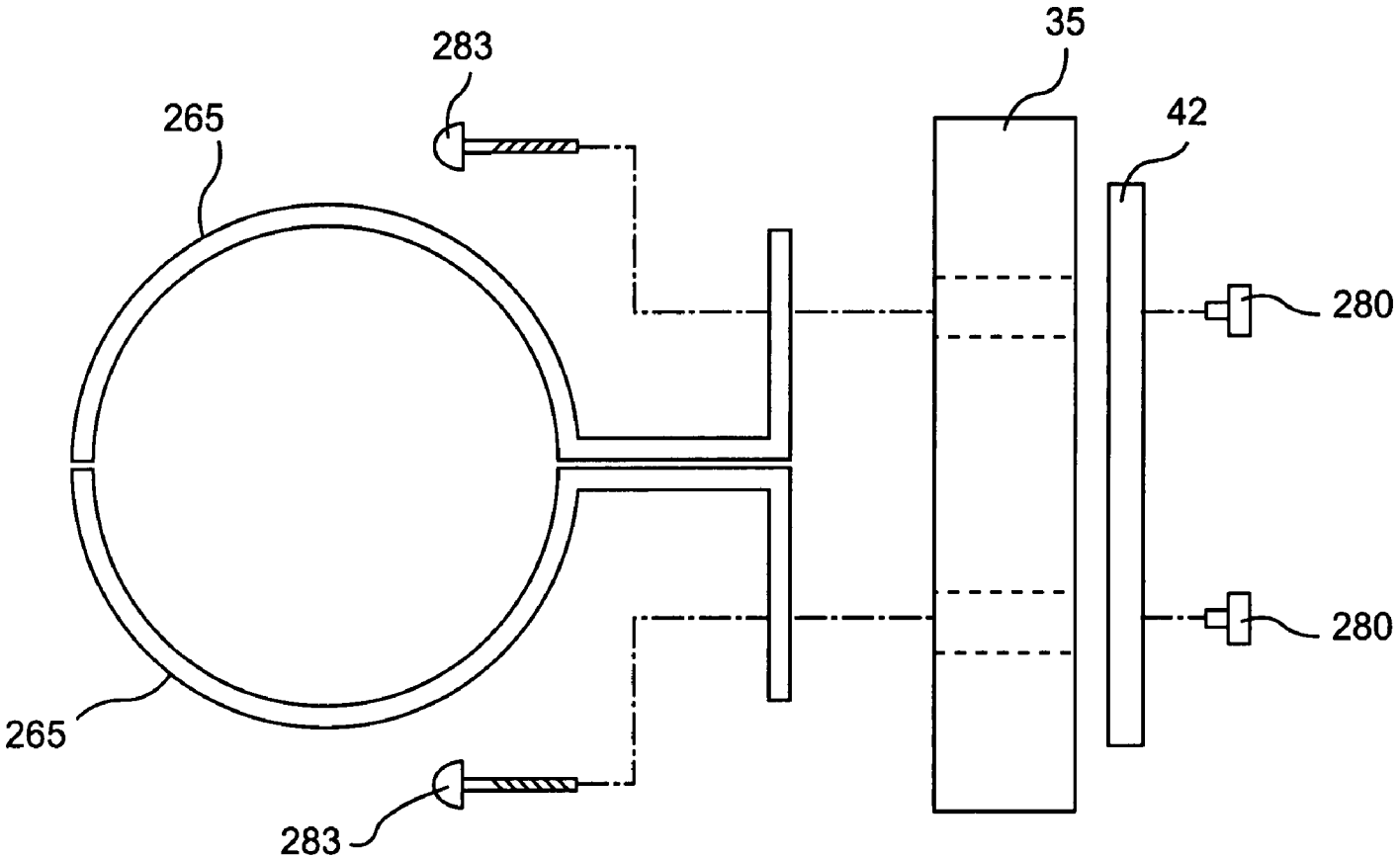

FIGS. 17A and 17B show an alternative attachment of the backboard 35 and goal 40 to a pole 50 (not shown in FIGS. 17A and 17B). Hand grippable nuts 280 and the carriage bolts 265 secure the backboard 35 and the plate 42 to the brackets 265. The brackets 265 include openings 285 and the backboard includes openings 287. The plate 42 also includes openings 286. Although only two carriage bolts 283 and hand grippable nuts 280 are shown in FIGS. 17A and 25B, four may be used to secure the backboard and rim. The brackets 265 may be secured to a pole 50 (not shown) in any manner consistent with the present invention.

Figure 18:
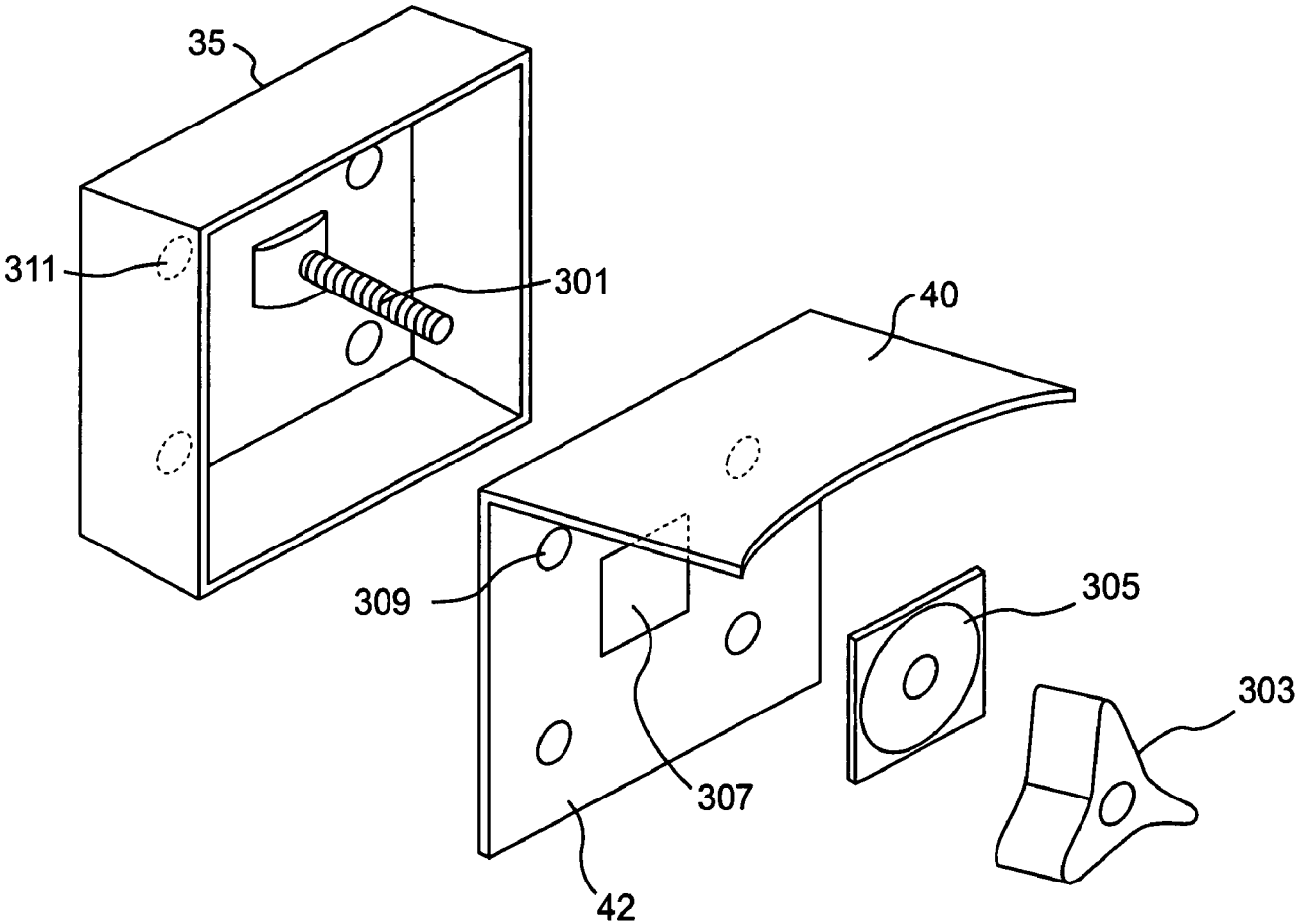
FIG. 18 shows a view of a goal and backboard assembly according to another embodiment of the present invention.

FIG. 18 shows another embodiment of the connection between the goal 40 and backboard 35 assembly. Goal 42 may be secured to backboard 35 via carriage bolt 301 which may be set within and affixed to backboard 35. The bolt 301 may be received through interface 307 in plate 42 of goal 40. The washer 305 and the hand grippable nut 303 may be used to secure the plate 42 to the backboard 35. Plate 42 also may include protuberances 309 sized and shaped to engage notches 311 in backboard 35 to ensure that the plate 42 is rotationally fixed to the backboard 35.

Figure 19:
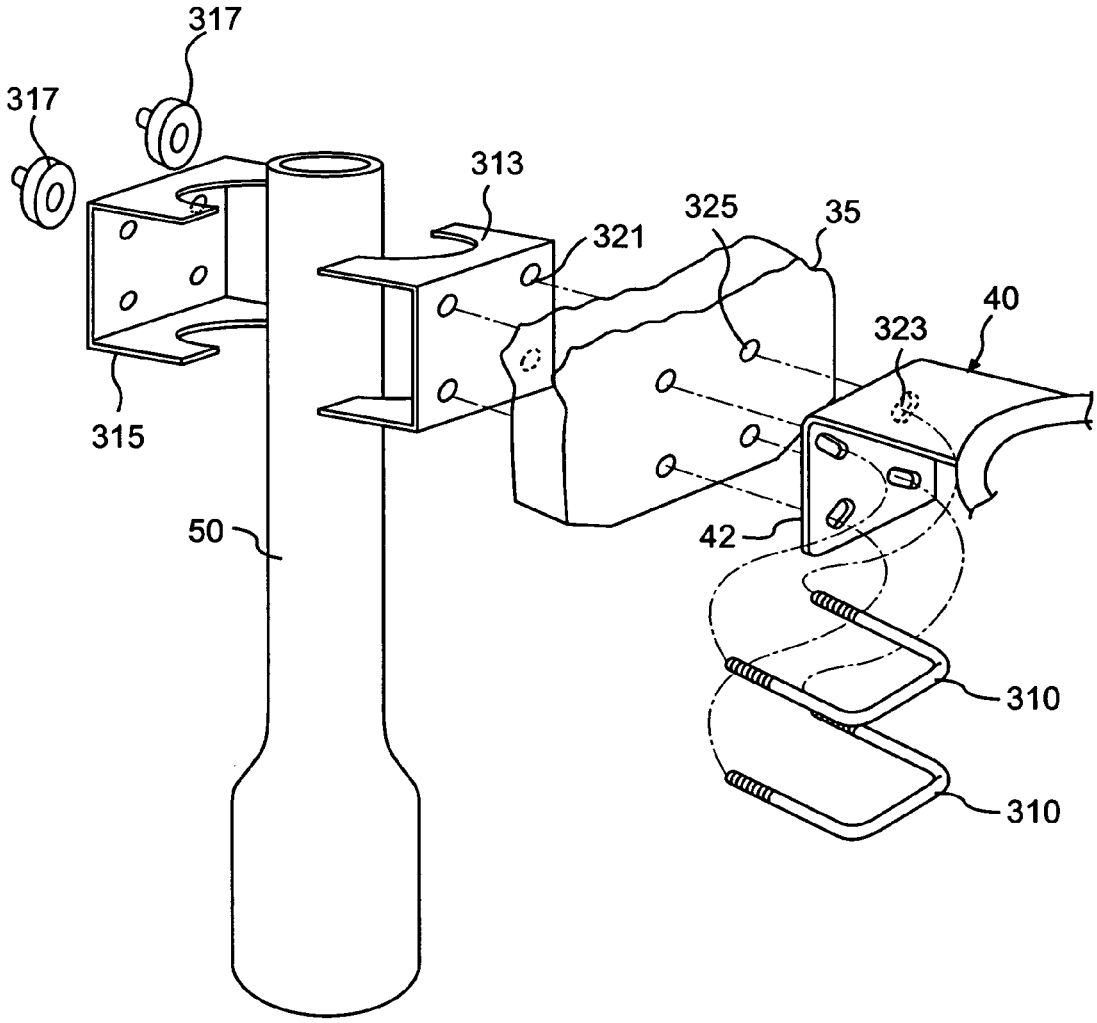
FIG. 19 shows a view of a goal and backboard assembly according to another embodiment of the present invention.

FIG. 19 shows an alternative connection between the goal 40, backboard 35 and pole 50. Goal 40 and backboard 35 may be secured to pole 50 with u-bolts 310, saddle clamps 313 and 317, and hand grippable knobs 317. U-bolts 310 may be directed through holes 323 in plate 42, through holes 325 in backboard 35, through holes 321 in saddle 313, through holes in saddle 315 (not shown) and secured with knobs 317. Saddles 313 and 315 may be located diametrically opposed on the outside of pole 50. As U-bolt 310 is secured with knobs 317, plate 42 of goal 40 abuts and is secured to the front side of backboard 35. Backboard 35 is then secured to pole 50 via saddle 313 which abuts the back side of backboard 35 on one side and straddles pole 50 on the other. The saddle 313 may be secured via U-bolts 310 and saddle 315, on the opposite side of pole 50, by the knobs 317. It should be obvious to one of ordinary skill that only one u-bolt may be used in some embodiments with a pair of saddles and corresponding holes in the plate 42 and backboard 35.

Figure 20:
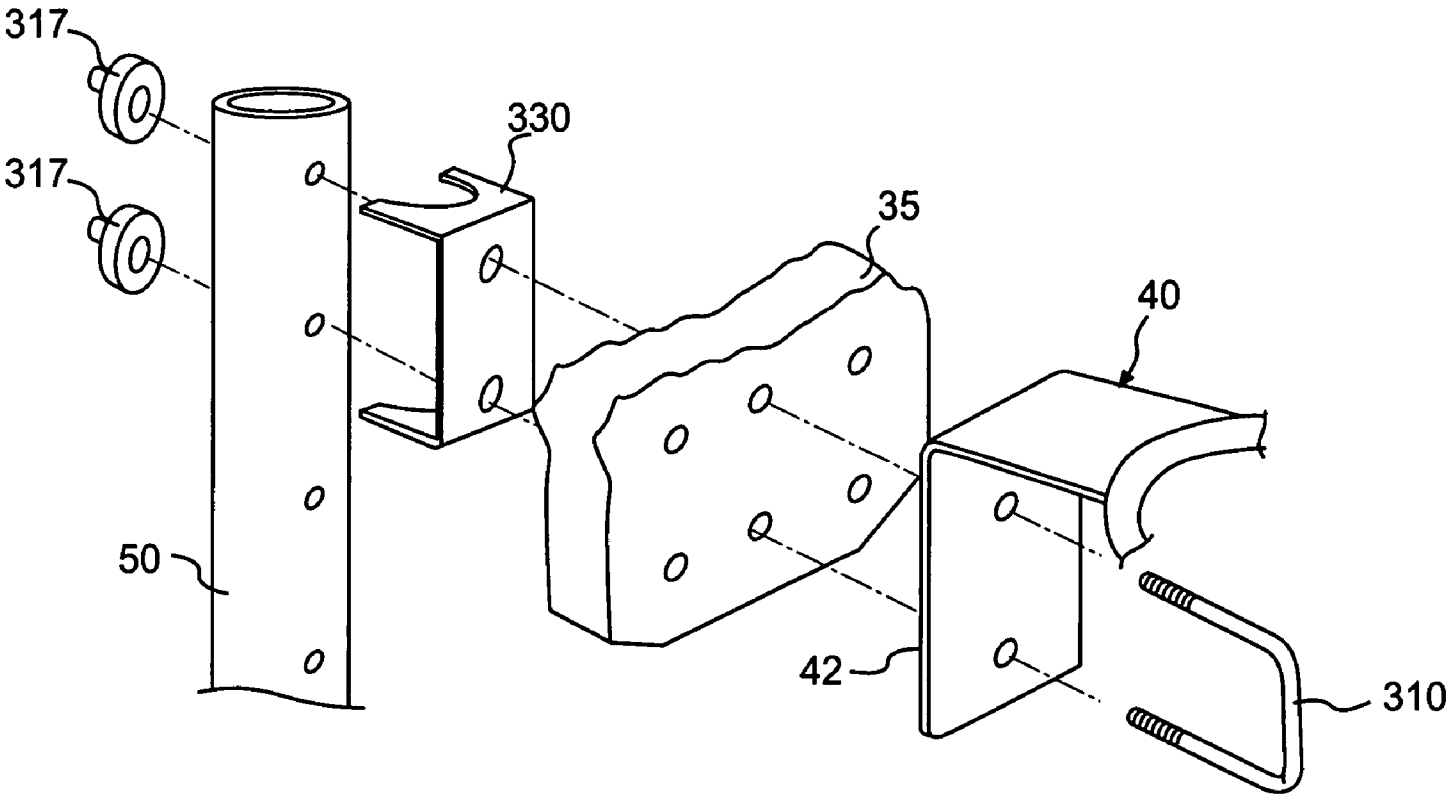
FIG. 20 shows a view of a goal and backboard assembly according to another embodiment of the present invention.

FIG. 20 shows an alternative arrangement of the assembly as shown in FIG. 19. In this arrangement U-bolt 310 is directed through the center of pole 50, where a mini saddle 330 abuts the back side of backboard 35. Knobs 317 secured the assembly to pole 50 on the opposite side thereof.

Figure 21A:
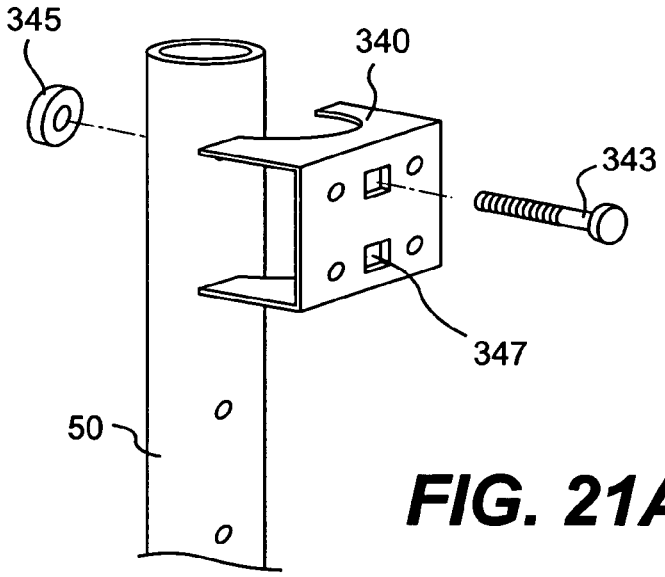
FIGS. 21A-21C show a view of a goal and backboard assembly according to another embodiment of the present invention.

FIG. 21A shows an alternative pole 50 and backboard bracket 340 assembly. Bracket 340 may be secured to pole 50 with carriage bolt 343 and hand grippable nut 345 combination. Bolt 343 may be sized and shaped to be received into opening 347 in the face of bracket 340 and passed through holes in pole 50 (not shown) located on opposite sides thereof and ultimately secured with nut 345. Bracket 340 is structured and arranged to securely abut pole 50 along the arc thereof creating a stable assembly and ensuring that the face of bracket 340 is suitably leveled for receiving and securing backboard 35.

Figure 21B:
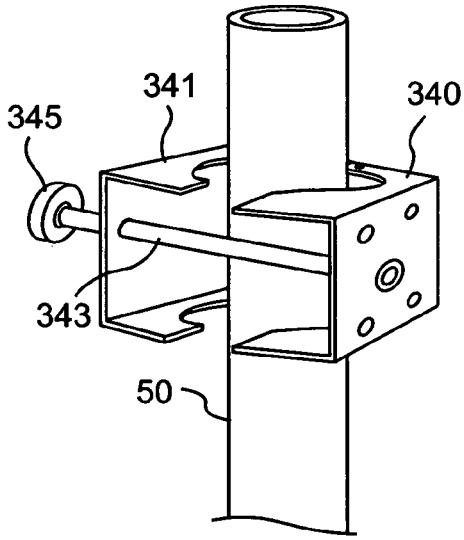
Figure 21C:
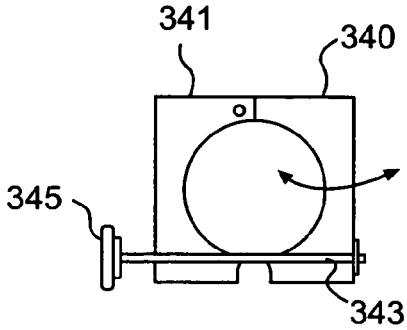

FIGS. 21B and 21C shows an alternative arrangement of the assembly of FIG. 21A, where bracket 341 is included and provides additional support to bracket 340. Bracket 341 is structured and arranged to pivotably engage bracket 340 on one side while receiving the bolt 343, which may be secured by nut 353. When nut 345 is secured to bolt 343, brackets 341 and 340 are clamped and secured to pole 50 in such a way that the face of bracket 340 is suitably leveled for receiving and securing backboard 35.

Figure 22B:
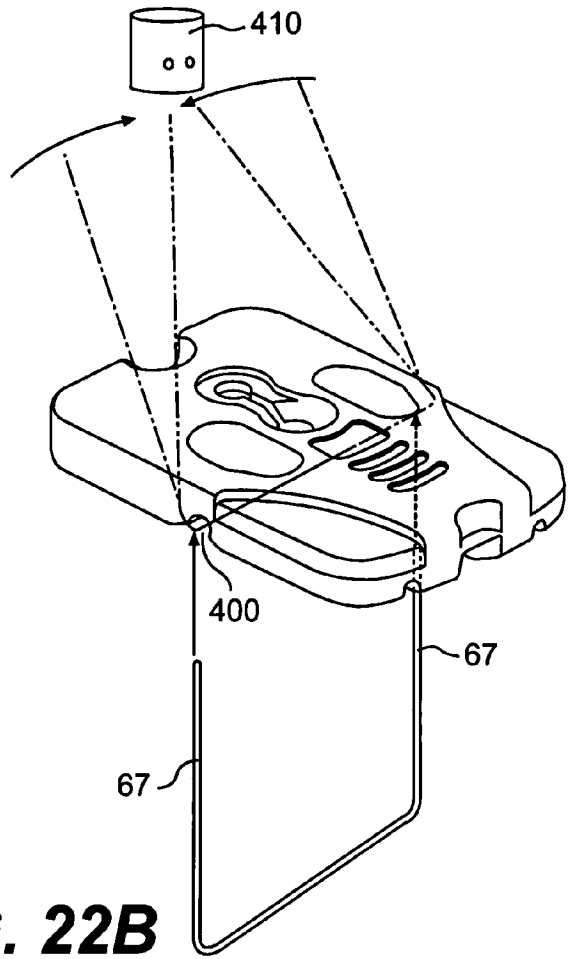
FIGS. 22A-22B show a view of a strut and base assembly to another embodiment of the present invention.
Figure 22A:
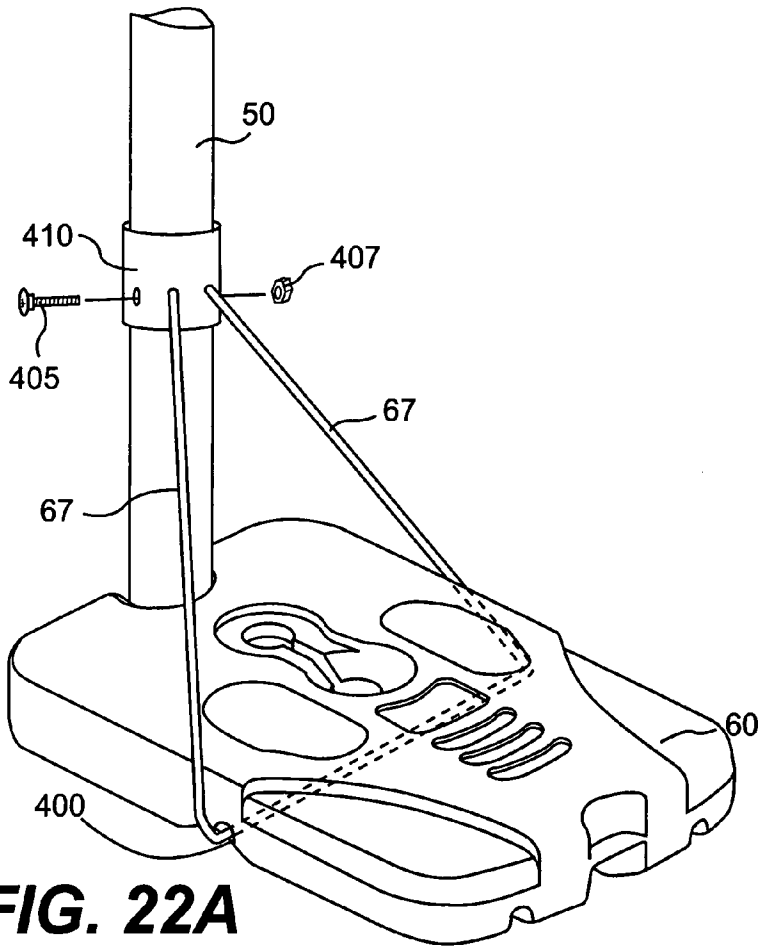

FIG. 22A shows an alternative pole 50, strut 67 and base 60 assembly. As shown in FIG. 22B, strut 67 may be a single piece where its ends are inserted from the underside of base 60 through strut slot 400. Once inserted into slot 400, the ends of strut 67 can be brought to bear onto pole 50 with coupling 410, bolt 405 and hand grippable nut 407 assembly. Coupling 410 is sized and shaped to trace and fit the outer circumference of pole 50 in a secure fashion and, with nut 405 and bolt 407, secure the ends strut 67 to coupling 410. The coupling 410 may also be frictionally engaged and clamped to pole 50. Furthermore, once the assembly is locked in place, strut 67 provides lateral and axial support to pole 50.

Figure 23:
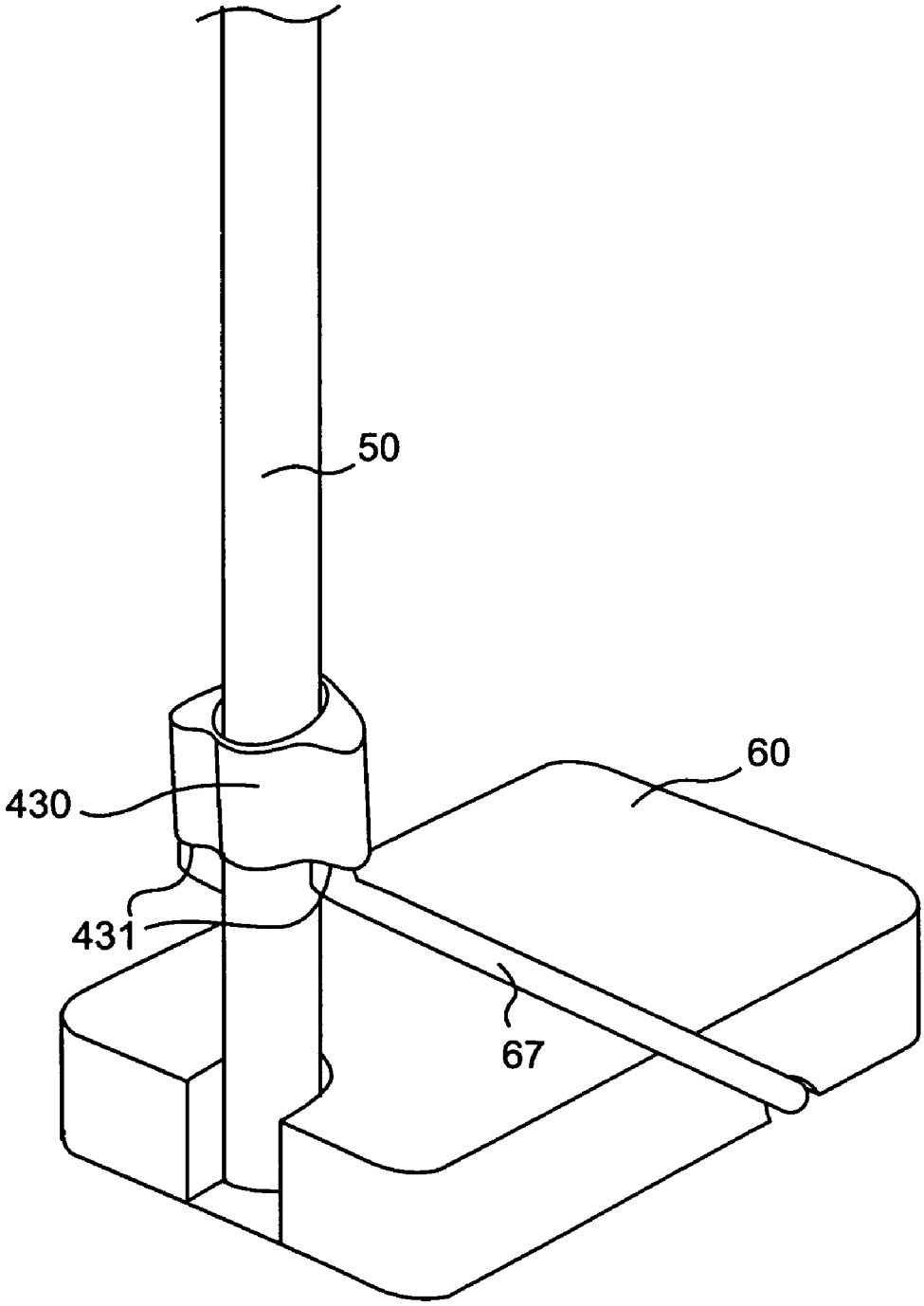
FIG. 23 shows a view of a strut, pole and base assembly according to one embodiment of the present invention.

FIG. 23 shows an alternative embodiment of the pole 50 and strut 67 assembly, where the ends of strut 67 may be secured to pole 50 with a strut cap 430. Strut cap 430 may be sized and shaped to fit and frictionally engage the outer circumference of pole 50 and having strut end slots 431 for receiving the ends of struts 67. The ends of strut 67 may be received and frictionally secured into strut end slots 431, thereby securing strut 67 to pole 50.

Figure 24:
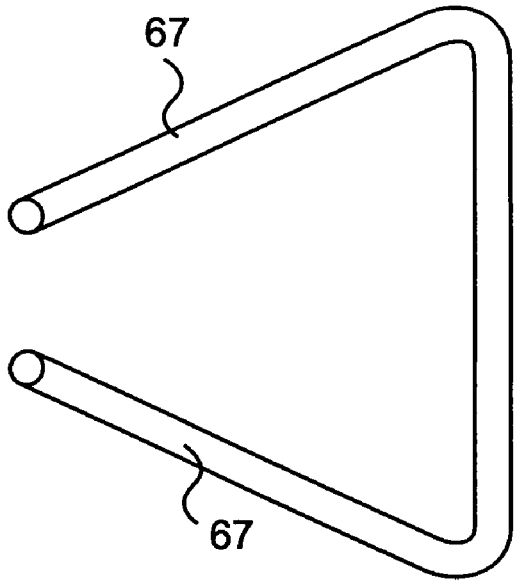
FIG. 24 shows a strut according to one embodiment of the present invention.
Figure 25:
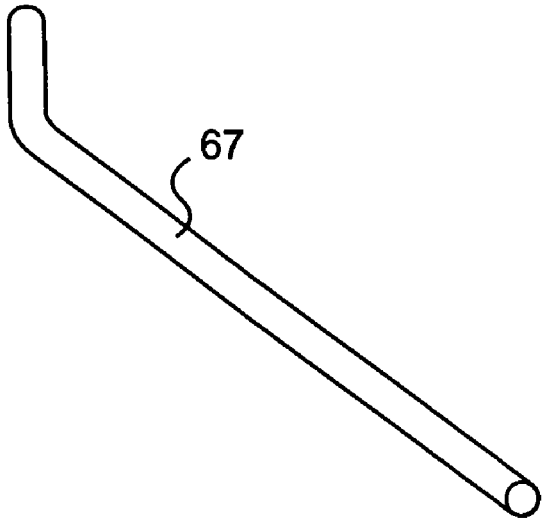
FIG. 25 shows a strut according to one embodiment of the present invention.
Figure 26:
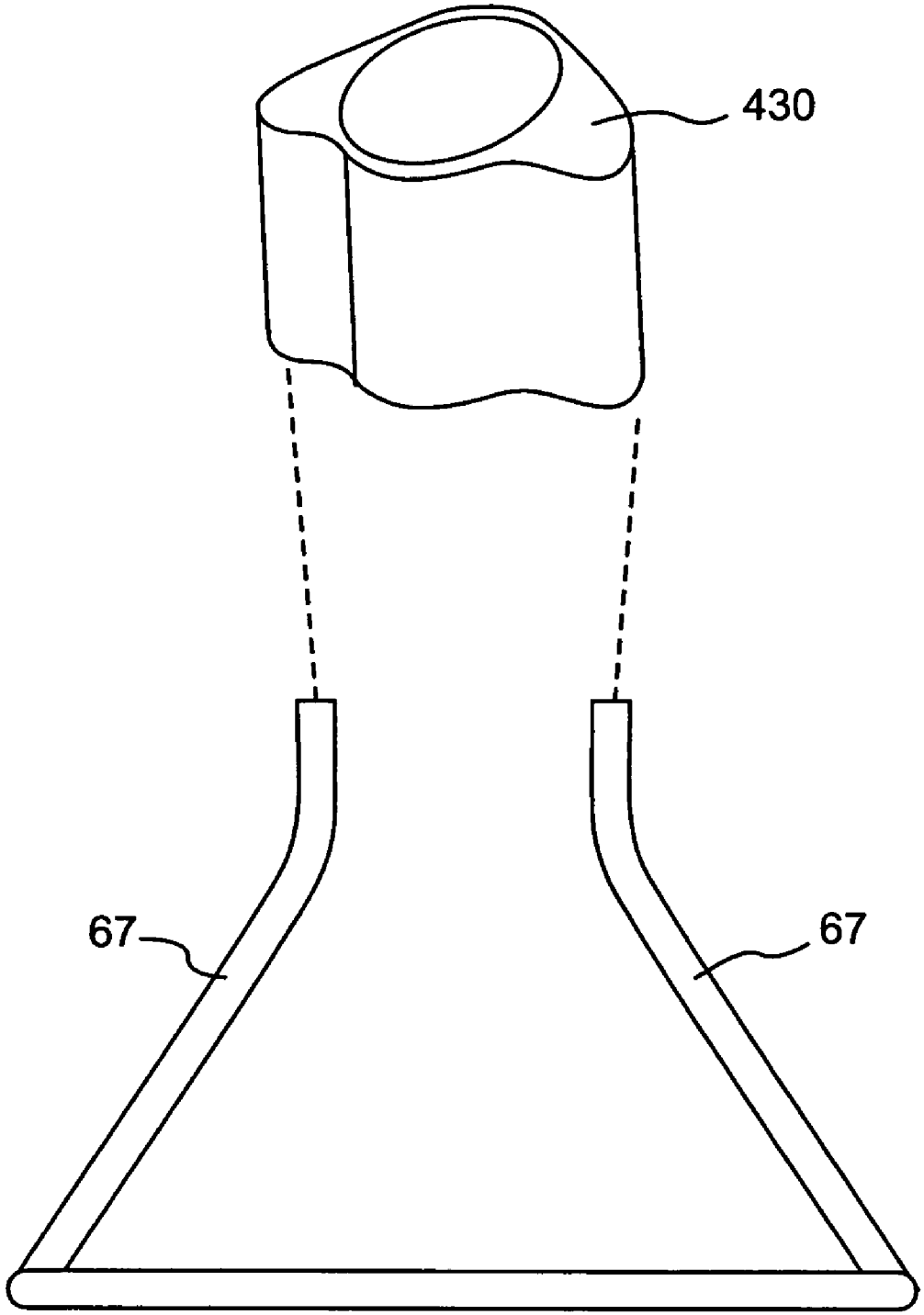
FIG. 26 shows a strut and pole connection according to one embodiment of the present invention.

FIG. 24 shows a strut 67 formed in a tubular shape and capable of engaging the base 60 and the strut cap 430 of FIG. 23. FIG. 25 illustrates a side view of the strut 67 as shown in FIG. 24. FIG. 26 shows a front view of the strut cap 430 and the struts 67 as shown in FIG. 23.

Figure 27A:
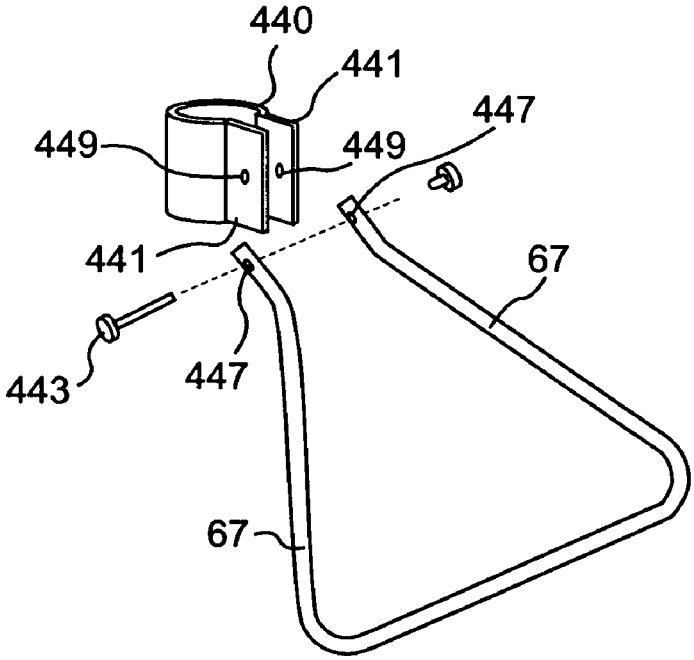
FIGS. 27A-27F show a strut assembly according to one embodiment of the present invention.
Figure 27B:
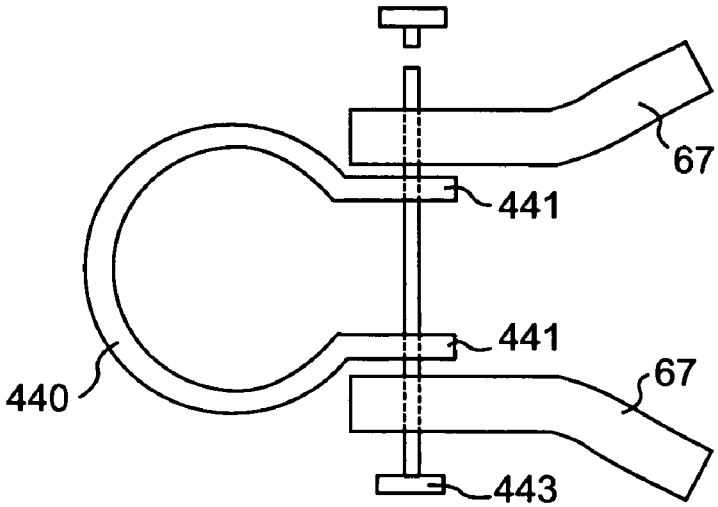

FIGS. 27A-27B show an alternative embodiment of strut 67 and a pole bracket 440, where pole bracket 440 is sized and shaped to fit the outer circumference of pole 50 (not shown). Pole bracket 440 may also include flanges 441 that abut the ends of strut 67 and are secured by hand grippable threaded bolt 443, which is received into eyelets 447 of strut 67 and by eyelets 449 of flanges 441 as shown in FIG. 27B. It should also be obvious to one of ordinary skill in the art that the struts 67 may be welded or otherwise mechanically fastened to the bracket 440.

Figure 27C:
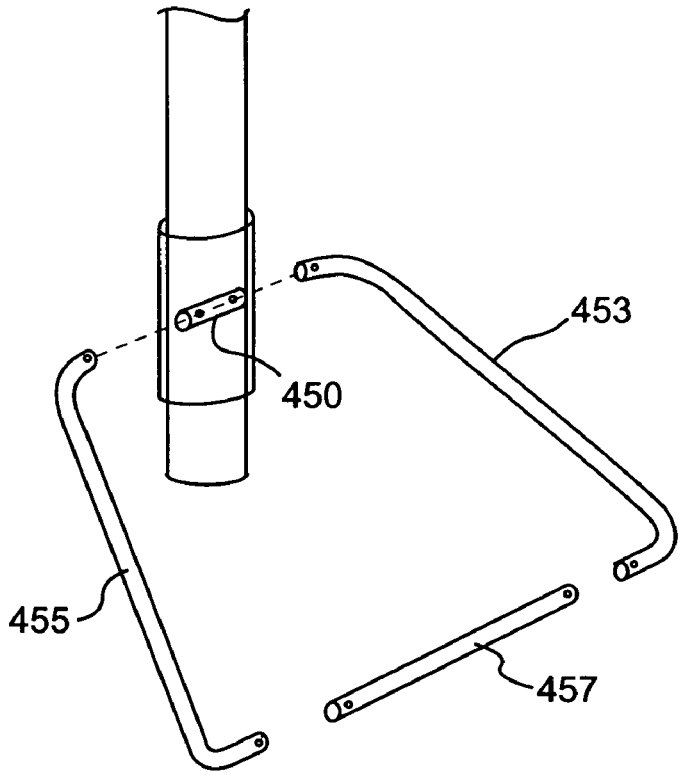
Figure 27D:
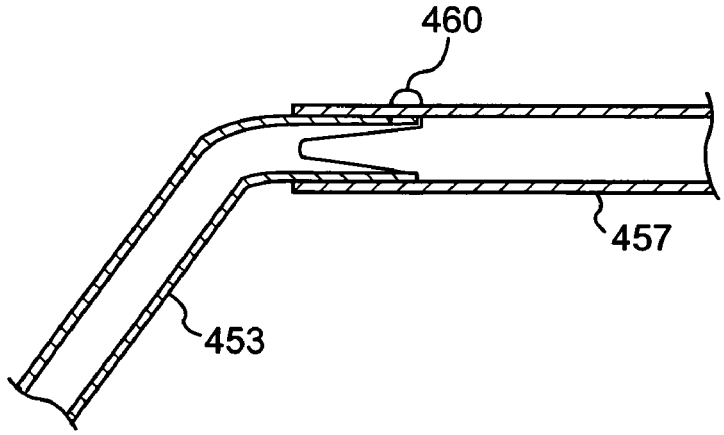
Figure 27E:
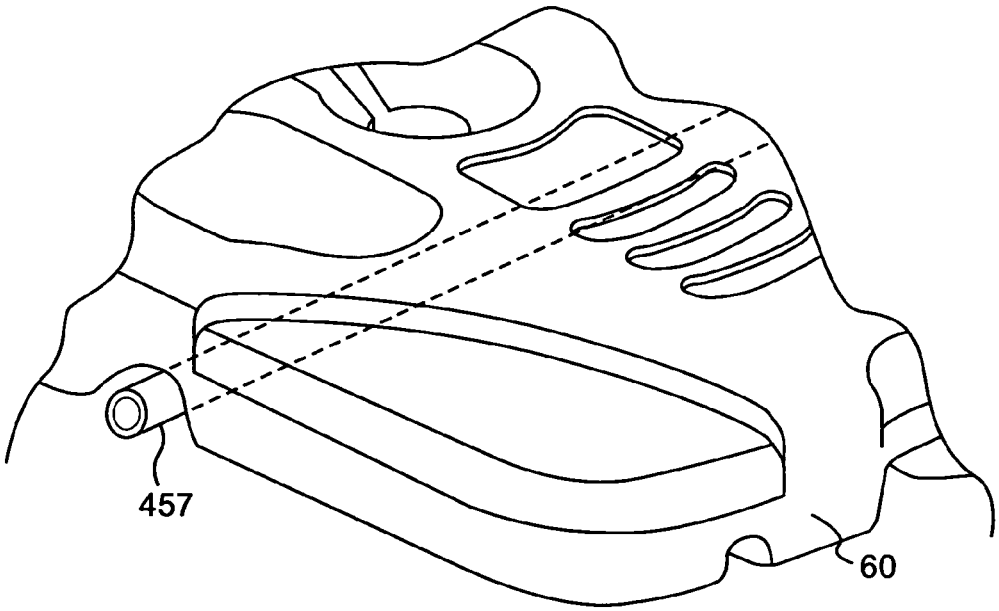
Figure 27F:
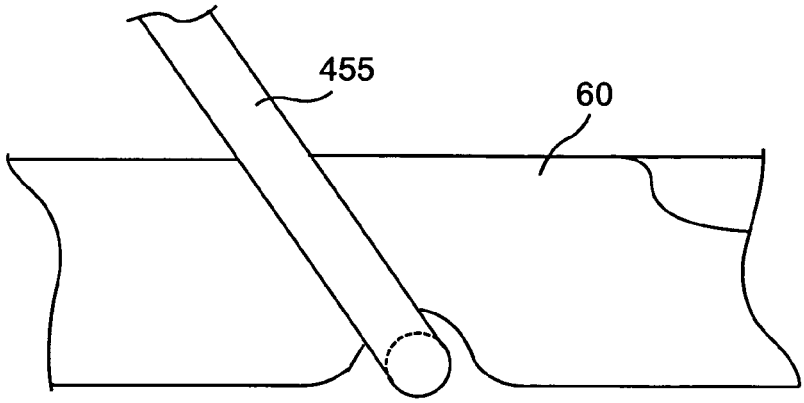

FIGS. 27C and 27D show an alternative embodiment of the strut 67 and a pole bracket 450. FIG. 27C shows an alternative embodiment of the strut 67 and pole 50 assembly, where strut 67 may configured in multiple section 453, 455 and 457. The ends of sections 453 and 455 may be received into slots in element 450 which may be welded to pole 50 or to the bracket 440. Alternatively, element 50 may be secured by other suitable fastening means such as nut and bolt, rivet or machine screw. FIG. 27C shows one manner of securing section 453 and 455 or the other sections of strut 67, with a spring lock 460 as shown in detail in FIG. 27D. The connections between bracket 450 and struts 453 and 455 may be secured using the spring lock 460. Furthermore, the connections between the strut member 457 and the struts 453 and 455 may also be secured using the spring lock 460. FIG. 27E shows the assembly of base 60 and section 457 of strut 67, where section 457 may be secured to the underside of base 60 by any suitable means. As shown in FIG. 27F, section 457 may be secured to the underside of base 60 frictionally when the assembly of strut 67 and pole 50 is complete so as to reduce the number of parts and/or steps in assembly of the basketball system.

Figure 28A:
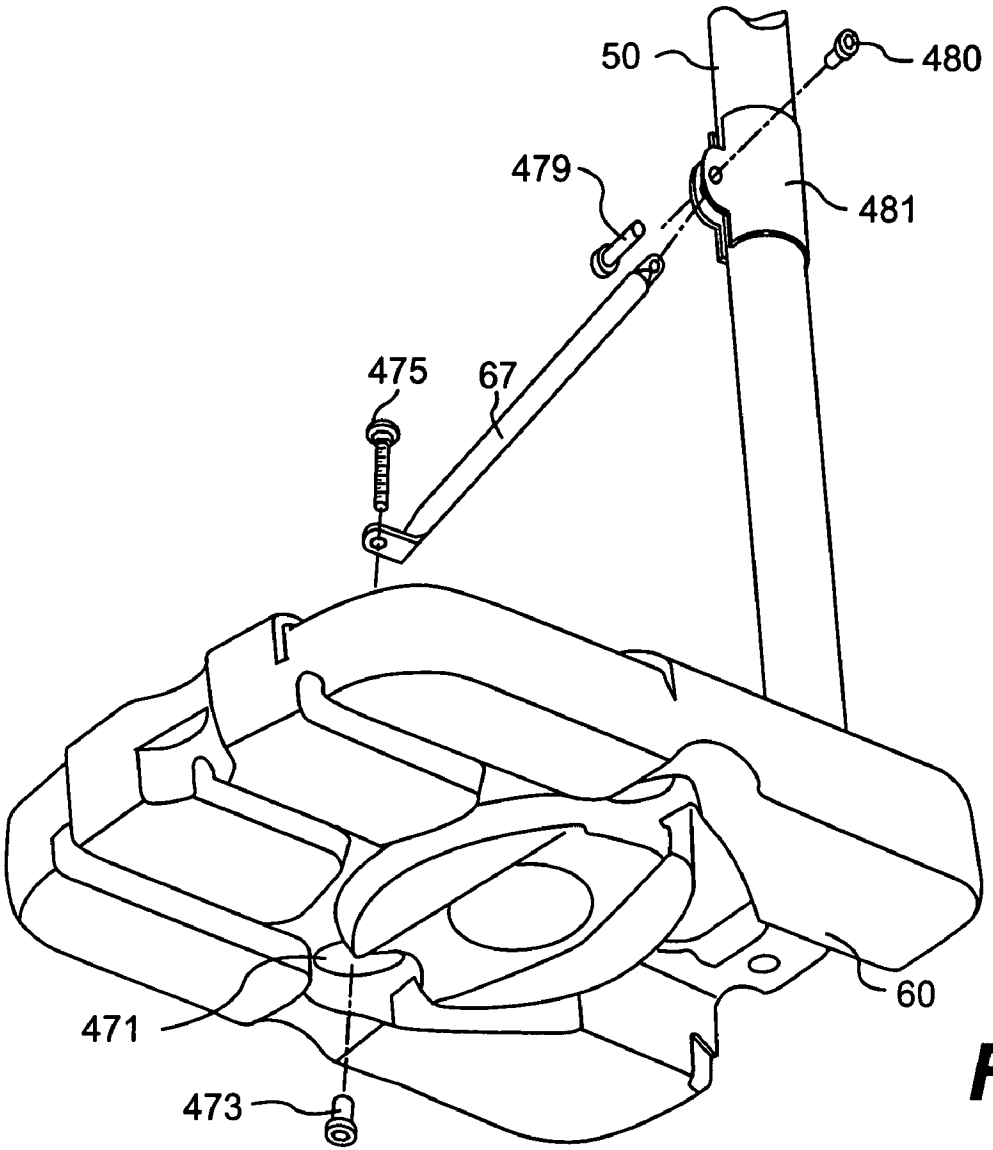
FIGS. 28A-28B show a strut and base assembly according to one embodiment of the present invention.
Figure 28B:
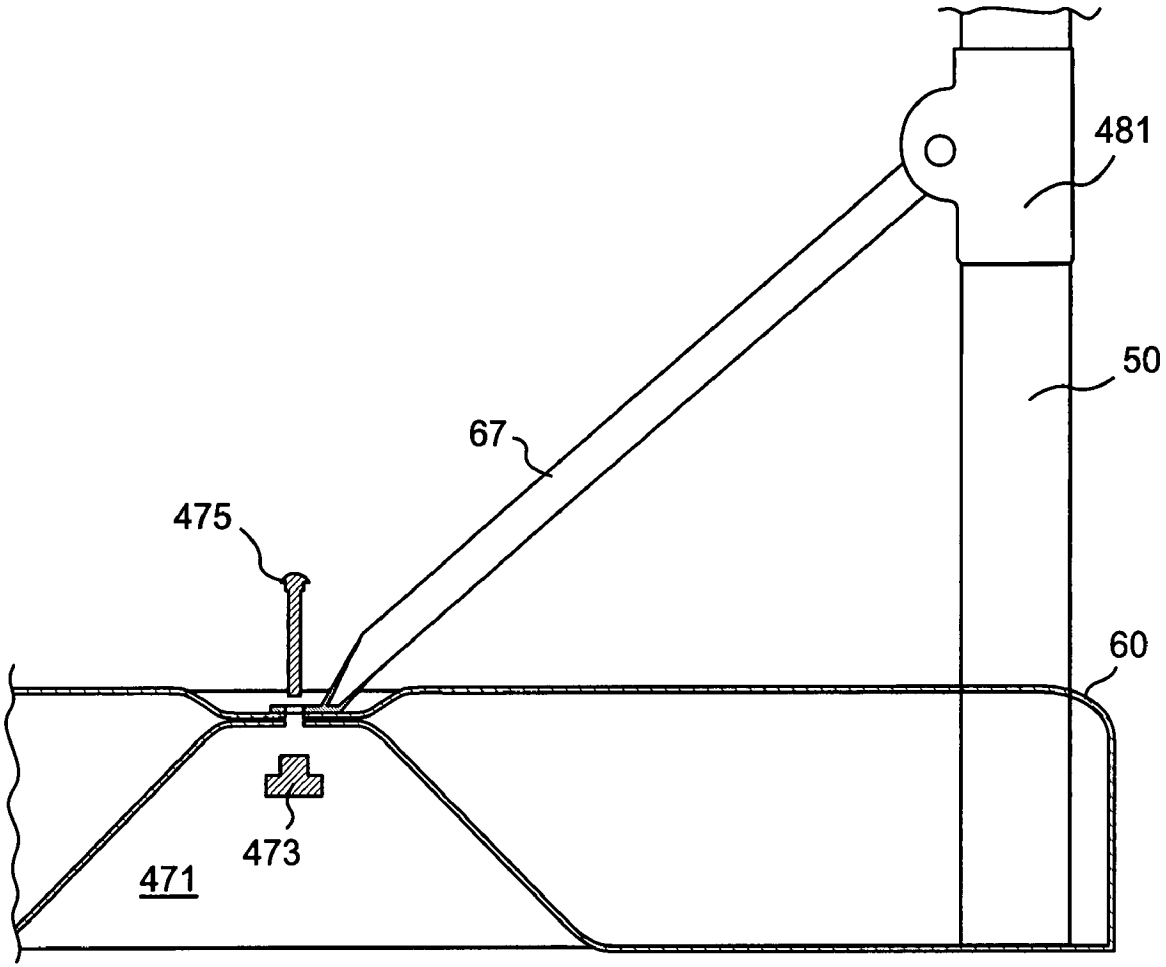

FIG. 28A shows an underside view of an alternative embodiment of the strut 67, pole 50 and base 60 assembly. Base 60 may include pockets 471 on the underside thereof for receiving a hand grippable nut 473 that mates with a carriage bolt 475 to secure strut 67 to the top of base 60 as shown in FIG. 28B. Strut 67 may be secured to pole 50 with collar 481, knob 480 and bolt 479 combination.

Figure 29A:
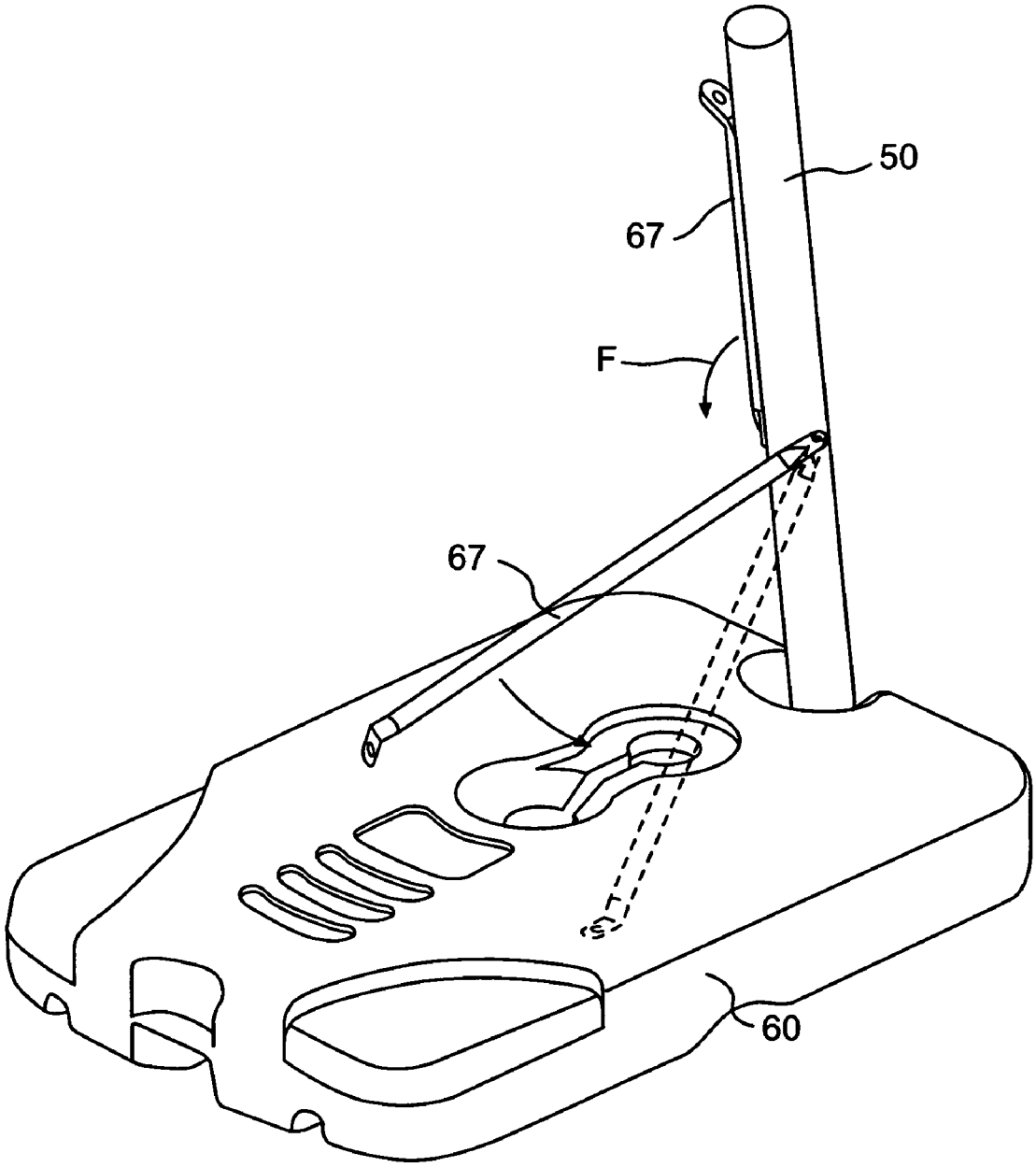
FIGS. 29A-29C show a strut and base assembly according to one embodiment of the present invention.
Figure 29B:
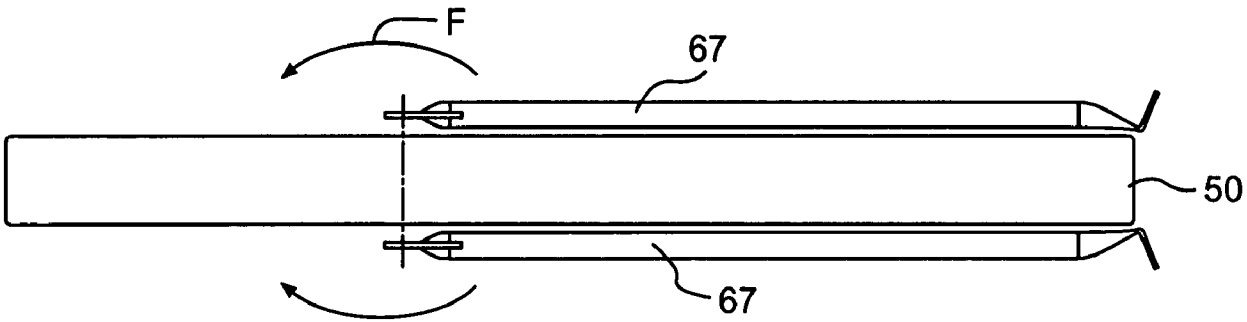
Figure 29C:
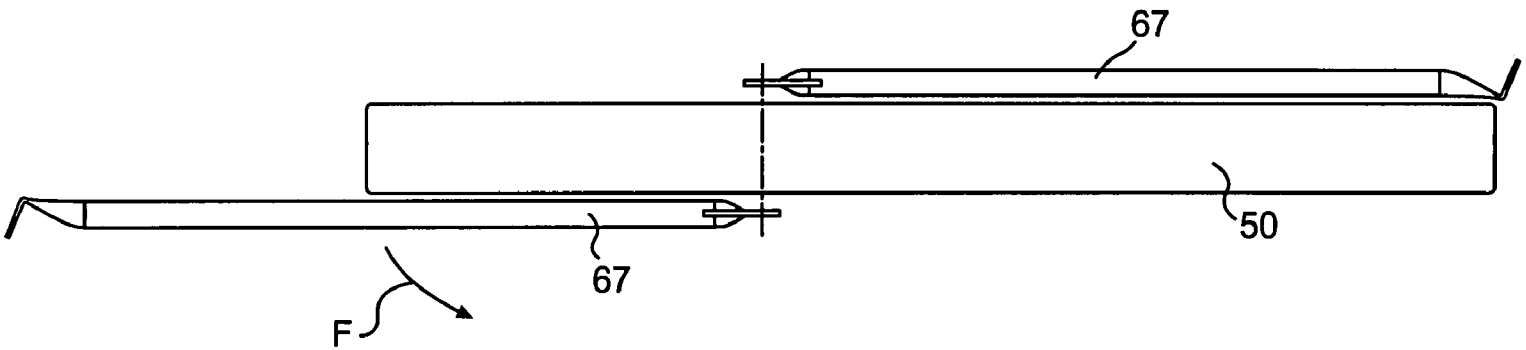

FIG. 29A shows an alternative for the connection of the base 60, the struts 67 and the pole 50. The struts 67 may be permanently attached to the pole 50 and rotatably folded onto the pole 50 to minimize packaging space and maximize shipping space for other components. When the pole 50 is unpackaged and prepared for assembly, struts 67 may be rotated downward and outward in the direction of lines F as shown in FIGS. 29B and 29C. The struts 67 may be rotated from the positions shown in FIG. 29B to the position shown in dashed lines in FIG. 29A.

Figure 30A:
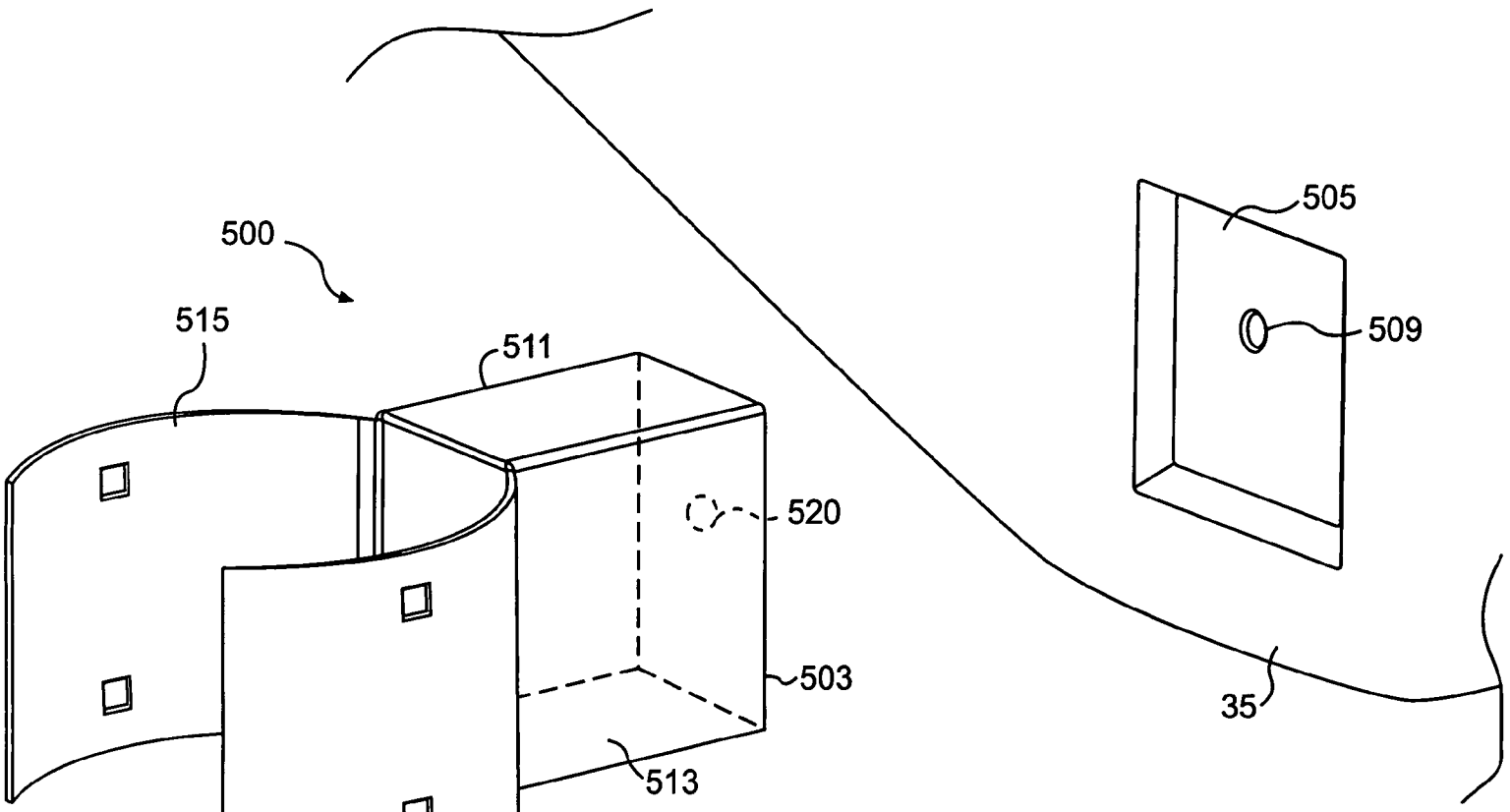
FIGS. 30A-30E show a goal and bracket assembly according to one embodiment of the present invention.
Figure 30B:
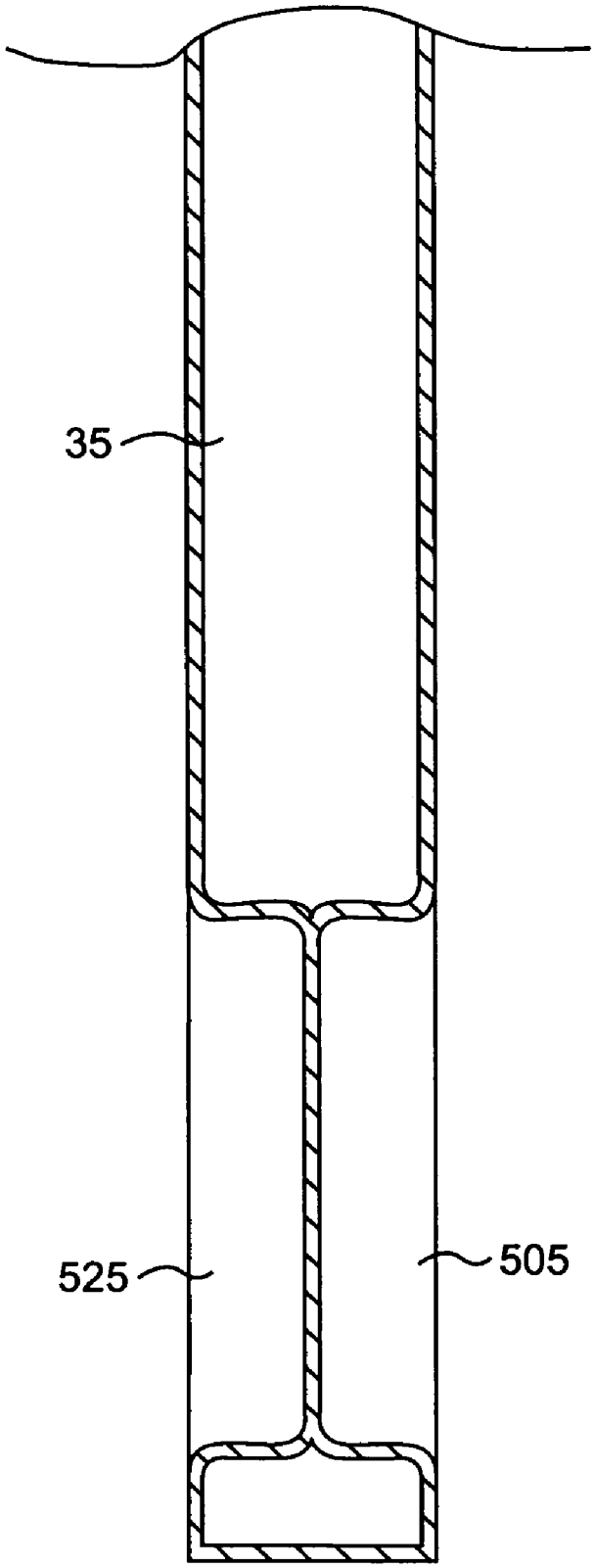

FIG. 30A shows an alternative embodiment of pole bracket 45 and backboard 35. Pole bracket 45 may include junction section 500 which is sized and shaped to be received into a rear slot 505 of backboard 35. Rear slot 505 receives and frictionally secures back plate 503 of junction section 500. Junction section 500 may also include side plates 511 and 513 connecting back plate 503 to pole section 515 of bracket 45. Preferably, back plate 503 includes an opening 520 and is sized and shaped to mate with opening 509 in rear slot 505. Also, back plate 503 is sized and shaped so a user may easily secure a hand grippable knob (not shown) to any bolt received through opening 509 and 520. As shown in FIG. 30B backboard 35 may also include a front slot 525, which is opposite the rear slot 505 on the backboard 35.

Figure 30C:
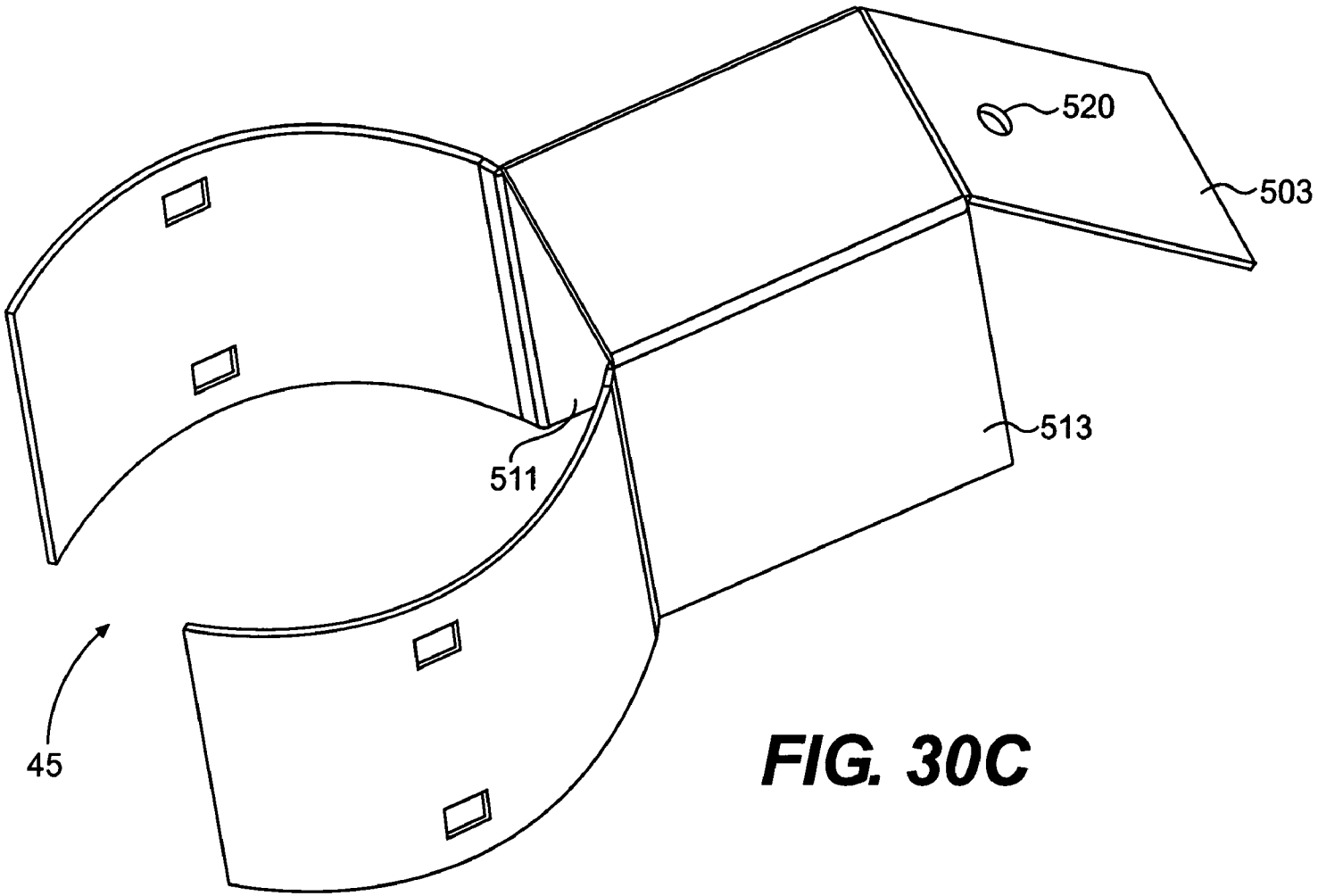

As shown in FIG. 30C, the bracket 45 may be formed from a single sheet of material and cut to form the individual plates and sections 503, 511, 513, and 515. After being folded or bent into positions, the sections may be welded or secured using well known mechanical means. In FIG. 30C, the back section 503 may be bent until the edges of section 503 meet the edges of section 513 and 511.

Figure 30D:
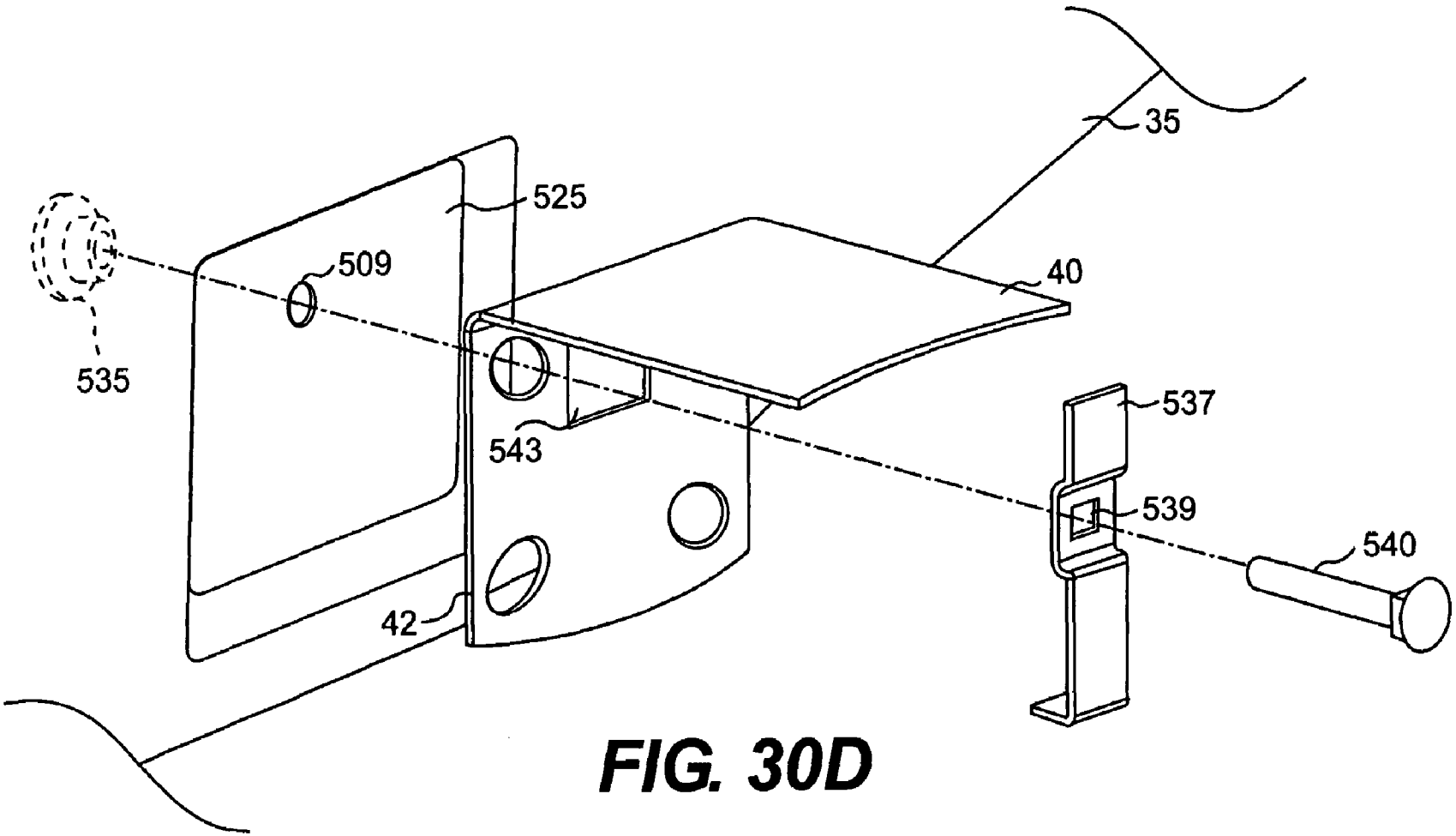

Referring now to FIG. 30D, a front view is shown of the backboard 35 as shown in FIG. 30A. Plate 42 of goal 40 may be sized and shaped to be received and frictionally secured into front slot 525 such that opening 509 is mated with opening 543 in plate 42. Bracket 537 may be positioned on the front side of plate 42 to secure plate 42 to backboard 35 with a carriage bolt 540 sized and shaped to be received into and through opening 539 in bracket 537, opening 543 in plate 42, opening 509 in backboard 35, opening 520 in backplate 503 of bracket 45 on the rear side of backboard 35 and ultimately secured via hand grippable knob 535 (as shown in FIG. 30D).

Figure 30E:
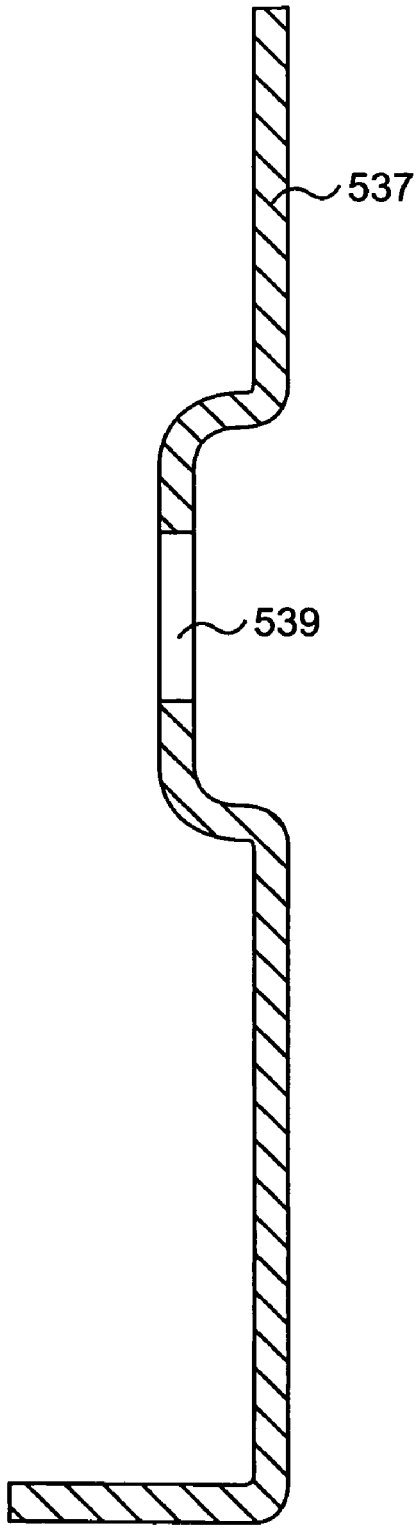

FIG. 30E shows the bracket 537 and the opening 539 for receiving and securing the plate 42 to the backboard 35.

Figure 31A:
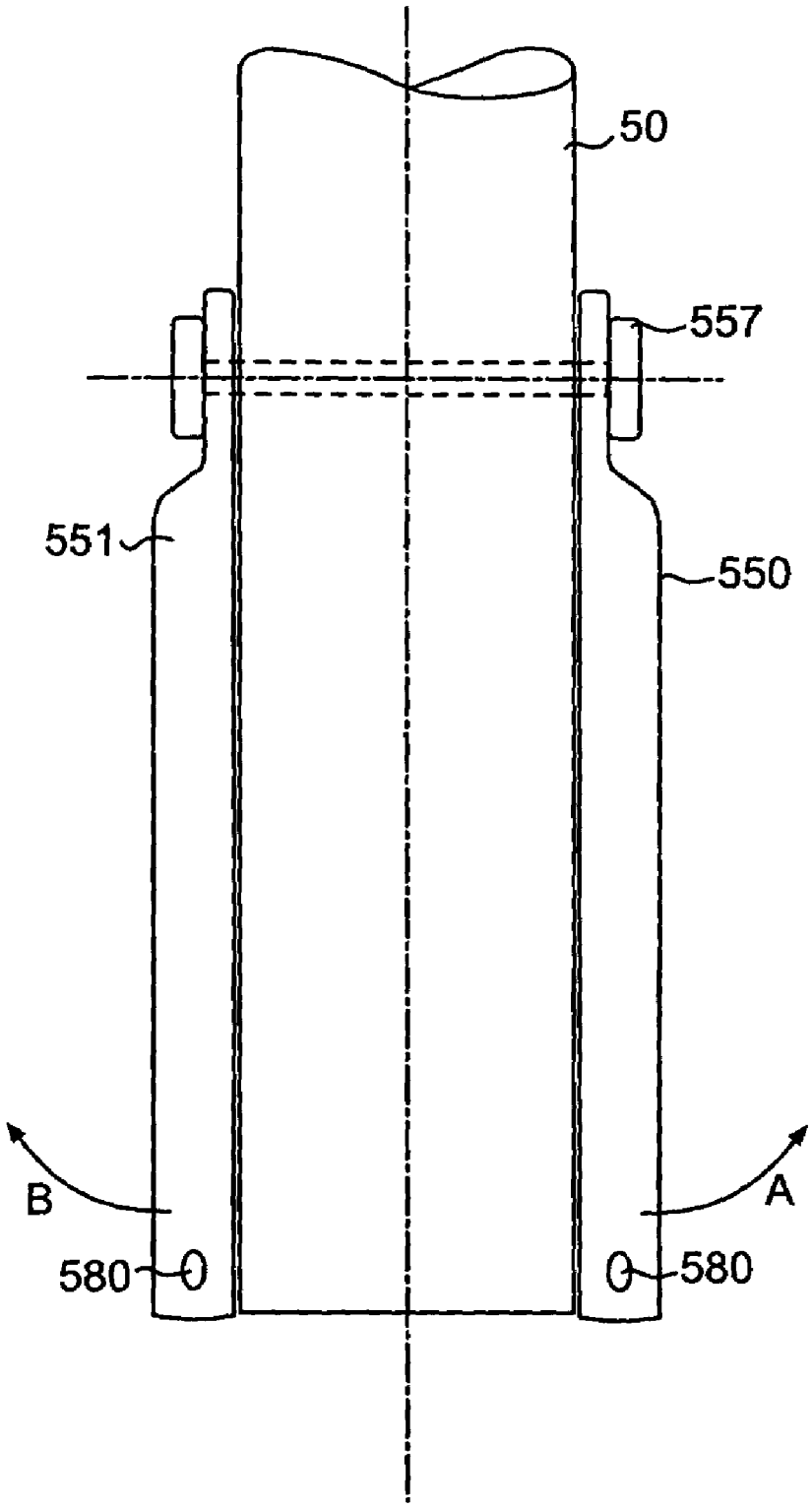
FIGS. 31A-31E show a strut and base assembly according to one embodiment of the present invention.
Figure 31B:
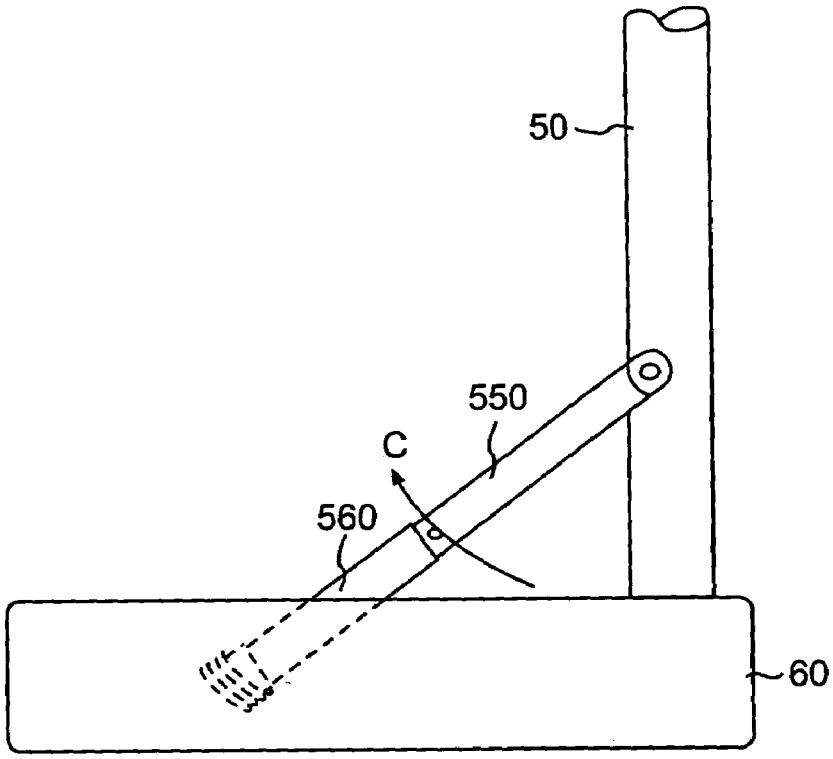
Figure 31C:
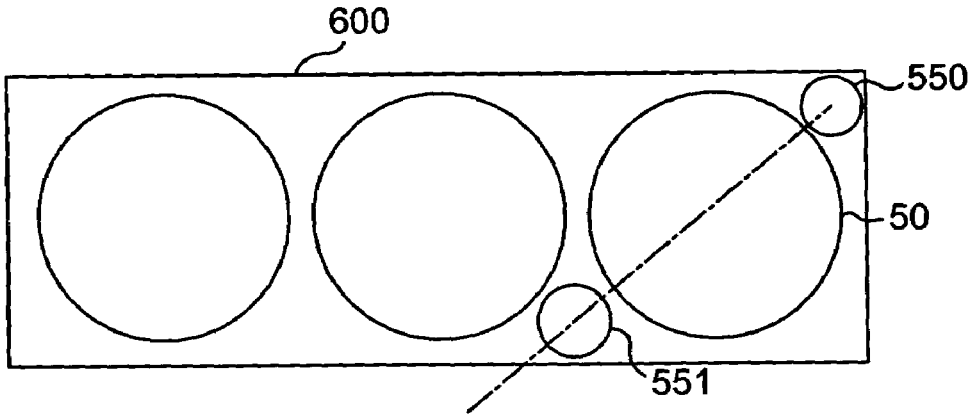

FIG. 31A shows an alternative embodiment of the strut 550, 551 and pole 50 assembly. Struts 550 and 551 may be rotationally secured to pole 50 with bolts 557 before the basketball system 10 is shipped to the consumer. In some embodiments, strut 550 may be bent away from pole 50 along line A and strut 551 may be bent away from pole 50 along line B. In some embodiments, struts 550 and 551 extend to the bottom end of pole 50. As shown in FIG. 31B, struts 550 and 551 may be rotated along lines A and B to bring the struts in alignment with positions on the base suitable for securing the struts. FIG. 31C shows a prepack box 600 that includes optimum dimensions for packaging the basketball system 10 when the struts 550 and 551 are secured to the pole 50 before shipping.

Figure 31D:
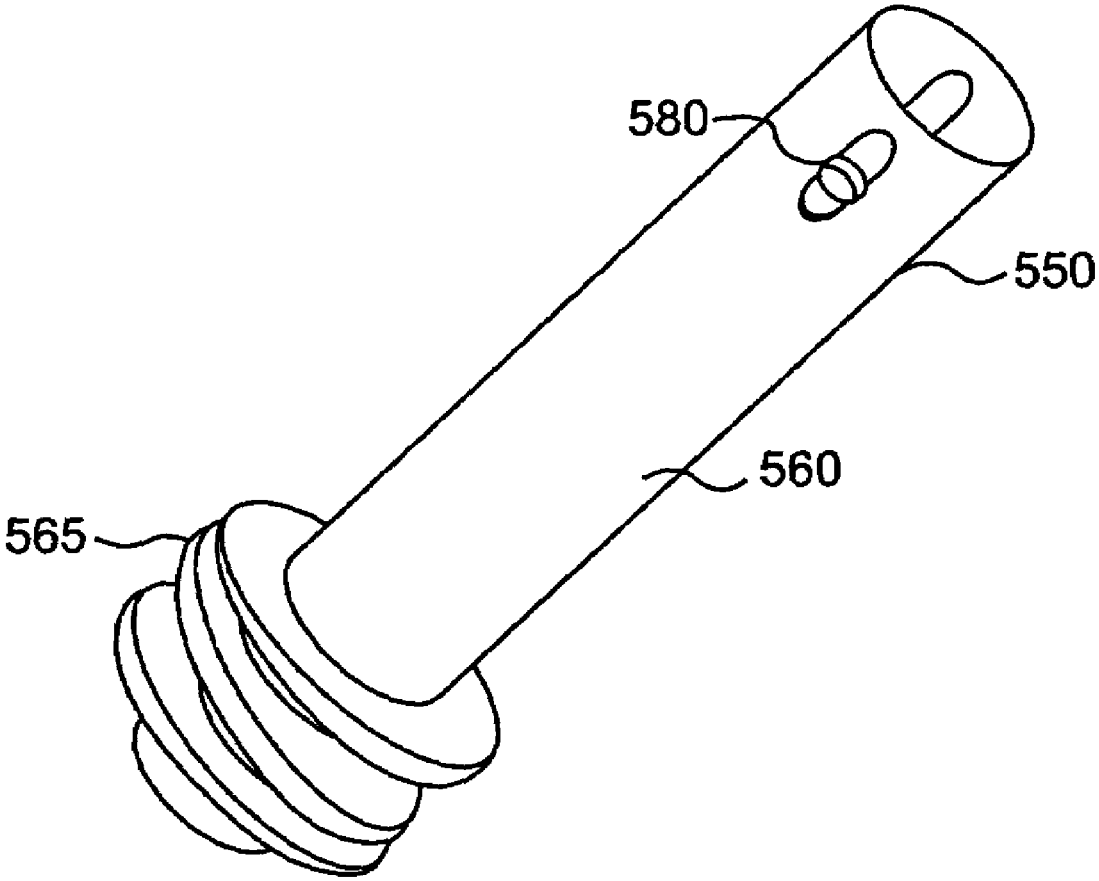
Figure 31E:
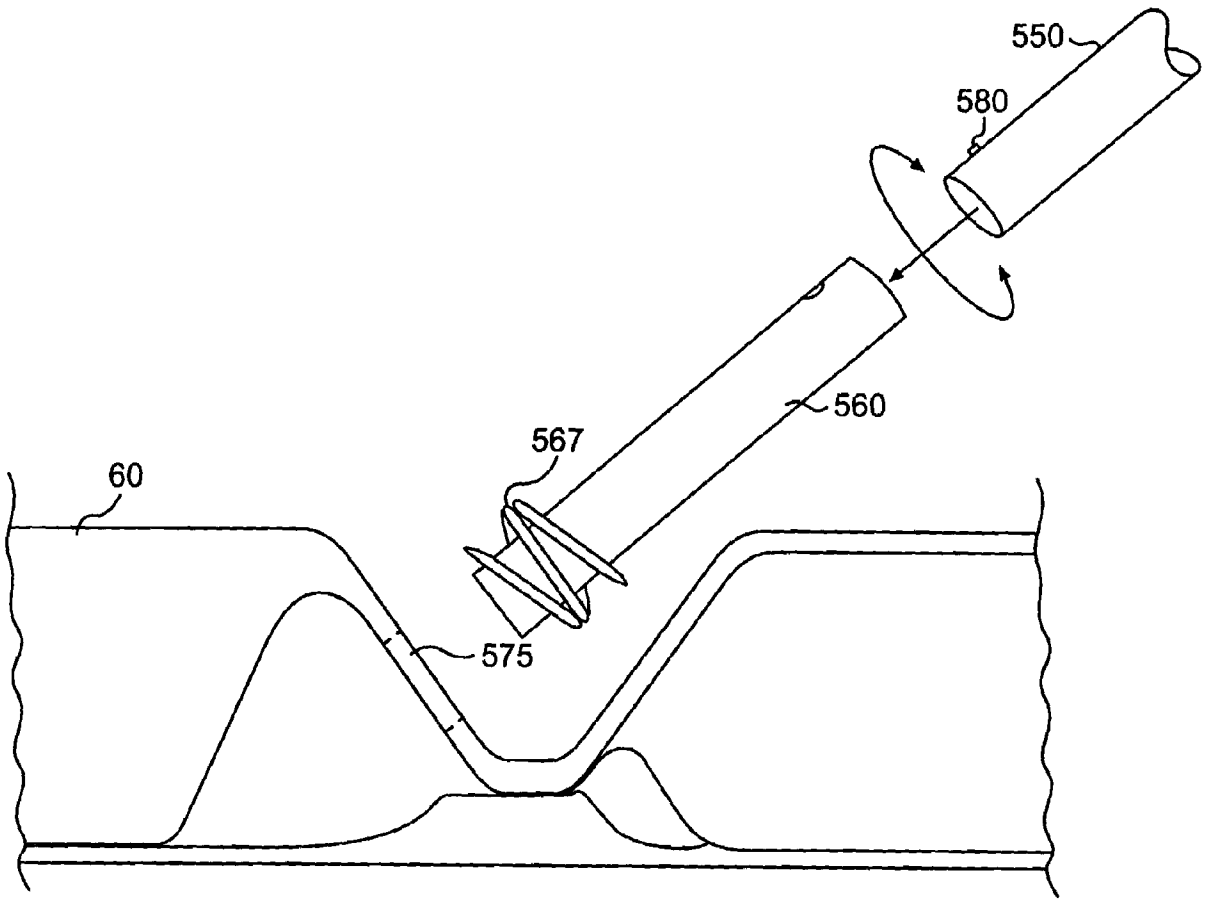

In FIG. 31B, the strut section 560 is shown connected to the strut 550. The line C indicates how the strut 550 must be rotated out from the pole 50 to meet the strut 560. FIG. 31D shows the strut 560 with a spring lock 580 for securing the strut 560 to the strut 550. FIG. 31E shows the assembly of strut 550 to lower strut 560, connected via a spring lock or snap button 580. Lower strut 560 may include a threaded portion 656 sized and shaped to interface and mate with angled opening 575 in base 60 as shown in FIG. 31B. Rotating lower strut 560 into angled opening 575 secures lower strut 560 to base 60 and extends lower strut 560 into a suitable position for mating with strut 550 to ultimately support pole 50 (not shown). The upper strut 550 may be rotated out from the pole 50 to mate with the strut 560.

Figure 32A:
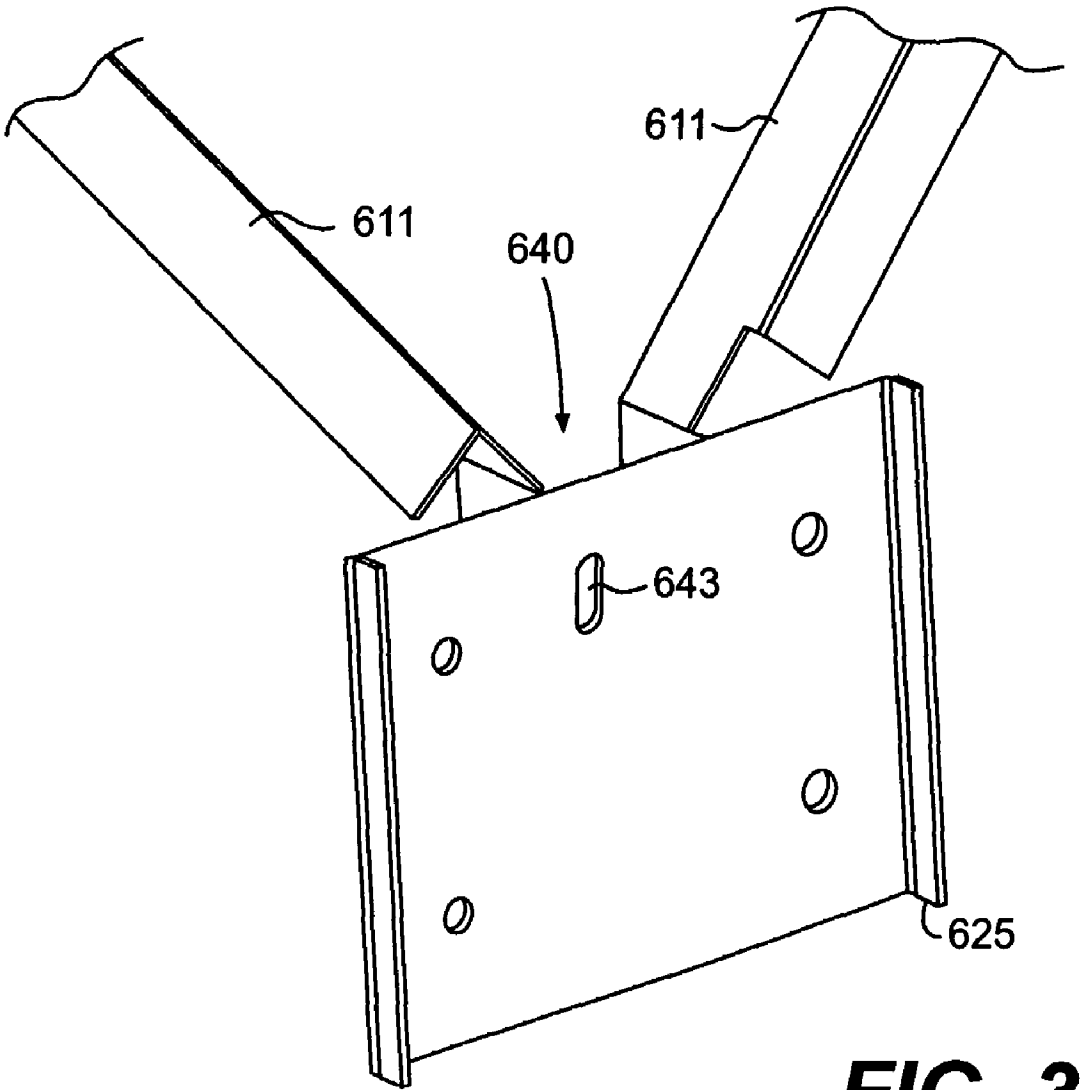
FIGS. 32A-32B show a goal and bracket assembly according to one embodiment of the present invention.
Figure 32B:
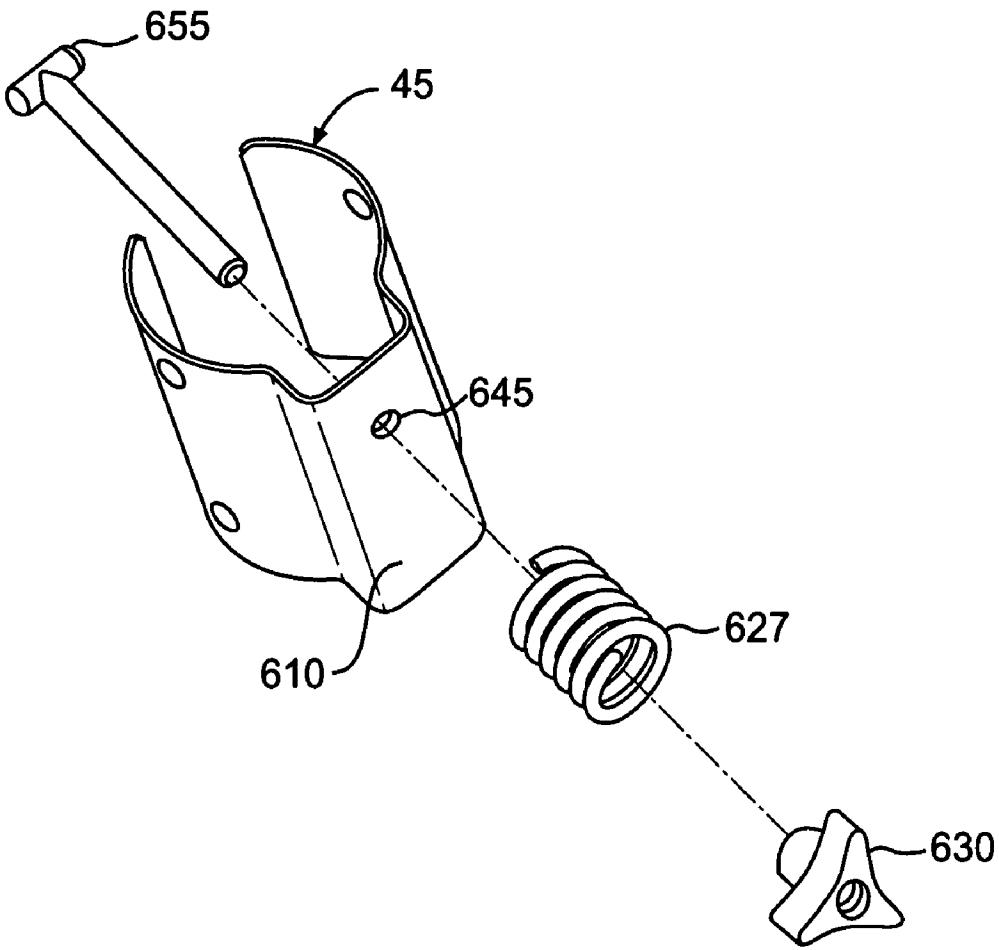

FIG. 32A shows the front side of backboard 35 designed for use with a removable rebound member constructed from a transparent acrylic or other material. The backboard 35 includes with Y-brackets 611 on the rear of backboard 35. Backboard 35 may include brackets 625 structured and arranged to receive backplate 42 of goal 40 (not shown). Backboard 35 may also be an opening 643 that aligns with opening 645 in bracket 45 (shown in FIG. 32B). The opening 643 may be sized and shaped to receive T-bolt 655 as shown in FIG. 32B. T-bolt 655 may secure pole bracket 45 to the rear of backboard 35 and may secure plate 42 (not shown) to the front of backboard 35 with spring 627 and knob 630. Brackets 625 may be integrally formed with the backboard or may be parts separate from backboard 35 and secured thereto by any known means.

Additionally, brackets 625 may be made of acrylic or other material having similar physical characteristics. It should be understood by one of ordinary skill that an acrylic backboard member may be placed over and around brackets 625 and secured to the Y-brackets 611 for support. The backboard also includes a niche 640 between the Y-brackets 611 for receiving the backboard support section 610 of the bracket 45. Section 610 may be sized and configured to fit into niche 640.

Figure 33A:
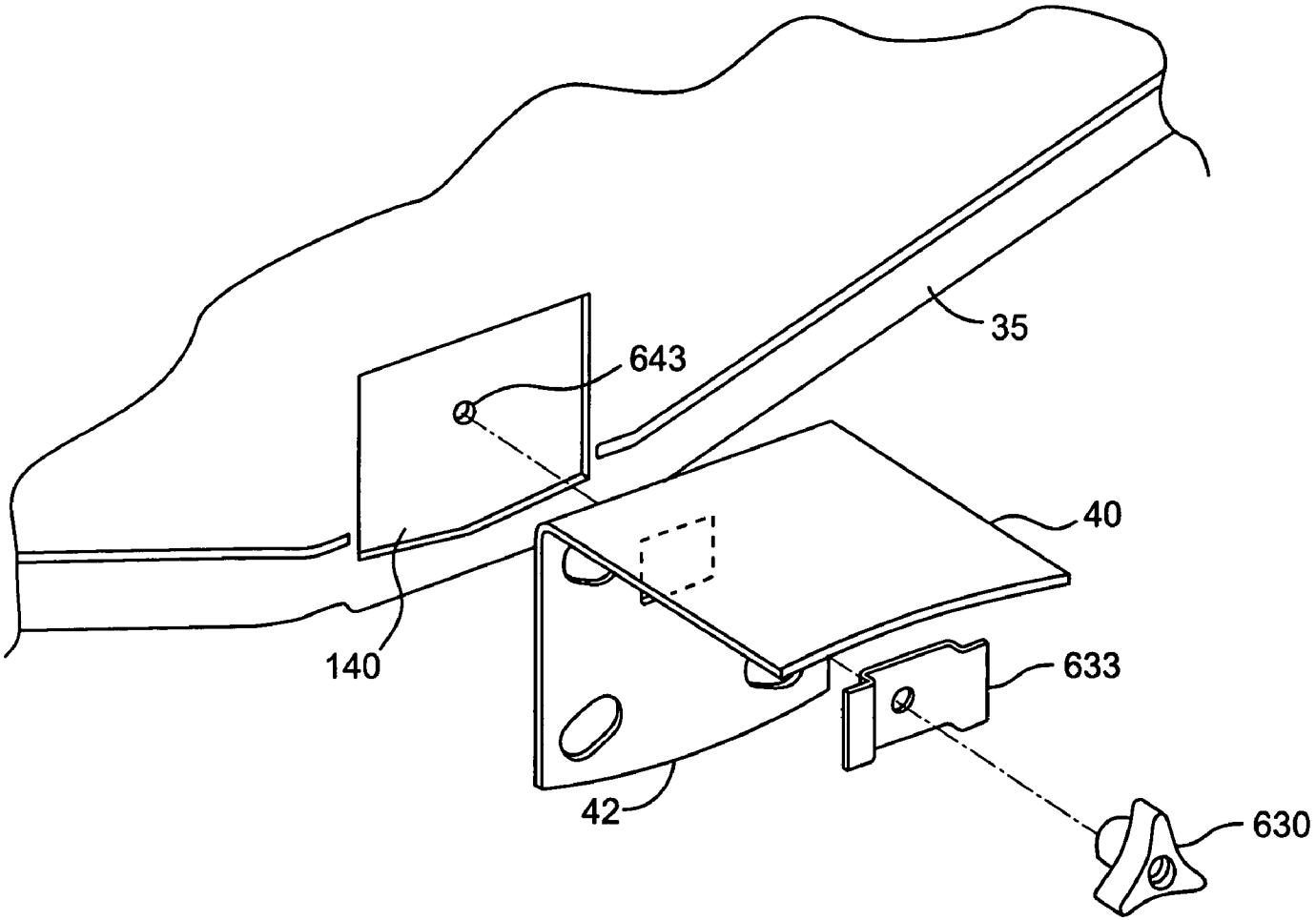
FIGS. 33A-33B show a goal and bracket assembly according to another embodiment of the present invention.
Figure 33B:
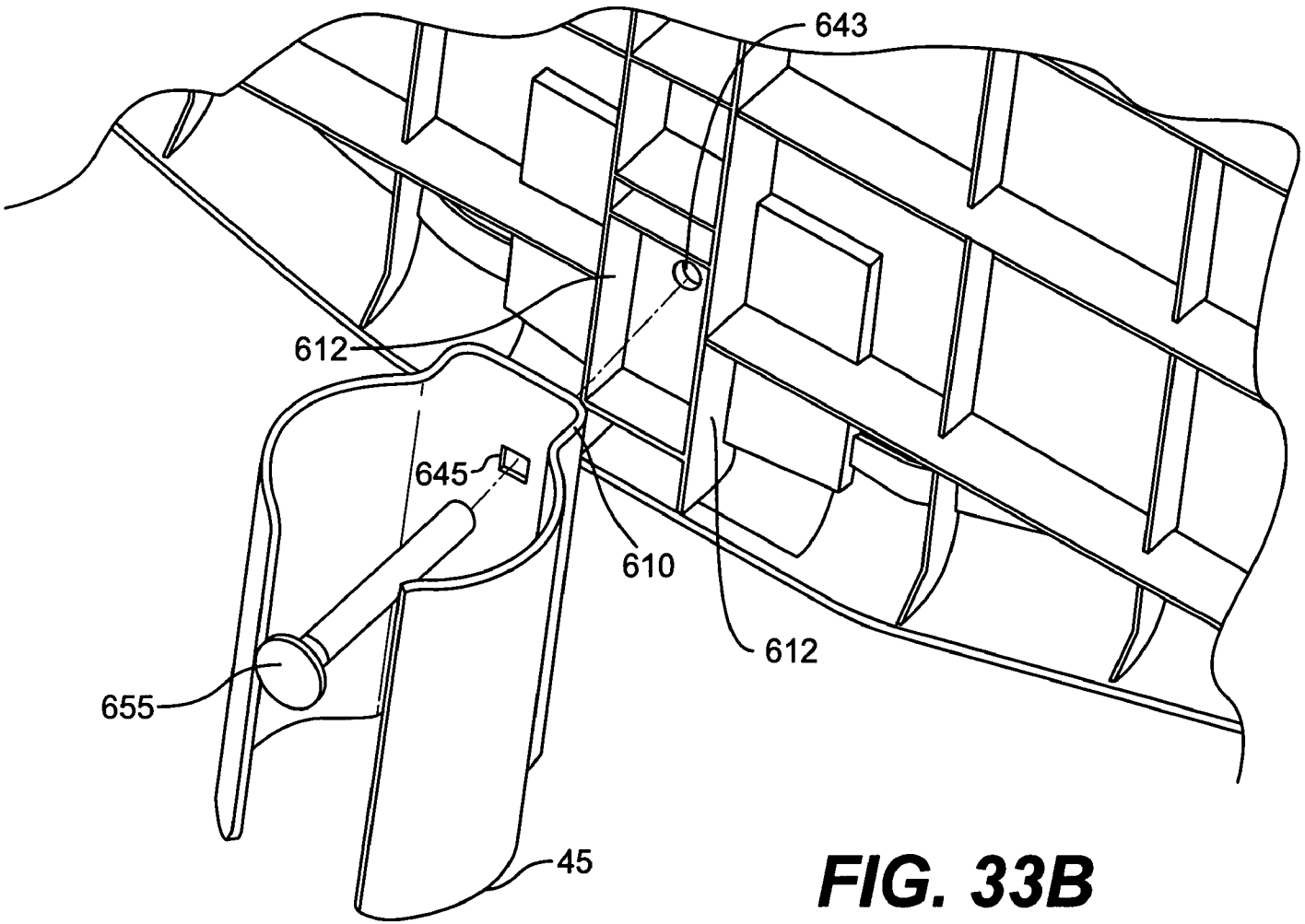

FIGS. 33A and 33B show an alternative embodiment of the backboard 35, goal 42 and pole bracket 45 assembly as shown in FIGS. 32A-32B. In this embodiment clip 663 may replace spring 627 (shown in FIG. 32B) and the section 610 of bracket 45 may be received into the opening formed between the flanges 612. Furthermore, the plate 42 may be received into the recess 140 on the front side of the backboard 35.

Figure 34A:
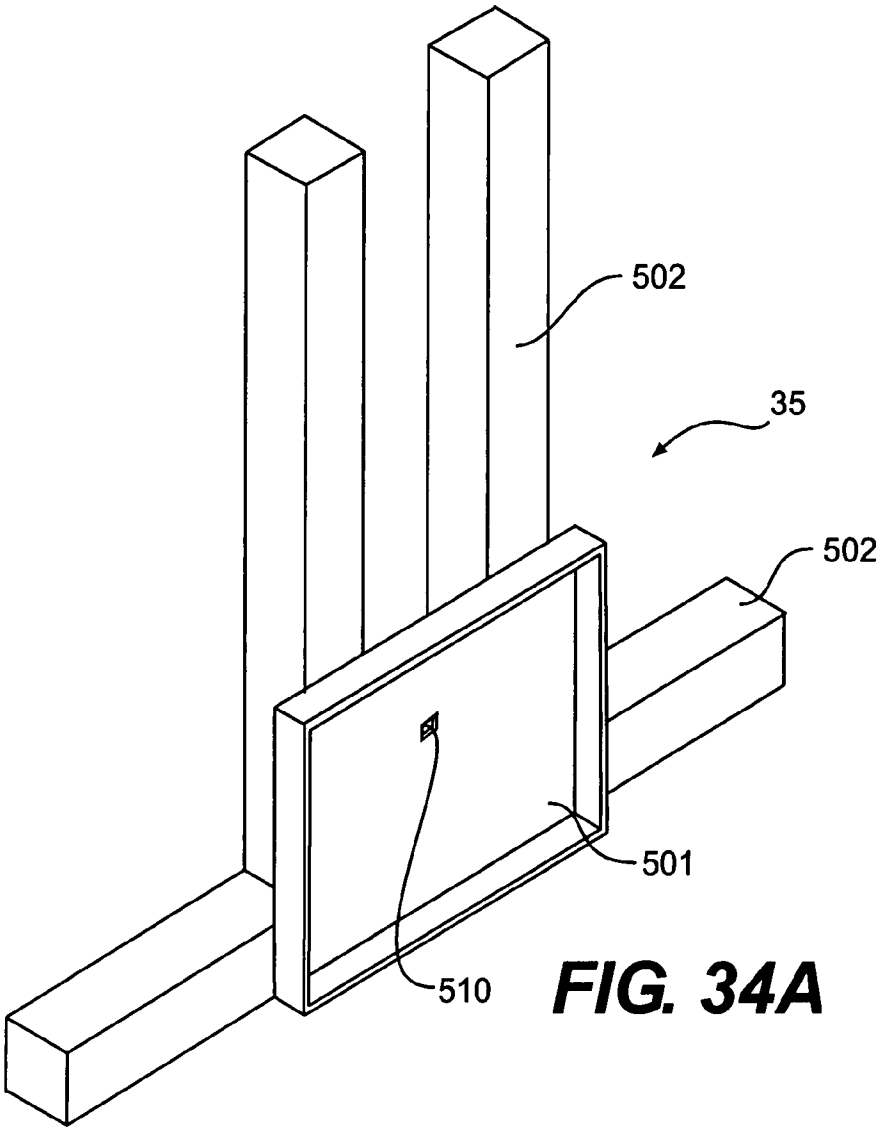
FIGS. 34A-34D show a goal and bracket assembly according to another embodiment of the present invention.
Figure 34B:
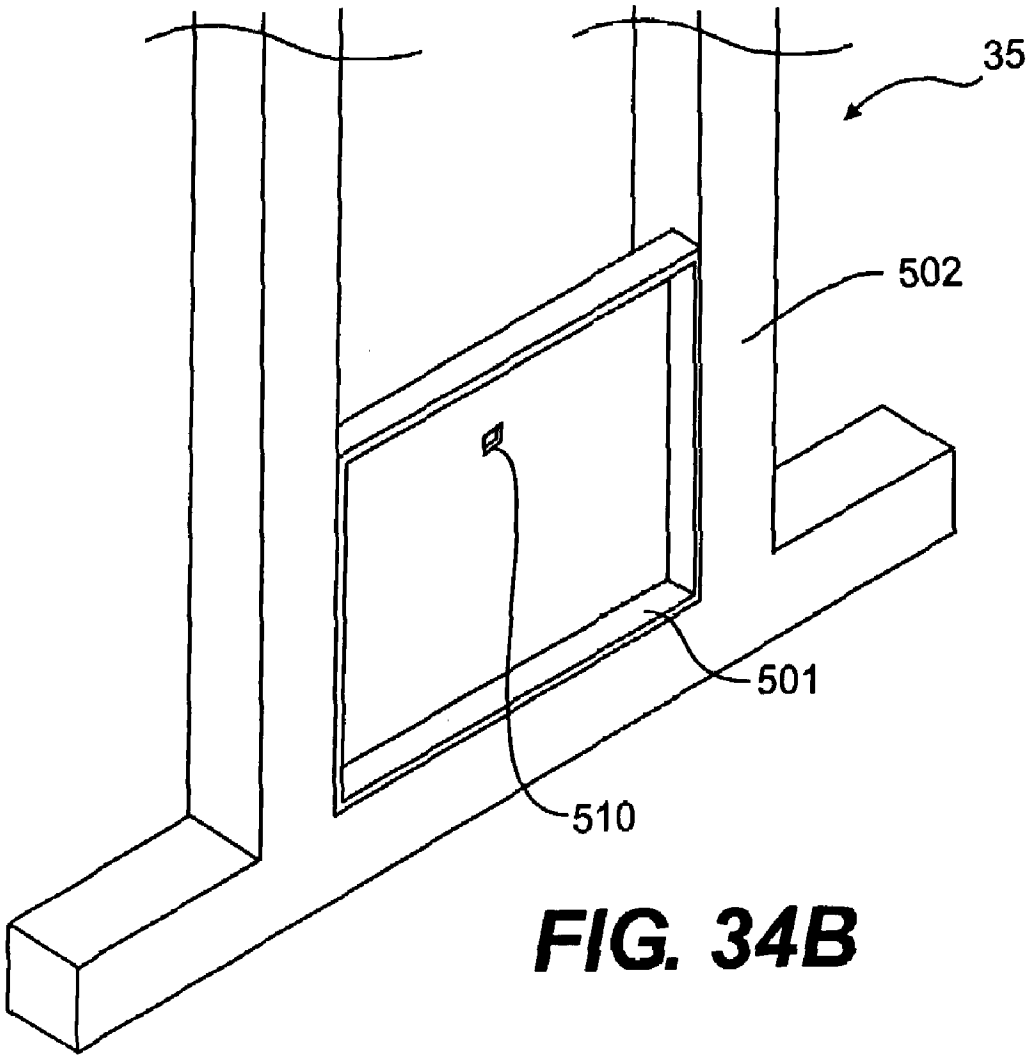
Figure 34C:
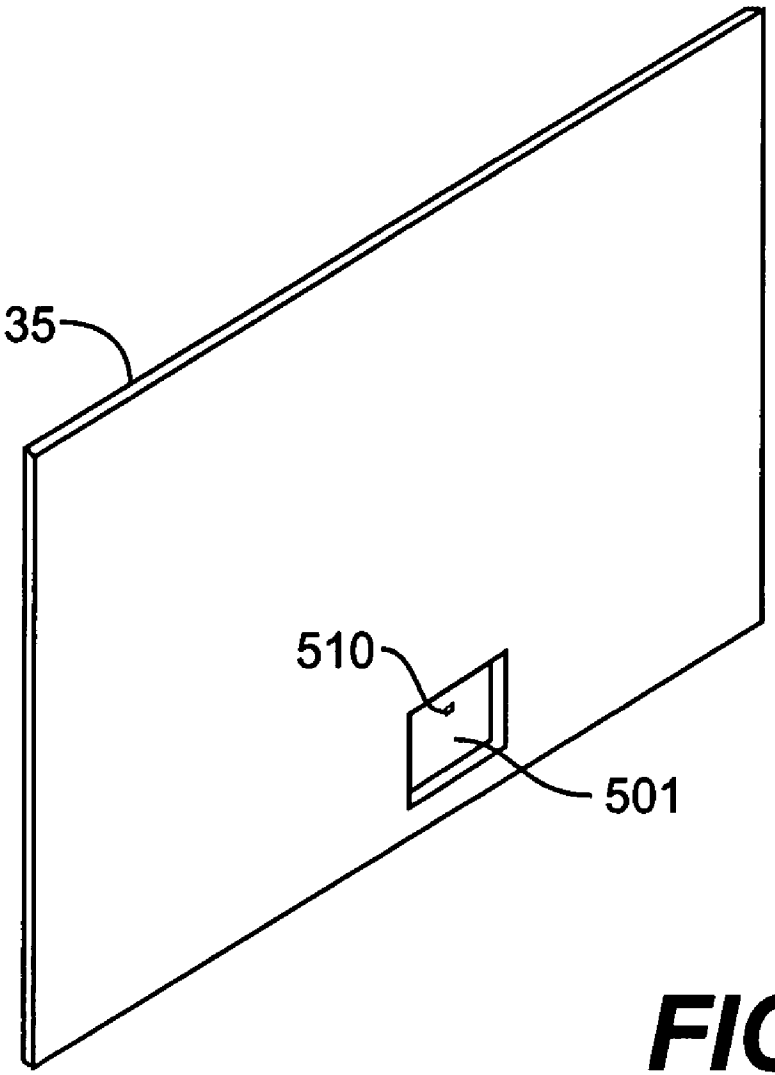

FIGS. 34A-34C show various types of backboard 35 configurations. In FIG. 34A, the backboard 35 may be fabricated from tubular structure 502 with a rectangular metal pocket or a square-shaped recess 501 welded or secured by known means to the tubular structure 502. The recess 501 may include an opening 510 for receiving bolts for securing the plate 42 to the backboard consistent with the present invention. In FIG. 34B, the recess 501 may be nested within the tubular structure 502 as shown and welded or secured by well known mechanical fastening means.

FIG. 34C shows an assembly of an acrylic backboard 35 mounted on the tubular structure 502 (not shown in FIG. 34C). The acrylic backboard includes a section removed for the recess 501 such that the plate 42 (not shown) may be attached consistent with the present invention. It would be obvious to one of ordinary skill that the backboard 35 may be fabricated from other materials than acrylic without deviating from the scope and spirit of the present invention.

Figure 34D:
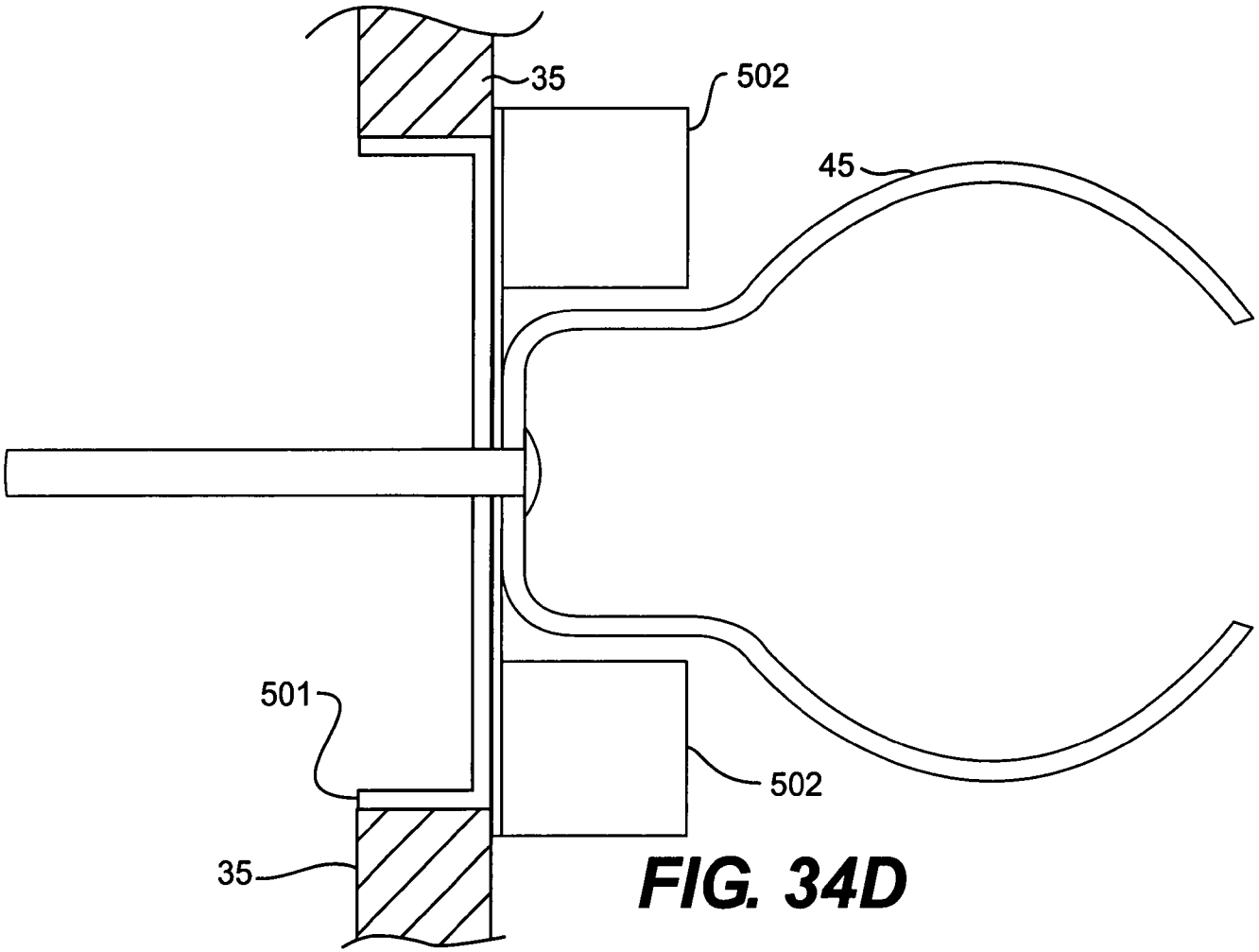

FIG. 34D shows a cross sectional view of the backboard of FIG. 34C and the tubular structure 502 of FIG. 34A. The recess 501 is shown between the acrylic backboard 35 and mounted to the tubular structure 502. The bracket 45 may be inserted between the tubular structure 502 such that a bolt may be place through the opening 510 consistent with the present invention.

Figure 35A:
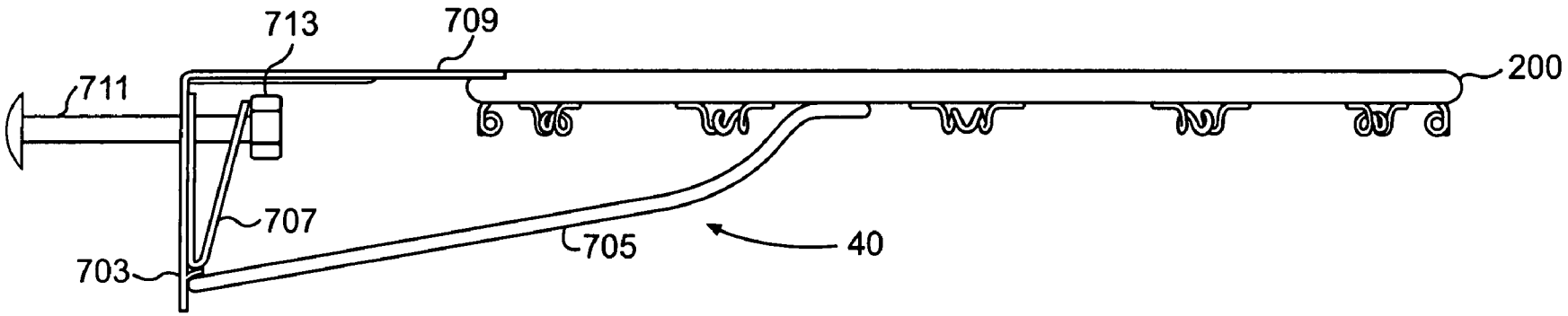
FIGS. 35A-35B show a goal and bracket assembly according to another embodiment of the present invention.

FIG. 35A shows a side view of goal 40 which may include support 705, back plate 703 and rim 700. Also included is a V-spring 707 positioned on the front side of back plate 703 and is structured and arranged to receive carriage bolt 711. The bolt 711 may be secured to backboard 35 (not shown) with hand grippable nut 713.

Figure 35B:
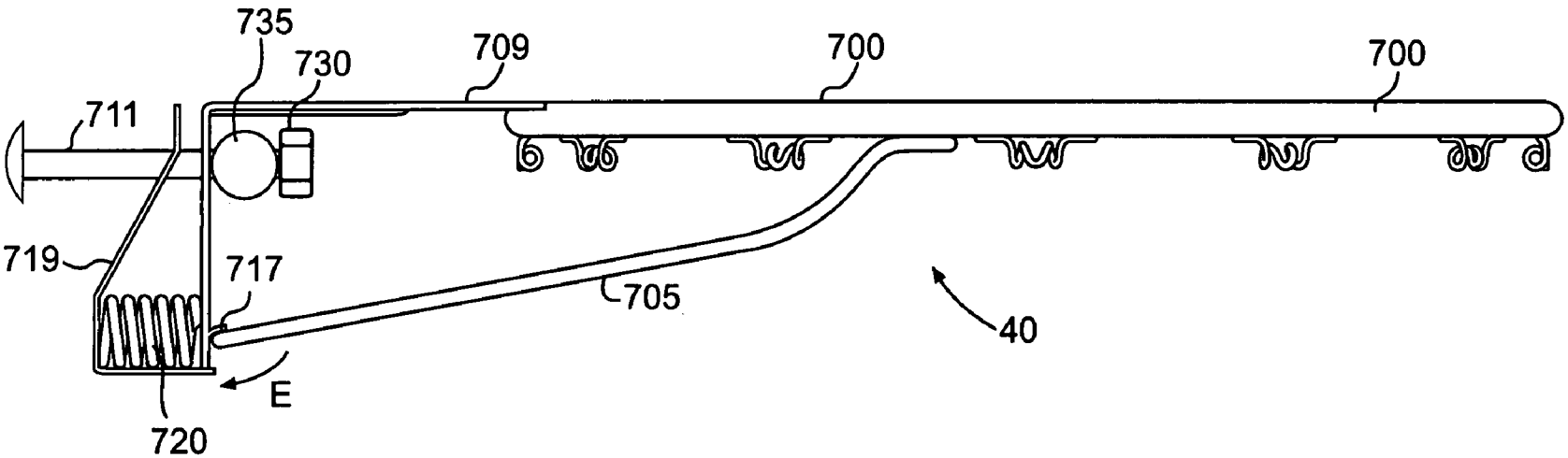

FIG. 35B shows an alternative embodiment of goal 40. In this embodiment of goal 40 may include a pivot point about the roller 735, allowing support 705 or rotate along line E. There may also be a spring loaded section 719 in backboard 35 that includes spring 720 abutting the rear side of backplate 703, where upon rotation about the roller 735, backplate 703 may rotate towards the rear of the backboard 35, thereby compressing the spring 720. The rim plate 709 and backplate 703 may be secured to the backboard 35 by bolt 711 and hand grippable nut 730 combination.

Figure 36:
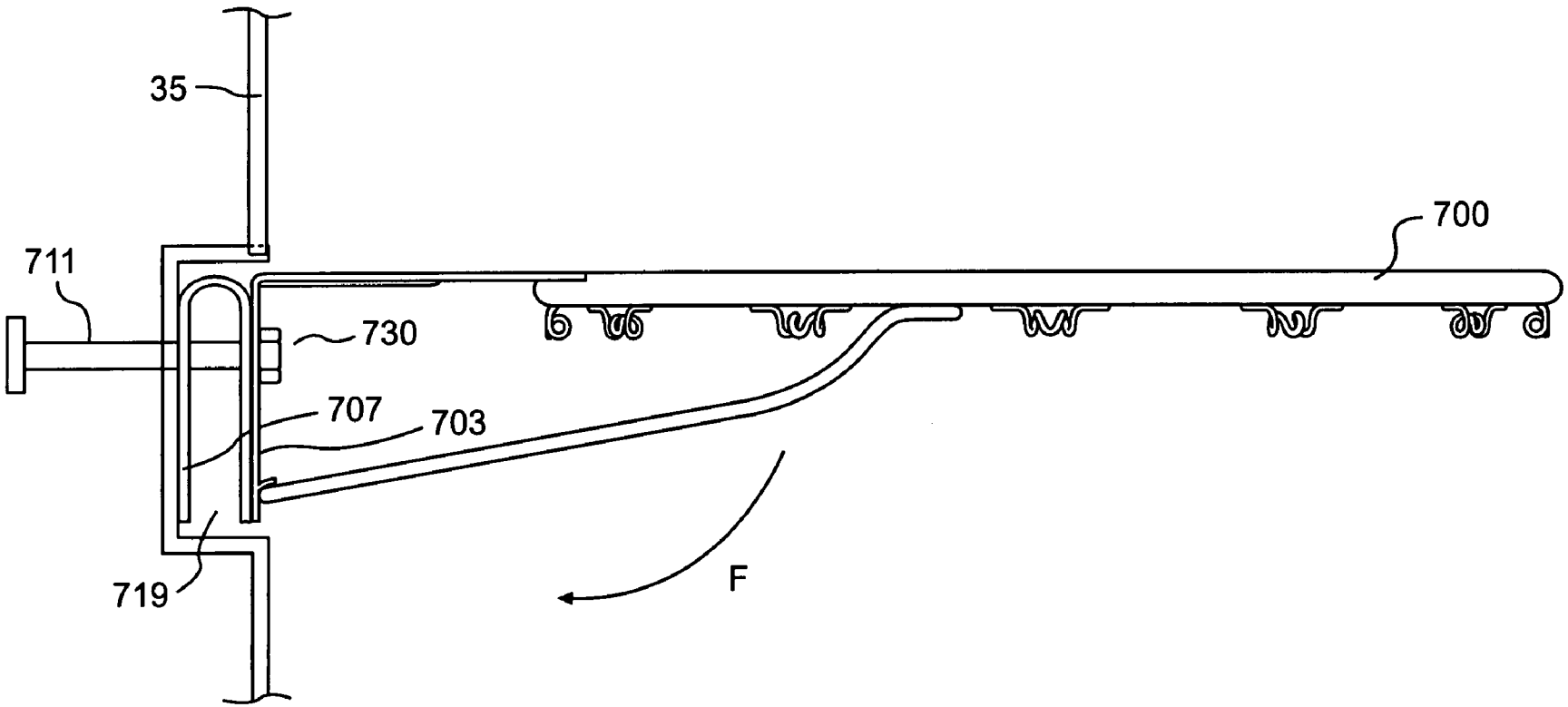
FIG. 36 shows a goal and bracket assembly according to another embodiment of the present invention.

FIG. 36 shows an alternative embodiment of the goal 40. In this embodiment V-Spring 707 may be placed behind back plate 703 and secured via hand grippable nut 730 and bolt 711. The backplate 703 may be structured and arranged to rotate along line F into the spring loaded section 719 of the backboard 35. The V-Spring 707 may bias the backplate 703 toward the position shown in FIG. 36.

It will be apparent to one of skill in the art that described herein is a novel system and method for a basketball assembly without the need for tools. While the invention has been described with reference to specific preferred embodiments, it is not limited to these embodiments. The invention may be modified or varied in many ways and such modifications and variations as would be obvious to one of skill in the art are within the scope and spirit of the invention and are included within the scope of the following claims.

The invention claimed is:

1. A basketball system assemblable without the use of tools, comprising:

a portable base portion having a front end, the front end having a pole slot positioned substantially along a center axis of the base portion;

a pole having a first end with a first opening and a second end with at least one holding pin positioned on the external circumference of the pole;

a wheel assembly secured to the base portion, the wheel assembly comprising a pair of wheels, an axle securing the wheels to the base portion; and a backboard assembly comprising a backboard and goal attached to the first end of the pole; said backboard assembly comprising a pole bracket having a front plate with a second opening and a curved section sized and shaped to mate with the top end of the pole, a backboard having a first recess on a front side with a third opening passing through to a second recess on a backside of the backboard, a coal having a rim and a securing plate having a fourth opening and being sized and shaped to be received in the first recess, a hand grippable securing knob, and a threaded bolt sized and shaped to be received in each of the first, second, third and fourth openings, the knob being sized and shaped to secure the securing plate, the backboard, the bracket and the top end of the pole such that the curved section is secured to the top end of the pole and such that the front plate of the pole bracket abuts the second recess and the securing plate abuts the first recess;

wherein the second end of said pole is engageable with the pole slot and the pole is held in position by inserting the holding pin into the slot and at least partially rotating the pole.

2. The basketball system according to claim 1, further comprising a pair of struts, each strut having a top section and a bottom section, where each strut is connected to the pole at its top section and connected to the base at its bottom section.

3. The basketball system according to claim 2, wherein the struts are pivotally connected to the pole at a position to minimize the shipping dimensions of the system.

4. The basketball system according to claim 2, wherein the top section of each strut is connected to the pole with at least one hand grippable nut and at least one bolt.

5. The basketball system according to claim 2, wherein the bottom section of each strut is connected to the base with at least one hand grippable nut and at least one bolt.

6. The basketball system according to claim 2, wherein the bottom sections of each strut are secured to each other with at least one snap and button connector.

7. The basketball system according to claim 2, wherein the top sections of each strut are connectable with at least one snap and button connector.

8. The basketball system according to claim 2, wherein the bottom sections of each strut are threadably connected to the base.

9. The basketball system according to claim 1, wherein the wheel assembly further includes a wheel bracket, where said axle is rotatably connected to the wheel bracket and the wheel bracket is structured and arranged to securably engage the second end of the pole.

10. The basketball system according to claim 9, wherein the wheel assembly further includes a rectangular bracket and said pole includes a bracket slot on the second end, the bracket slot being structured and arranged to receive the rectangular bracket and the wheel bracket being securably engaged to the rectangular bracket by a hand grippable bolt.

11. The basketball system according to claim 1, wherein the base further includes an anchor section and the second end of a the pole is structured and arranged to receive the axle of the wheel assembly, the anchor section has a cam portion which is structured and arranged to lockably receive the axle such that the pole is secured to the base in a substantially vertical position.

12. The basketball system according to claim 1, wherein the pole further comprises a cross plate affixed to the second end.

13. The basketball system according to claim 12, wherein the cross plate includes a threaded portion and at least one depression.

14. The basketball system according to claim 12, wherein the wheel assembly further comprises a wheel bracket, the wheel bracket including a bolt sized and shaped to be received into the threaded portion of the cross plate.

15. The basketball system of claim 1, wherein the goal is slidably attachable to the backboard.

16. The basketball system of claim 1, wherein the backboard assembly further comprises:

a pole bracket having a plate with a second opening and coupled with the first end of the pole;

a hand grippable securing knob; and a threaded bolt, wherein the backboard includes a first side having a first recess, a second side having a second recess, with a third opening passing between the first and second recess;

wherein the goal includes a securing plate having a fourth opening and configured to be received in the first recess;

wherein the threaded bolt is configured to be received in each of the first, second, third and fourth openings; and wherein the knob is configured to secure the securing plate, the backboard, the bracket and the first end of the pole such that the pole bracket is secured to the first end of the pole and such that the plate of the pole bracket abuts the second recess and the securing plate abuts the first recess.

17. The basketball system according to claim 16, further comprising a rim seat disposed between the securing plate and the backboard, the rim seat including a plate lip structured and arranged to receive and nest the securing plate therein.

* * * * *